US006097908A

United States Patent [19]

Uchiyama et al.

[11] Patent Number: 6,097,908

[45] **Date of Patent: *Aug. 1, 2000**

[54] ELECTRICAL CONNECTOR, PROCESS CARTRIDGE AND ELECTROPHOTOGRAPHIC IMAGE FORMING APPARATUS

[75] Inventors: Seiji Uchiyama, Numazu; Kazushi Watanabe; Atsushi Numagami, both of Mishima; Katsunori Yokoyama, Susono, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/787,327

[22] Filed: Jan. 28, 1997

[30] Foreign Application Priority Data

Jan. 31, 1996 [JP] Japan ..... 8-037304

[51] Int. Cl.[7] ..... G03G 21/16; G03G 15/00; H01R 13/42

[52] U.S. Cl. ..... 399/111; 399/90; 439/248

[58] Field of Search ..... 399/111, 90, 1, 399/83; 439/248

[56] References Cited

U.S. PATENT DOCUMENTS

| | | | |
|---|---|---|---|
| 4,963,939 | 10/1990 | Kurando . | |
| 4,965,633 | 10/1990 | Surti . | |
| 5,095,335 | 3/1992 | Watanabe et al. | 355/210 |
| 5,125,846 | 6/1992 | Sampson et al. | 439/66 |
| 5,283,613 | 2/1994 | Midgley . | |
| 5,286,222 | 8/1981 | Yagi et al. | 439/607 |
| 5,331,372 | 7/1994 | Tsuda et al. | 355/200 |
| 5,345,294 | 9/1994 | Nomura et al. | 355/200 |
| 5,404,198 | 4/1995 | Noda et al. | 355/200 |
| 5,470,635 | 11/1995 | Shirai et al. | 428/131 |
| 5,475,470 | 12/1995 | Sasago et al. | 355/210 |
| 5,485,245 | 1/1996 | Kobayashi et al. . | |
| 5,488,459 | 1/1996 | Tsuda et al. | 355/211 |
| 5,500,714 | 3/1996 | Yashiro et al. | 355/200 |
| 5,510,878 | 4/1996 | Noda et al. | 355/211 |
| 5,512,988 | 4/1996 | Donaldson . | |
| 5,543,898 | 8/1996 | Shishido et al. | 355/210 |
| 5,583,613 | 12/1996 | Kobayashi et al. | 355/200 |
| 5,602,623 | 2/1997 | Nishibata et al. | 399/111 |
| 5,608,509 | 3/1997 | Shirai et al. | 399/351 |
| 5,708,912 | 1/1998 | Lee | 399/24 |

FOREIGN PATENT DOCUMENTS

| | | |
|---|---|---|
| 0 395 320 | 4/1990 | European Pat. Off. . |
| 0 612 124 | 8/1994 | European Pat. Off. . |
| 4 114 921 | 11/1992 | Germany . |
| 195998 | 12/1992 | Taiwan . |

OTHER PUBLICATIONS

Patent Abstract of Japan, vol. 007, No. 249, (P–234), Nov. 4, 1983 (JP 58–132758).

Patent Abstract of Japan, vol. 017, No. 424 (E–1410), Aug. 6, 1993 (JP 05–089933).

Patent Abstract of Japan, vol. 13, No. 537 (P–968), Nov. 30, 1989 (JP 01–221765).

Patent Abstract of Japan, vol. 017, No. 525 (E–1436), Sep. 21, 1993 (JP 05–144498).

*Primary Examiner*—Richard Moses

*Attorney, Agent, or Firm*—Fitzpatrick, Cella, Harper & Scinto

[57] ABSTRACT

An electrical connector electrically connectable with a main assembly connector, provided in a main assembly of an electrophotographic image forming apparatus includes storing member for storing information; a plurality of electrical contacts for separably connecting with a contact of the main assembly connector, when they are connected electrically with the main assembly connector; wherein the storing member is electrically connected with each of the electrical contacts with lead lines.

109 Claims, 13 Drawing Sheets

ELECTRICAL CONNECTOR, PROCESS CARTRIDGE AND ELECTROPHOTOGRAPHIC IMAGE FORMING APPARATUS

FIELD OF THE INVENTION AND RELATED ART

The present invention relates to an electrical connector, a process cartridge, and an electrophotographic image forming apparatus.

As discussed in this specification, an electrophotographic image forming apparatus includes an electrophotographic copy machine, an electrophotographic printer (LED printer, laser beam printer, and the like), an electrophotographic facsimile apparatus, an electrophotographic word processor, and the like. Also as used in this specification, the term process cartridge refers to such a process cartridge that is removably installable in the main assembly of an electrophotographic image forming apparatus, and integrally comprises an electrophotographic photosensitive member, as well as a charging means, a developing means, and/or a cleaning means. It also refers to a process cartridge that is removably installable in the main assembly of an image forming apparatus, and integrally comprises an electrophotographic photosensitive member, and at least a developing means.

Further, the present invention relates to any unit removably installable in the main assembly of an image forming apparatus. More specifically, it relates to any unit such as a developing device, a toner cartridge, a process cartridge, or the like, which is removably installable in the main assembly of an image forming apparatus.

It is common knowledge that some image forming apparatuses, such as a copy machine or a laser beam printer, which employ an electrophotographic image formation process, can be rendered maintenance-free with the use of a process cartridge which integrally comprises an electrophotographic photosensitive member, and one or a plurality of processing means, such as a cleaning unit or a development unit, which acts on the electrophotographic photosensitive member.

In the case of such an image forming apparatus as described above, after the functions of the structural components in a process cartridge deteriorate due to usage, the process cartridge is entirely replaced with a fresh process cartridge. This process cartridge replacement operation is an extremely simply operation comprising a step of opening the main assembly of the image forming apparatus, a step of removing the process cassette with worn components out of the main assembly of the image forming apparatus, and a step of installing a fresh process cartridge in the main assembly of the image forming apparatus. Therefore, such an image forming apparatus can be easily maintained by a user alone.

Recently, the aforementioned conventional art has been further developed to improve the usability of the above described image forming apparatus. More specifically, it has been considered to add the following functions to the above image forming apparatus:

(1) Data storing function: data regarding manufacturing conditions and the like are written into an electronic device such as a memory provided in a process cartridge, at the time of manufacturing or shipment, and when the process cartridge is installed in the main assembly of an image forming apparatus, the data is looked up by the image forming apparatus in order to carry out an image forming operation under the optimum condition for the process cartridge.

(2) Toner remainder reporting function: the amount of the remaining toner is sequentially detected during the image forming operation, and is stored in the memory so that the data regarding the amount of the remaining toner can be sequentially looked up.

(3) Self diagnostic function: the diagnosis data for the main assembly of an image forming apparatus is stored in the memory of the process cartridge, in order to allow a service supplier to look up the stored diagnostic data to provide fast maintenance service, or to efficiently deal with an anomaly.

In order to add the above functions to an image forming apparatus, it is necessary to mount an electronic device, such as an EEPROM or the like, in a unit such as a process cartridge which is removably installable in the image forming apparatus. As the means for mounting the electronic device in the process cartridge, it is conceivable to provide the process cartridge with a printed circuit on which electronic devices such as a memory, and a connector, have been mounted.

Generally, the aforementioned non-volatile memory and connector are mounted on the printed circuit provided in a process cartridge, along with the electrically functional components such as a diode, a resistor, or a condenser, which protects the IC from an electrical surge.

SUMMARY OF THE INVENTION

A primary object of the present invention is to provide an electrical connector which makes it easier to mount a memory in a unit such as a process cartridge, which is removably mountable in an image forming apparatus, as well as to provide a unit which is removably mountable in an image forming apparatus and comprises such an electrical connector, and an image forming apparatus compatible with such a unit.

Another object of the present invention is to provide an electrical connector which makes it possible to compactly mount a memory in a unit such as a process cartridge which is removably mountable in an image forming apparatus, as well as to provide a unit which is removably mountable in an image forming apparatus and comprises such an electrical connector, and an image forming apparatus compatible with such a unit.

Another object of the present invention is to provide an electrical connector which makes it possible to reliably establish an electrical connection between a memory and the main assembly of an electrophotographic image forming apparatus, as well as to provide a unit which is removably mountable in an image forming apparatus, and an image forming apparatus compatible with such a unit.

Another object of the present invention is to provide an electrical connector comprising a memory, a unit comprising such an electrical connector, and an image forming apparatus compatible with such a unit.

According to an aspect of the present invention, there is provided an electrical connector electrically connectable with a main assembly connector, provided in a main assembly of an electrophotographic image forming apparatus, comprising a storing member for storing information; a plurality of electrical contacts for separably connecting with a contact of the main assembly connector, when they are connected electrically with the main assembly connector; wherein the storing member is electrically connected with each of the electrical contacts with lead lines.

According to another aspect of the present invention, an electrical connector comprises storing means for storing data, and a plurality of electrical terminals which are connected to, or disconnected from, the corresponding electrical terminals of the counterpart connector provided on the main assembly side of an image forming apparatus, wherein the storing means is electrically connected to each of the plurality of electrical terminals by a lead wire, and a unit removably installable in an image forming apparatus comprises such an electrical connector. Further, an image forming apparatus is rendered compatible with such a unit.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, preferred embodiments of the present invention will be described in detail with reference to the drawings.

Embodiment 1

Figure 1:
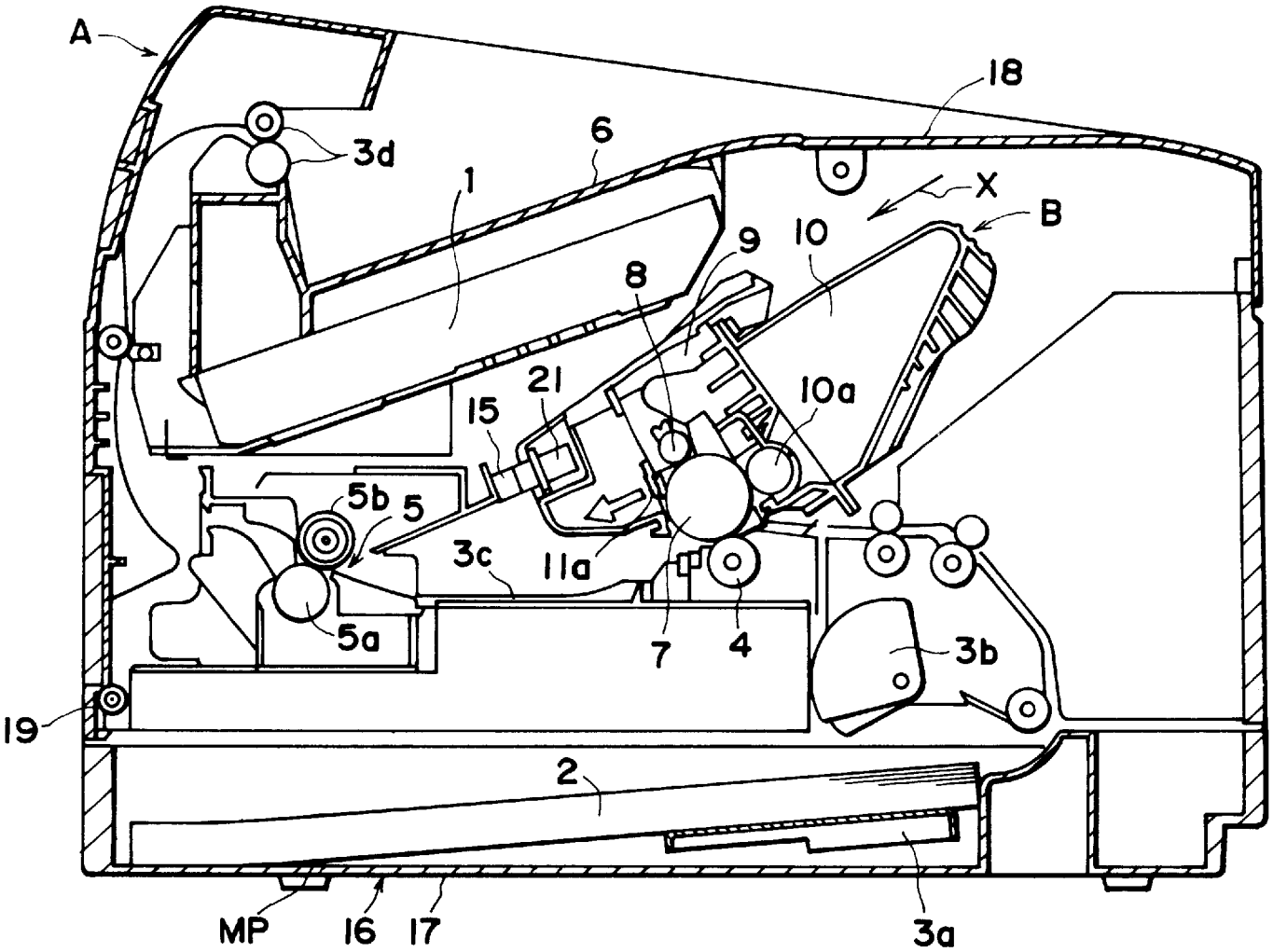
FIG. 1 is a longitudinal sectional view of a process cartridge comprising a connector in accordance with the present invention, and an image forming apparatus containing such a process cartridge.
Figure 2:
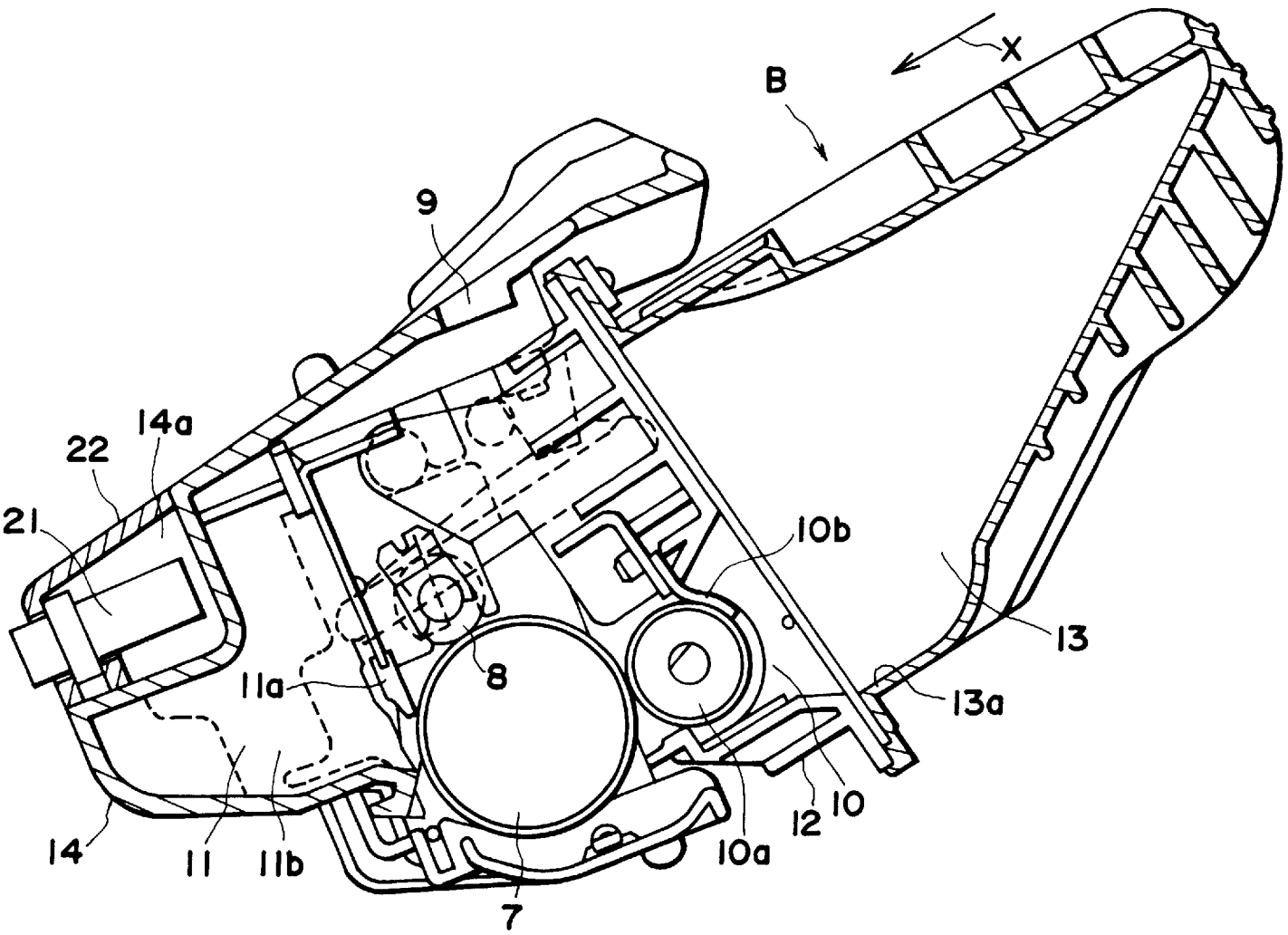
FIG. 2 is a cross-sectional view of a process cartridge comprising a connector in accordance with the present invention.

FIG. 1 is a sectional view of an image forming apparatus in which a process cartridge in accordance with the present invention is disposed. In this embodiment, the image forming apparatus in in the form of a laser beam printer. FIG. 2 is a sectional view of the process cartridge disposed in the image forming apparatus illustrated in FIG. 1.

Referring to FIG. 1, the image forming apparatus A in this embodiment contains a process cartridge B comprising a photosensitive drum, that is, an electrophotographic photosensitive member in the form of a drum. An optical image reflecting image data is projected from an optical system 1 onto this photosensitive drum 7 to form an electrostatic latent image. The electrostatic latent image is developed into a visible image, that is, a toner image, by the developing means 10 of the process cartridge, and the developer contained in the developing means. In synchronism with the toner image formation, a recording medium 2 is delivered by a conveying means 3*a* and 3*b*. The toner image, having been formed on the photosensitive drum 7, is transferred onto the recording medium 2 by a transferring means 4, and then, the recording medium 2 is conveyed to a fixing means 5 by a conveying means 3*c*. After the transferred toner image is fixed to the recording medium 2 by the pressure roller 5*a* and fixing roller 5*b* of the fixing means 5, the recording medium 2 is discharged into a delivery portion 6 by a conveying means 3*d*.

The main assembly 16 of the image forming apparatus A comprises a bottom frame 17 and a top frame 18. The bottom and top frames 17 and 18 are connected with a hinge 19 so that the top frame 18 can be opened or closed relative to the bottom frame 17. The bottom frame 17 holds a paper magazine MP in which the recording medium 2 is loaded, the major portion of the conveying means 3*a*, 3*b* and 3*d*, the transferring means 4, the fixing means 5, and the like. The top frame 18 holds the optical system 1, and the rest of the conveying means.

In order to install the process cartridge B, first, the top frame 18 is rotated about the hinge 19 in the counterclockwise direction in FIG. 1 to create an opening between the top and bottom frames 17 and 18. Then, the process cartridge B is inserted through the opening, diagonally downward from the top right to the bottom left along the guide portion (unillustrated) provided in the bottom frame 17. As the process cartridge B is inserted, its position is fixed by an unillustrated positioning member, and at the same time, an I/O connector 15 provided in the bottom frame 17 is engaged with the I/O connector 21 of the process cartridge B.

In order to remove the process cartridge B from the image forming apparatus main assembly 16, the top frame 18 is opened, and the process cartridge B is pulled out in the diagonally upward direction from the bottom left to the top right of FIG. 1. During this removal, the I/O connectors 15 and 21 are automatically disengaged from each other.

Referring to FIG. 2, the process cartridge B in this embodiment comprises the aforementioned photosensitive member 7, and processing means, which act on the photosensitive member 7. The processing means includes a charging means 8 (for example, charge roller illustrated in FIG. 2) for charging the surface of the photosensitive drum 7, an exposing portion 9 through which an optical image is projected onto the charged surface of the photosensitive member 7 from the optical system 1, the aforementioned developing means 10 for developing the latent image formed on the photosensitive member 7, and a cleaning means 11 comprising a cleaning blade 11*a* and a toner collector 11*b*. The developing means 10 comprises a developer container 13, a development roller 10*a*, and a toner regulator blade 10*b*. The developer container 13 holds the toner. The development roller 10*a* is disposed in a development frame 12 in a manner to adjoin the photosensitive drum 7. The toner regulator blade 10*b* is placed in contact with the development roller 10*a*. The development frame 12 is united with the developer container 13, wherein their internal spaces are connected through an opening 13*a*.

After the toner image is transferred onto the recording medium 2 by the transferring means 4 (transfer roller), the photosensitive drum 7 of the process cartridge B is cleaned by the cleaning blade 11*a* to remove the toner remaining on the photosensitive drum 7, becoming prepared for the following image formation.

Figure 3:
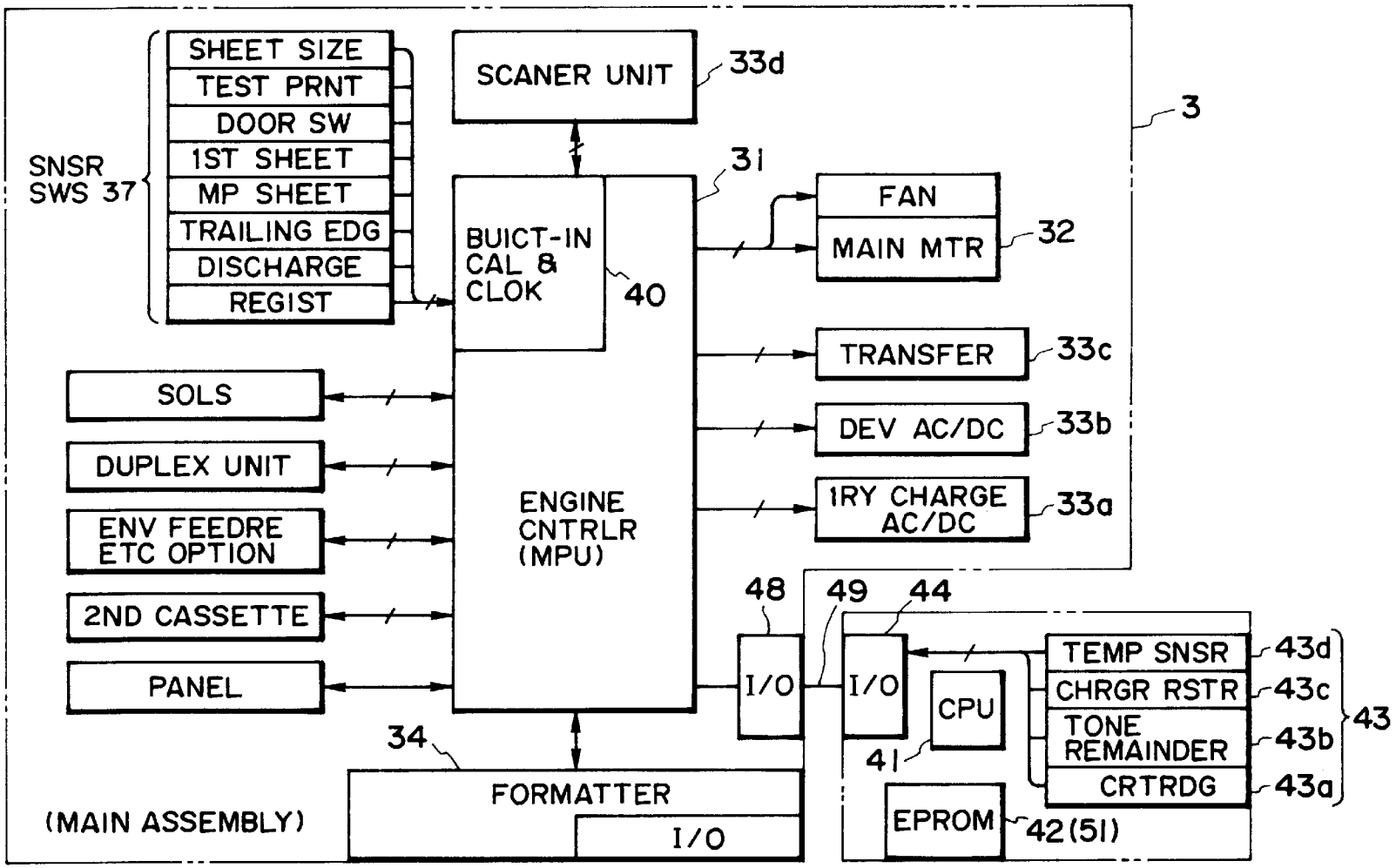
FIG. 3 is a block diagram for controlling the image forming apparatus illustrated in FIG. 1.

FIG. 3 is a block diagram for controlling the electrophotographic image forming apparatus and process cartridge in this embodiment. In this diagram, only the diagram portion related to the actual control system is depicted, without depicting the electric power source and the like. First, the basic control of the image forming apparatus will be described.

In FIG. 3, the portion of the electronic device, which is in the image forming apparatus main assembly 16, is surrounded with a double-dot chain line 30. An engine controller (MPU) 31 has a computing function, a memory function, an internal clock function, and a function to input/output signals. Normally, it is a device in the form of an ASiC or the like. To this engine controller 31, a main motor control block 32, a primary charge voltage/current control block 33*a*, a development bias voltage control block 33*b*, a transfer voltage control block 33*c*, and a scanner unit control block 33*d* are connected to control each unit by the programs in the engine controller 31.

Also within the image forming apparatus main assembly 16, various sensor switches constituting a sensor switch group 37 are disposed at appropriate locations, and the output of the sensor switch group 37 is transmitted to the engine controller 31 so that the operational conditions of the various portions of the apparatus can be monitored by the engine controller 31 throughout a printing operation sequence. Also, a formatter 34 is connected to the engine controller 31. The formatter 34 is a device which has a function for storing printing formats, a function for developing the printing formats into image data, and also functions as an input/output port. In other words, it functions as a pre-processor for the engine controller 31.

In FIG. 3, the area surrounded by a double-dot chain line, which is designated by a reference code C', is the portion which is mounted in the process cartridge B. At the same time as the process cartridge B is installed into the image forming apparatus main assembly 16, the engine controller 31 of the image forming apparatus main assembly 16 and the circuit portion C' mounted in the process cartridge B are electrically connected through the I/O connector 49. The engine controller 31 is connected to the input/output device (I/O port) 44 of the process cartridge B through the input/output port of the circuit portion of the image forming apparatus main assembly 16 and the input/output connector 49, so that the engine controller 31 is allowed to communicate with the computing device of the process cartridge B, and also to refer to the data from the sensor group 43 of the process cartridge B.

Next, the functions of the portion C' mounted on the process cartridge side will be described. The sensor group 43 on the process cartridge side comprises a cartridge sensor 43*a* based on a limit switch or the like, a toner remainder detection sensor 43*a* based on capacitance detection or light quantity detection, a charger resistance sensor 43*c* for detecting condensation and short circuit by detecting the electrical resistance of a charging means 8, a temperature sensor 34*d* for detecting the temperature increase of the process cartridge B, and the like. These sensors are connected to the input/output port 44 of the process cartridge B.

Also, a memory device 42 is mounted in the process cartridge B. In this embodiment, a rewritable EP ROM is employed as the memory device 42 (storing member). Also in this embodiment, a serial port is employed as an input/output port for exchanging input and output signals between the aforementioned engines controller 31 of the image forming apparatus main assembly 16 and the computing device 41 on the process cartridge side, to reduce the number of contact points so that contact failure or the like can be prevented.

An example of how the control circuit portion C' is mounted in the process cartridge B is depicted in FIG. 2. This portion C' of the control circuit may be disposed anywhere in the process cartridge B. In this embodiment, however, it is disposed in a cleaning frame 14 which plays a role of a positional reference for fixing the position of the process cartridge B in the image forming apparatus main assembly 16. More specifically, it is attached to the end portion of the cleaning frame 14, that is, a point farthest from the noise source such as the charge unit, the transfer unit, and the like. Also, more specifically, the cleaning frame 14 is provided with a recess 14*a*, as seen from outside, and an I/O connector 21 is disposed under a cover 22 which is fixed to the cleaning frame 14 in a manner to cover the recess 14*a*. As shown in FIG. 2, the cleaning frame 14 holds the photosensitive drum 7, the charging means 8, and the cleaning means 11. The development frame holds the developing means 10, and is connected to the cleaning frame 14 in a manner to allow them to pivot relative to each other.

Referring again to FIG. 1 in which a process cartridge comprising the aforementioned control circuit portion is in the image forming apparatus main assembly 16, the I/O connector portion 21 of the process cartridge B in the image forming apparatus main assembly 16 is connected to the I/O connector portion 15 of the image forming apparatus main assembly 16, forming the I/O connector 49 illustrated in FIG. 3. These connector portion 21 and 15 are structured in such a manner that they are automatically engaged with each other as the process cartridge B is inserted into the image forming apparatus main assembly 16.

In this embodiment, the I/O connector portions 15 and 21, which constitute the I/O connector 49, is described as components comprising the contacts, for connecting the IC and the engine controller 31. However, they may comprise contacts for connecting the sensor group 42 on the process cartridge side to the engine controller 31, in addition to the contacts for connecting the IC and the engine controller 31, or they may comprise only the contact for connecting the IC and the engine controller 31.

Figure 4:
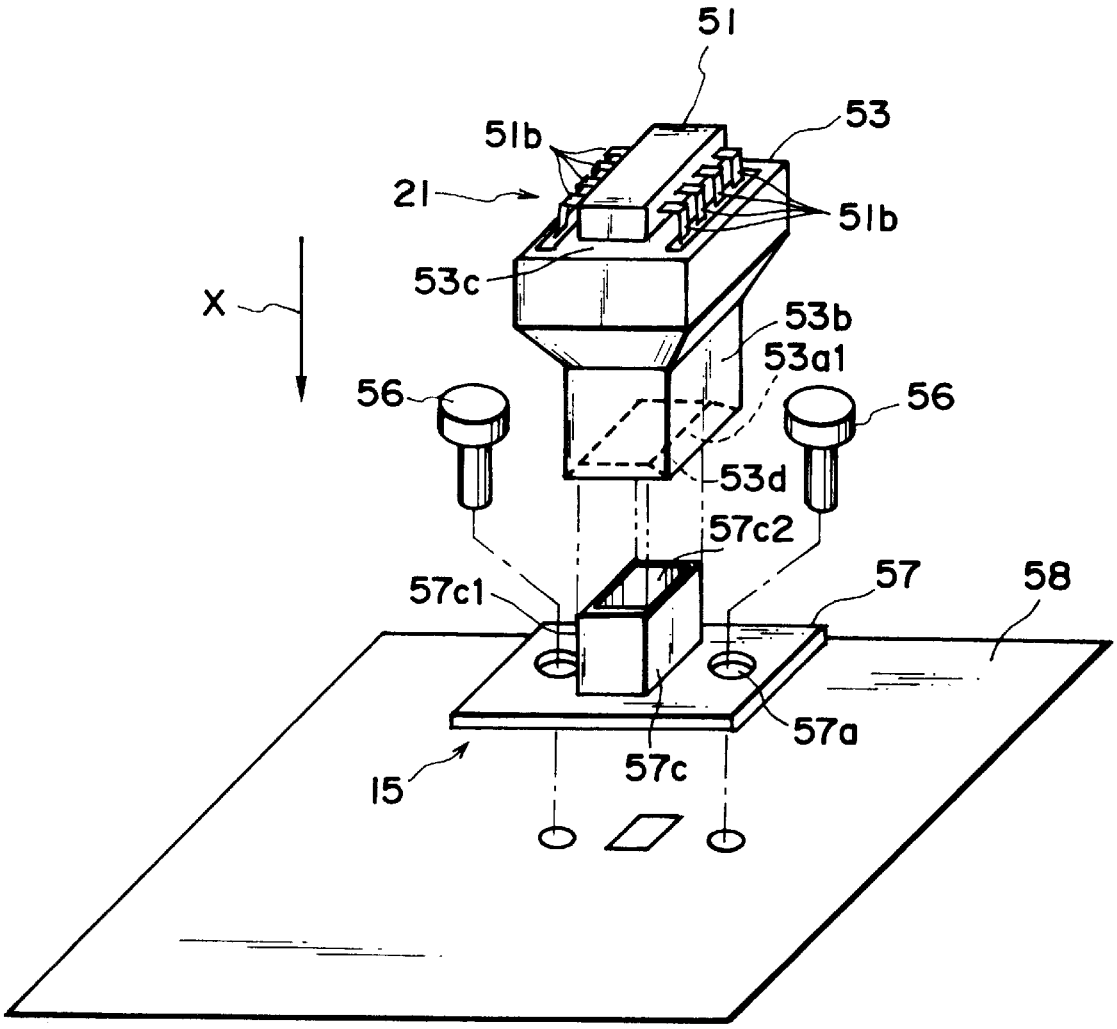
FIG. 4 is a perspective view of the connector in the first embodiment of the present invention, depicting the structure thereof.

Referring to FIG. 4 which depicts the aforementioned I/O connector portions 15 and 21, the connectors employed in this embodiment will be described. FIG. 4 is a perspective view of a connector, and depicts the structure thereof. An IC (integrated circuit) 51 (storing member) is mounted in the connector main structure 53 on the process cartridge side. The connector main structure 53 is a structural component which integrally comprises an IC socket and the connector. A connector main structure 57 on the image forming apparatus main assembly side, which is the counterpart of the connector main structure 53 on the process cartridge side, is also a structural component, and is mounted on the connector mount 58 with the use of small screws 56. The small screw 56 is put through hole 57*a* of the connector main structure 57, and is screwed into the female screw 58*a* of the connector mounts 58 of the image forming apparatus main assembly 16.

Figure 5:
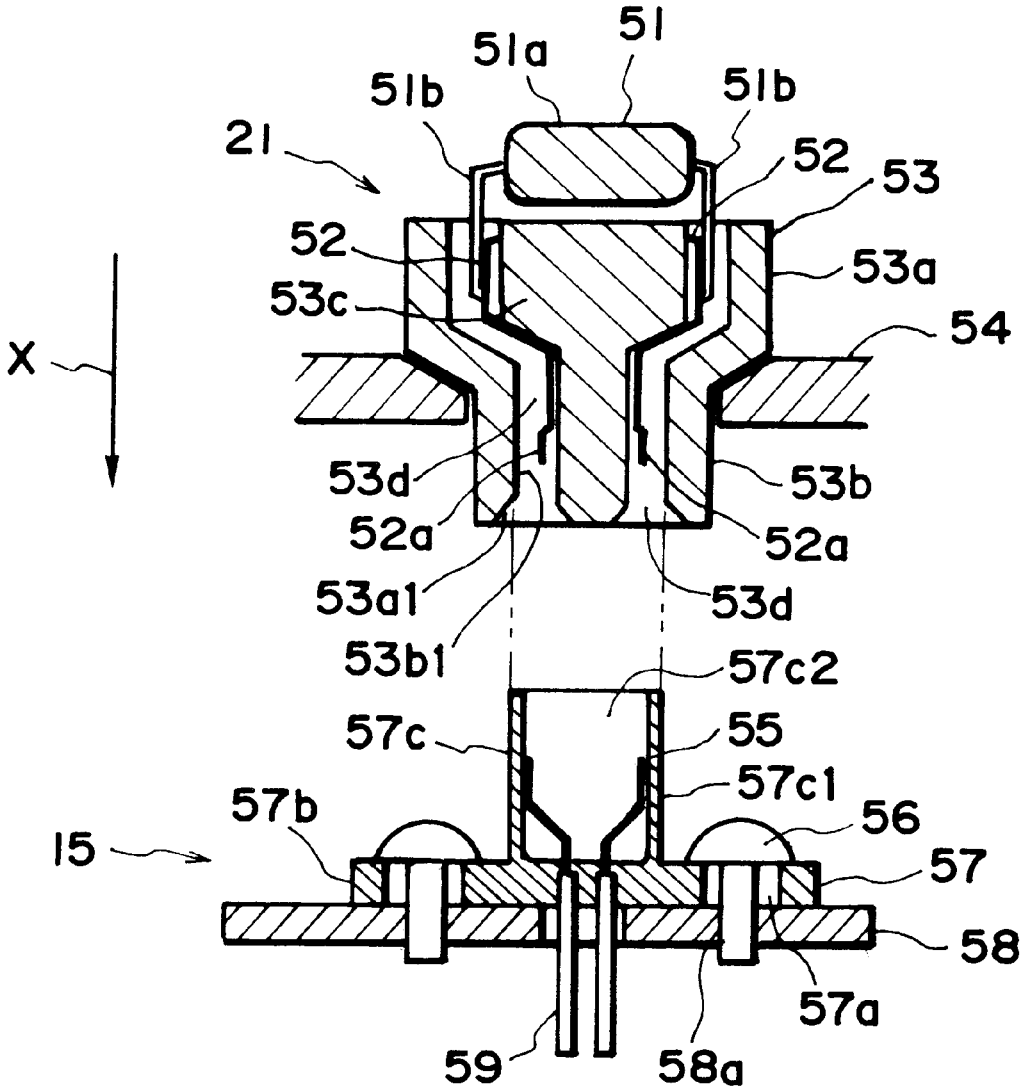
FIG. 5 is a longitudinal sectional view of the connector in the first embodiment of the present invention, depicting the structure thereof.

FIG. 5 is a sectional view of the connector illustrated in FIG. 4.

In this embodiment, the connector main structure 53 on the process cartridge side contains a contact 52 which is placed in contact with the IC 51. This connector main structure 53 on the process cartridge side is fixed to the process cartridge B. As for the connector main structure 58 on the image forming apparatus main assembly side, which is the counterpart of the connector main structure 53 on the process cartridge side, is fixed to the connector mount 58, that is, a part of the image forming apparatus main assembly 16, with the use of the small screw 56. However, since the connector main structure 53 attached to the process cartridge B side is firmly fixed to the process cartridge B, it is necessary to make it sure that imperfect alignment between the process cartridge B and the image forming apparatus main assembly 16 does not generate stress in the connector main structures 53 and 57. Therefore, the connector main structure 57 on the image forming apparatus main assembly side must be floatingly attached to the connector mount 58 of the image forming apparatus main assembly 16. FIG. 5, a sectional view, depicts a connector designed in consideration of such a requirement. More specifically, the diameter of the hole 57*a* of the connector main structure 57 on the image forming apparatus main assembly side is rendered slightly larger than that of the small screw 56 to create a gap large enough to compensate for the aforementioned misalignment. Therefore, even though the small screw 56 is firmly screwed into the female screw 58*a* of the connector attachment portion 58 of the image forming apparatus main assembly 16, the connector main structure 57 on the image forming apparatus main assembly side is floatingly attached to the connector mount 58 of the image forming apparatus main assembly 16.

Next, the structures of the I/O connectors 15 and 21 will be described.

The connector main structure 53 on the process cartridge side is formed of synthetic resin. It is hollow, and has a substantially square cross-section. Its base side half (top side in the drawings) is larger than its engagement portion side (bottom side in the drawings). In the internal space of the connector main structure on the process cartridge side is occupied by the IC mount 53*c*. The IC mount 53*c* is integrally formed with the connector main structure 53, or is first formed independently from the connector main structure 53, and then attached to the external wall portion 53*a* and engagement portion wall 53*b* of the connector main structure 53. The longitudinal section of the IC mount 53 is in the form of a character T as shown in FIG. 5. The surface of the IC mount 53*c* and the base side external wall 53*a*, and the surface of the IC mount 53*c* and the engagement portion side external wall 53*b*, form a continuous terminal mounting space 53*d* which opens outward at the top and bottom. The contact 52 is disposed in the IC mounting space, substantially in contact with the IC mount 53*c* except for a contact portion 52*a*, the bottom end portion. More specifically, in order to assure that the contact 52 is reliably placed in contact with the contact 53 on the image forming apparatus main assembly side, the bottom end of the contact 52 is bent outward to form the contact portion 52*a*. As for the IC 51, the main structure 51*a* of a chip is disposed directly above the IC mount 53*c*, with the provision of a predetermined gap. The lead wires 51*b* of the IC 51 are inserted from above into the electrode mounting space 53*d*, and made to directly press on the contact 52. The IC 51 is electrically connected to each of the contacts 52, by one of the lead wires 51*b*.

The connector main structure 57 on the image forming apparatus main assembly side integrally comprises a mount portion 57*b* provided with the aforementioned hole 57*a* for the small screw, and an engagement portion 57*c* in the form of a rectangular parallelepiped. Wiring 59 is connected to a contact 55 fixed to the contact main structure 57 on the image forming apparatus main assembly side. The contact 55 is in contact with the internal surface of the engagement portion 57*c*. A reference symbol 57*c*2 designates a cavity provided in the engagement portion 57*c*. As the process cartridge B is inserted into the image forming apparatus main assembly 16, the internal periphery 53*b*1 of the engagement portion 53*b* of the connector main structure 53 on the process cartridge side fits against the external periphery 57*c*1 of the engagement portion 57*c* of the connector main structure 57 on the image forming apparatus main assembly side, and the contact portion 52*a* of the contact 52 on the process cartridge side is pressed against the contact 55 on the image forming apparatus main assembly side, being elastically bent inward, and establishes an electrical connection. In other words, when the connector main structure 53 on the process cartridge side is electrically connected to the connector main structure 57 on the image forming apparatus main assembly side, the engagement portion 57*c* of the image forming apparatus main assembly side fits into the space 53*d* of the connector main structure 53 on the process cartridge side. As a result, the contact 52 of the connector main structure 53 fits into the aforementioned cavity 57*c*2, and comes in contact with the contact 55 disposed in the cavity 57*c*2. The IC 51 is behind the contact 52 relative to the direction (direction of an arrow mark X) in which the connector main structure 53 is fitted with the connector main structure 57. The bottom end of the external wall 53*a* of the connector main structure 53, which first comes in contact with the connector main structure 57 when the two are connected, is provided with a tapered portion 53*a*1 by which the connector main structure 53 is guided.

In the drawing, the connector main structure 53 on the process cartridge side, and the mount portion 54 for the connector main structure 53 are schematically drawn to show the direct attachment of the former to the latter. However, the manner in which the I/O connector portion 21 is attached to the process cartridge B is not limited to the direct attachment depicted in the drawing. The connector mount portion 54 on the process cartridge side may be, for example, a part of the cover 22 attached to the cleaning frame 14 of the process cartridge B shown in FIG. 2.

Next an example of how to attach the connector on the process cartridge side to the process cartridge with the use of a support member will be described.

Figure 6:
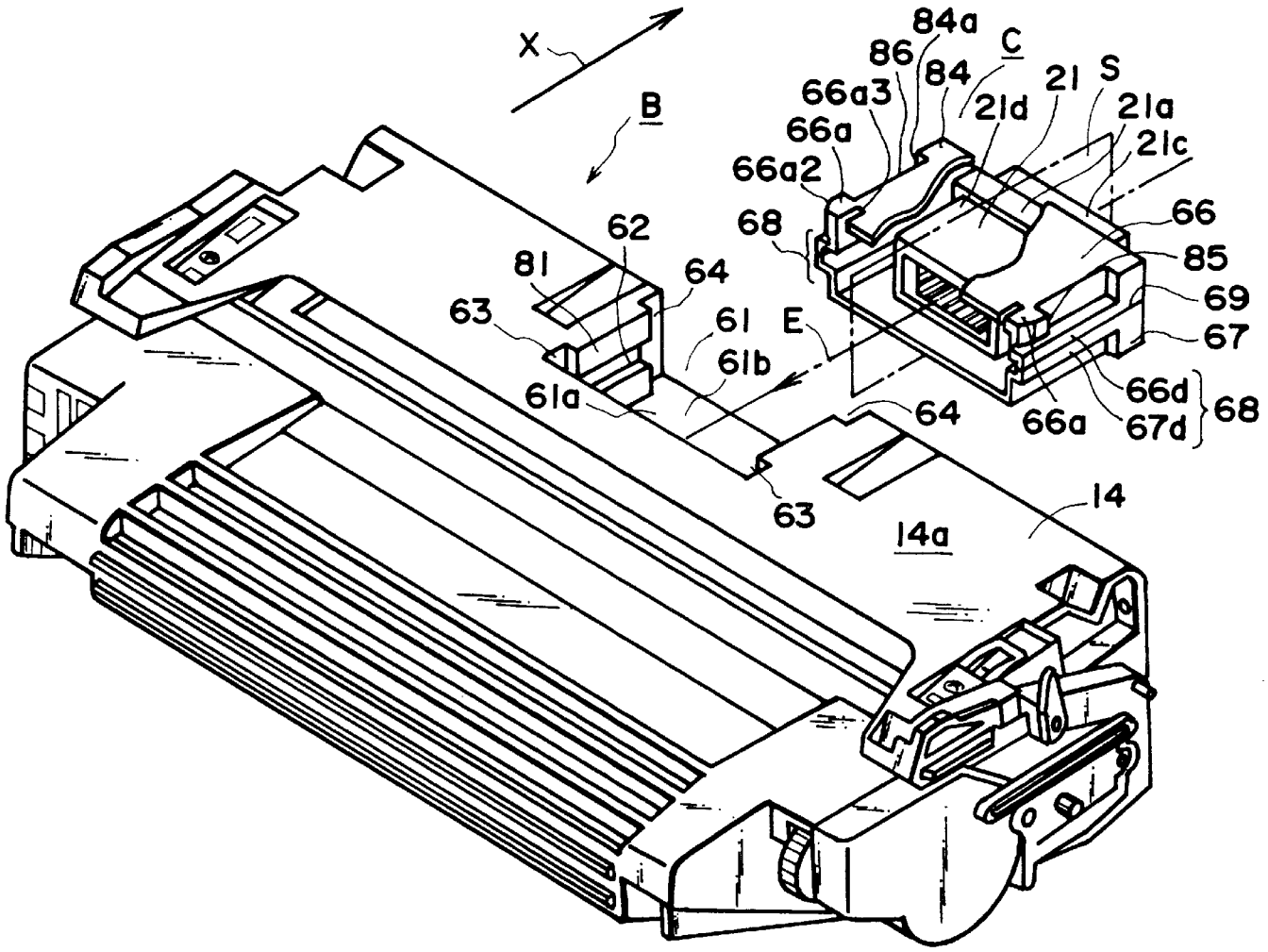
FIG. 6 is a perspective view of the connector assembly in accordance with the present invention, and a process cartridge, depicting the structures thereof.
Figure 7A:
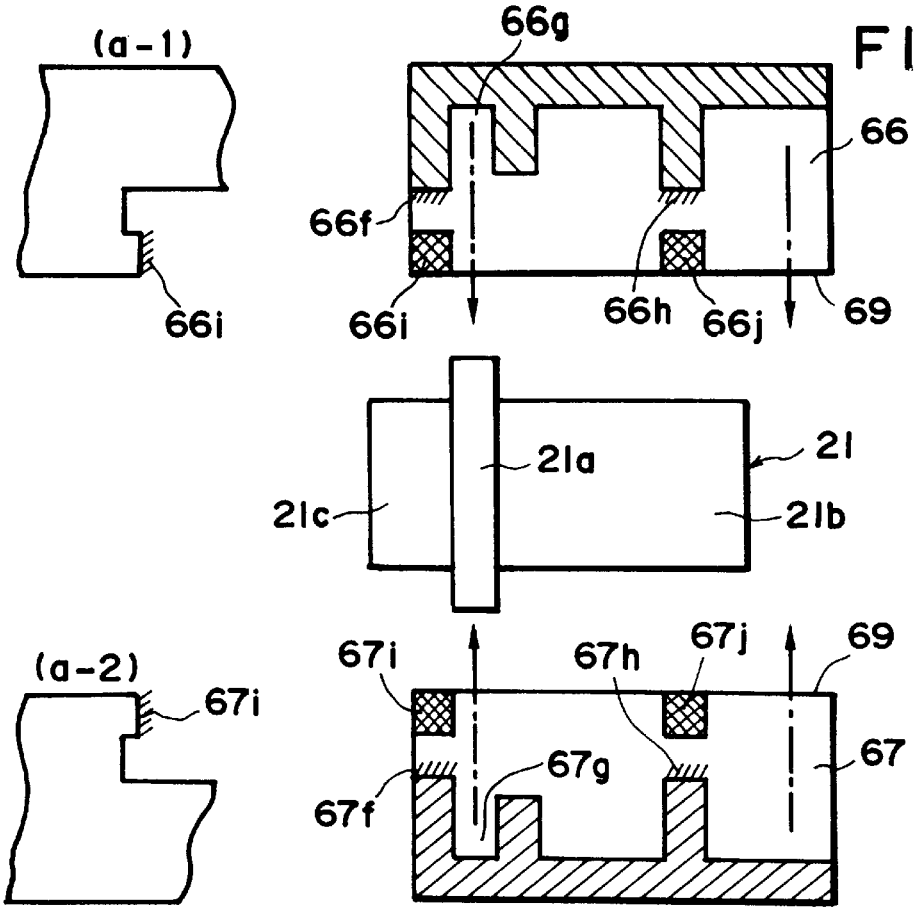
FIGS. 7(*a*) and 7(*b*) are a longitudinal sectional view of the connector assembly in the first embodiment of the present invention, depicting the structure thereof FIGS. 8(*a*), 8(*b*) and 8(*c*) are schematic longitudinal sections of the connector assembly and process cartridge, depicting how they are fitted together.
Figure 7B:
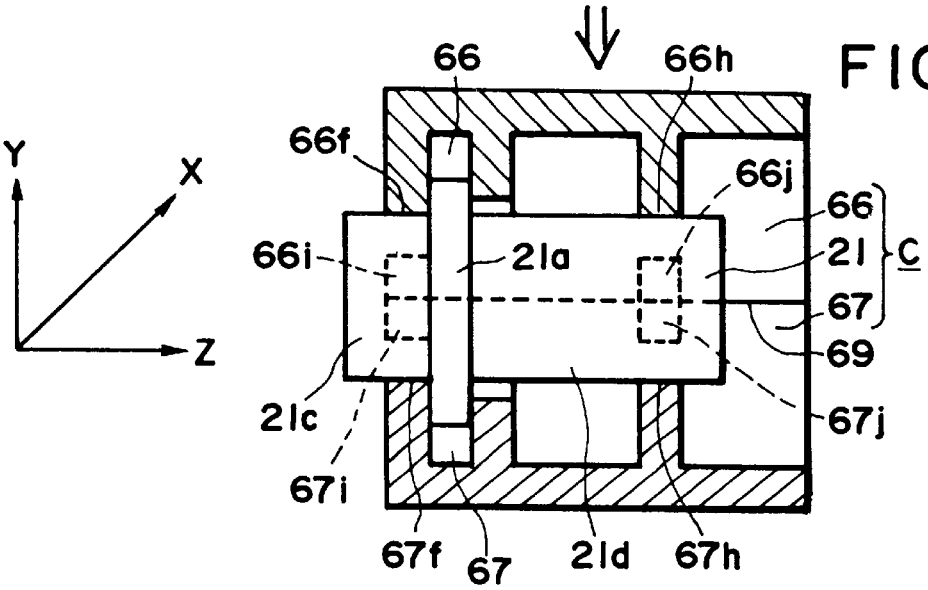
Figure 8A:
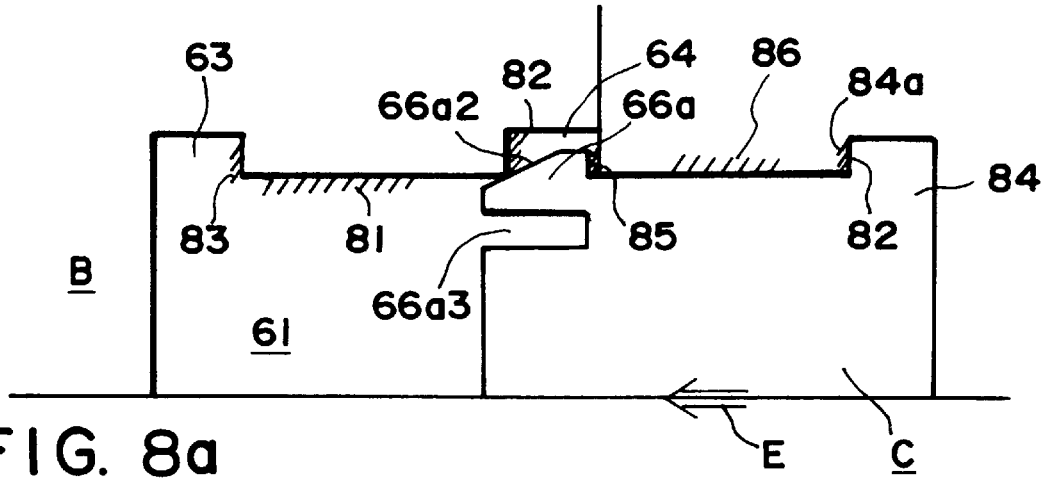
Figure 8B:
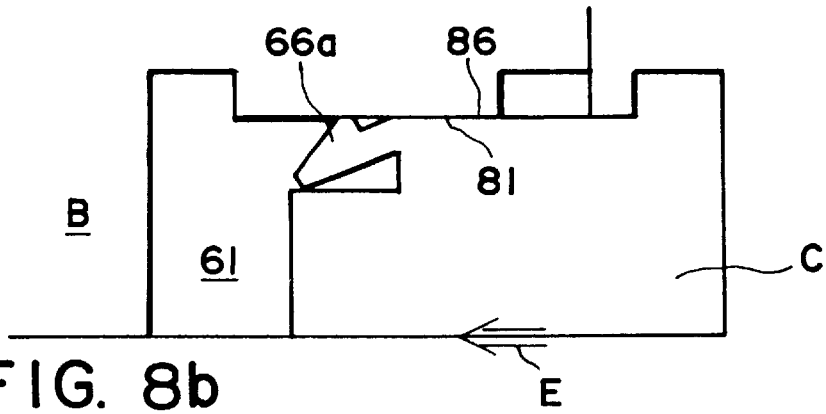
Figure 8C:
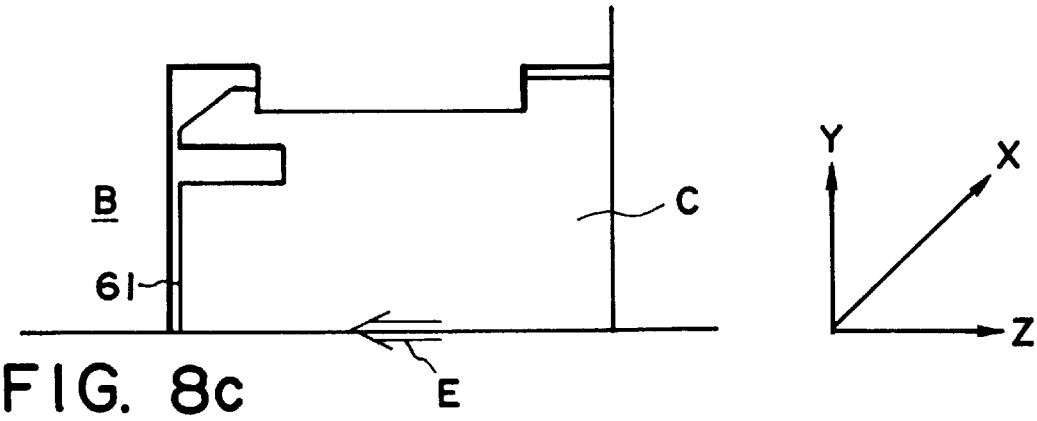

FIG. 6 is a perspective drawing which depicts a method for attaching a connector supported by a support member, to a process cartridge.

FIG. 6 depicts a specific example of how a connector is attached to a process cartridge in this embodiment. In the drawing, the left and right sides of the I/O connector portion 21 and connector support members 66 and 67 are symmetrical relative to a symmetry plane S (which will be described later).

Also referring to FIG. 6, the cleaning frame 14 of the process cartridge B is provided with a connector mounting space 61. Each of the opposing lateral surfaces 81 of the space 61 is provide with a guide groove 62 (one of the lateral walls 81 and one of the guide groove are not illustrated). This guide groove 62 extends in the same direction as the inserting direction of the process cartridge B indicated by an arrow mark E. Also, each lateral surface 81 is provided with a vertical groove 63, which is located at the deepest corner 61*a* of the space 61, and extends from the top surface 14*a* of the cleaning frame 14 to the bottom surface 61*b* of the space 61 in the direction perpendicular to the guide groove 62. Further, each lateral surface 81 is provided with a rabbet-like portion 64, which also vertically extends from the top surface 14*a* of the cleaning frame 14 to the bottom surface 61*b* of the space 61 in the direction perpendicular to the guide groove 62.

On the other hand, the I/O connector portion 21 on the process cartridge side is supported by two support members composed of resin material, that is, a top support member 66 and a bottom support member 67 which are separable from each other at a separation plane 69; the I/O connector portion 21 and the connector support member 66 and 67 form a connector unit C. Both external lateral surfaces of the connector unit C are provided with a straight tongue-like portion 68 which extends along the separation plane 69 of the top and bottom connector support members 66 and 67. Also, the left and right ends of the top connector support member 66 are provided with a locking claw 66*a*.

Next, the configuration of the locking claw 66*a* will be described. The left and right locking claws 66*a* are symmetrical relative to the vertical plane S which includes the line coinciding with the stem line of the arrow mark E which indicates the inserting direction of the top connector support member 66. The outward front corner of the claw 66*a* forms a guide portion 66*a*2, which first comes in contact with the entrance side of the lateral surface 81 of the space 61 when the connector support member 66 is inserted into the space 61 in the direction of the arrow mark E. Further, the claw 66*a* is provided with a slit 66*a*3, which is cut into the claw 66*a* from the inserting end of the claw 66*a*. The lateral surface 86 of the top connector support member 66, which fits against the lateral surface 81 of the space 61, is provided with a stopper 84, which is located at the trailing end side relative to the inserting direction of the top connector support member 66.

The width of the vertical groove 63 located at the corner of the space 61 of the process cartridge B is greater than the length of the claw 66*a* of the connector support member 66 in the inserting direction of the connector support member 66. The distance between the surface of the claw 66*a* on the trailing end side and the bumping surface 84*a* of the stopper 84 equals to the sum of the length of the lateral surface 81 in the inserting direction of the connector support member 66, and the engagement margin.

Further, the claw 66*a* is separated by the slit from the top half portion 66*d* of the tongue-like portion 68, which belongs to the top connector support member 66.

Referring to FIG. 7(*a*) this figure is a sectional view of the I/O connector portion 21 on the process cartridge side, and the top and bottom connector support members 66 and 67, in the disassembled state. FIGS. 7(*a*-1) and 7(*a*-2) illustrate the trailing end thereof relative to the inserting direction of the connector support members 66 and 67. The sectional view of the connector support members 66 and 67 in the assembled state is given as FIG. 7(*b*). In FIG. 7, the details of the external periphery of the connector support members 66 and 67 are omitted to simplify the drawing.

The I/O connector portion 21 on the process cartridge side comprises central structure portions 21*c* and 21*d*, and a flange portion 21*a* which fits around the central structure, between the portion 21*c* and 21*d*. The central structure portions 21*c* and 21*d* are substantially square in section area. The flange portion 21*a* comprises four pieces, forming a complete square, or comprises at least two pieces which are attached to the top and bottom surfaces, respectively of the central structure.

The inward facing surfaces of the connector support members 66 and 67 are provided with grooves 66*g* and 67*g*, respectively, in which the top and bottom pieces of the flange portion 21*a* of the I/O connector portion 21 on the process cartridge side are fitted. Also, they are provided with projections 66*h* and 67*h* which cramp the central structure portions 21*d* from above and below, respectively. The rear end portions of the connector support members 66 and 67, relative to the direction in which the connector unit C is inserted into the space 61 of the process cartridge B, forms projections 66*f* and 67*f* which cramp the central structure portion 21*c* from above and below, respectively. These projections 66*f* and 67*f* double as the side walls of the grooves 66*g* and 67*g*. The inward facing surface of the left lateral wall of the connector support members 66, and the inward facing surface of the right lateral wall of the connector support member 66, are provided with projections 66*i* and 66*j*. Also, the inward facing surface of the left lateral wall of the connector support member 67, and the inward facing surface of the right lateral wall of the connector support member 67, are provided with the projection 67*i* and 67*j*, respectively. The projections 66*i* and 67*i*, and the projection 66*j* and 67*j*, cramp the central structure portions 21*c* and 21*d*, respectively, from the horizontal direction.

FIG. 7(*b*) is a sectional view of the connector unit C illustrated in FIG. 6, at the plane S (this plane S is perpendicular to the separation plane 69, and divides the connector unit C into symmetrical left and right halves).

Next, the positional fixation of the I/O connector portion 21 on the process cartridge side in the connector unit C will be described with reference to directions X, Y and Z shown in FIG. 7 (X direction is perpendicular to the surface of FIG. 7; Z direction is the direction in which the connector unit C is inserted or removed, and coincide with the arrow E direction in FIG. 6).

First, regarding the Z direction, the I/O connector portion 21 is fixed in the connector unit C as the flange portion 21*a* of the I/O connector portion 21 is cramped into the grooves 66*g* and 67*g* of the connector support members 66 and 67, respectively. As for the Y direction, the I/O connector portion 21 is fixed in the connector unit C as the central structure portion 21*c* of the I/O connector portion 21, that is, the central structure portion located on the rear side of the flange portion 21*a,* is cramped from above and below by the projections 66*f* and 67*f* which double as one of the walls of the grooves 66*g* and 67*g* of the connector support members 66 and 67, respectively. Further, the central structure portion 21*d,* that is, the central structure portion located on the front side of the flange portion 21*a,* is cramped from above and below by the protection 66*h* and 67*h,* respectively, to prevent the rotational movement of the I/O connector portion 21 about the axis X. As for the X direction, the I/O connector portion 21 is positionally fixed as the lateral surfaces of the central structure portion 21*c* of the I/O connector portion 21 are cramped by a pair of projections 66*i* and a pair of projections 67*i* (projections on the opposing side are not illustrated) provided on the corresponding internal lateral surfaces of the connector support members 66 and 67. Further, a pair of protections 66*j* and a pair of projections 67*j* (projections on the opposing side are not illustrated) cramp on the lateral surfaces of the central structure portion 21*d* of the I/O connector portion 21 to prevent the rotational movement of the I/O connector portion 21 about the axis Y. As these components are assembled as described above, the top and bottom connector support members 66 and 67 join with each other at the separation plane 69. The connector support members 66 and 67 may be glued together by coating in advance the connector support members 66 and 67 with adhesive, on the surfaces facing the separation plane 69. However, even without gluing, the connector support members 66 and 67 do not separated from each other once the connector support members 66 and 67 are inserted into the space 61 of the process cartridge B after the I/O connector portion 21 is disposed in the connector support members 66 and 67.

With the employment of the structure illustrated in FIG. 7, it is possible to precisely and solidly fix the I/O connector portions 21 on the process cartridge side in the connector unit C.

Next, a method for attaching the aforementioned connector unit C to the process cartridge B will be described.

The connector unit C is inserted in a straight line into the space 61 of the process cartridge B, in the direction of the arrow mark E, with its tongue-like portions being fitted in the corresponding guide grooves 62 of the process cartridge B. This tongue-like portion is constituted of the portions 66*d* and 67*d* of the connector support members 66 and 67, respectively, that is, the straight portions which have an L-shaped cross-section and extend along the separation plane 69.

FIG. 8 is a schematic drawing for describing how the connector unit C is inserted into the connector mounting space 61 of the process cartridge B. In the drawing, only one of the left and right sides of the connector unit C and space 61 is illustrated. The left and right sides of the connector unit C are symmetrical relative to the arrow mark E in FIG. 6.

FIG. 8(*a*) depicts the first stage of the insertion, in which the guide portion 66*a*2 of the locking claw 66*a* of the connector unit C comes in contact with the lateral surface 81 of the space 61 of the process cartridge B, on the front side as seen from the direction from which the connector unit C is inserted.

As pressure is applied to the connector unit C in the arrow mark E direction, the locking claw 66*a* is elastically bent toward the slit 66*a,* and as the connector unit C is inserted deeper, the lateral surfaces 86 of the connector unit 86 come in contact with the correspondent lateral surfaces 81 of the space 61 (FIG. 8(*b*)).

Then, as the connector unit C is further inserted to the final position, that is, the position where it is to be fixed, the hooking surface 85 reaches the vertical groove 63 on the process cartridge side, allowing the claw 66*a* to restore its original shape due to its resiliency. As a result, the lateral wall 83 of the vertical groove 63 flatly joins with the hooking surface 85 of the claw 66*a,* and the front surface 82 of the rabbet-like portion 64 also flatly joins with the bumping surface 84*a* of the stopper 84, whereby the connector unit C is positionally fixed in term of the Z direction. As for the Y direction, the guide grooves 62 of the process cartridge B engage with the tongue-like portions 68 of the connector unit C to positionally fix the connector unit C.

As for the X direction, the left and right lateral surfaces 81 of the space 61 of the process cartridge B engage with the lateral surfaces 86 of the connector unit C to fix the position of the connector unit C.

Therefore, the employment of the connector unit C and process cartridge B which have the above described structures makes it possible to precisely and solidly fix the connector unit C to the process cartridge B.

Embodiment 2

Next, the second embodiment of the present invention will be described. This embodiment is similar in structure to the first embodiment illustrated in FIG. 5, except that the base side of the exterior wall 53*a* of the connector main structure 53 on the process cartridge side is extended upward. Therefore, the description of the first embodiment may be quoted as the description of this embodiment, except for the difference which will be described next.

Figure 9:
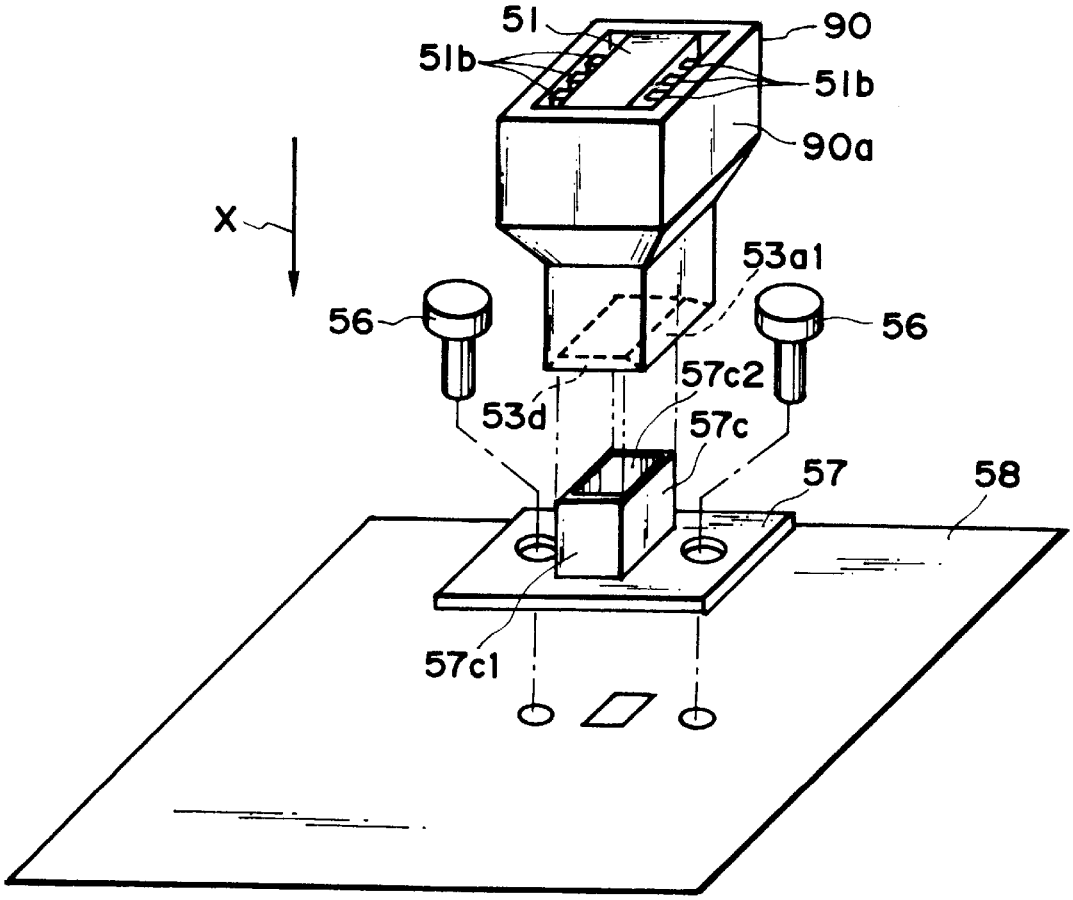
FIG. 9 is a perspective view of the connector in the second embodiment of the present invention, depicting the structure thereof.

Referring to FIG. 9, in the case of the connector main structure 90 on the process cartridge side, an IC 51 is surrounded with the base portion of the external wall 90*a* of the connector main structure 90 on the process cartridge side. With the provision of this structure, even if the connector main structure 90 on the process cartridge side is carelessly handled after the installation of the IC 51, the IC 50 can be prevented from being subjected to destructive force.

Figure 10:
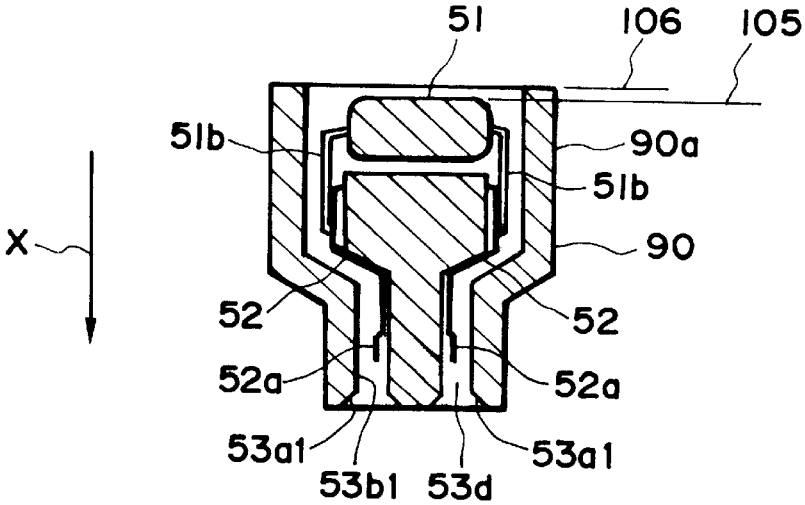
FIG. 10 is a longitudinal sectional view of the connector in the second embodiment of the present invention, depicting the structure thereof.

FIG. 10 is a sectional view of the connector main structure 90 on the process cartridge side in this embodiment. As shown in the drawing, it is structured in such a manner that the top end surface 106 of the external wall 90*a* comes above the top surface 105 of the IC 51.

Figure 11:
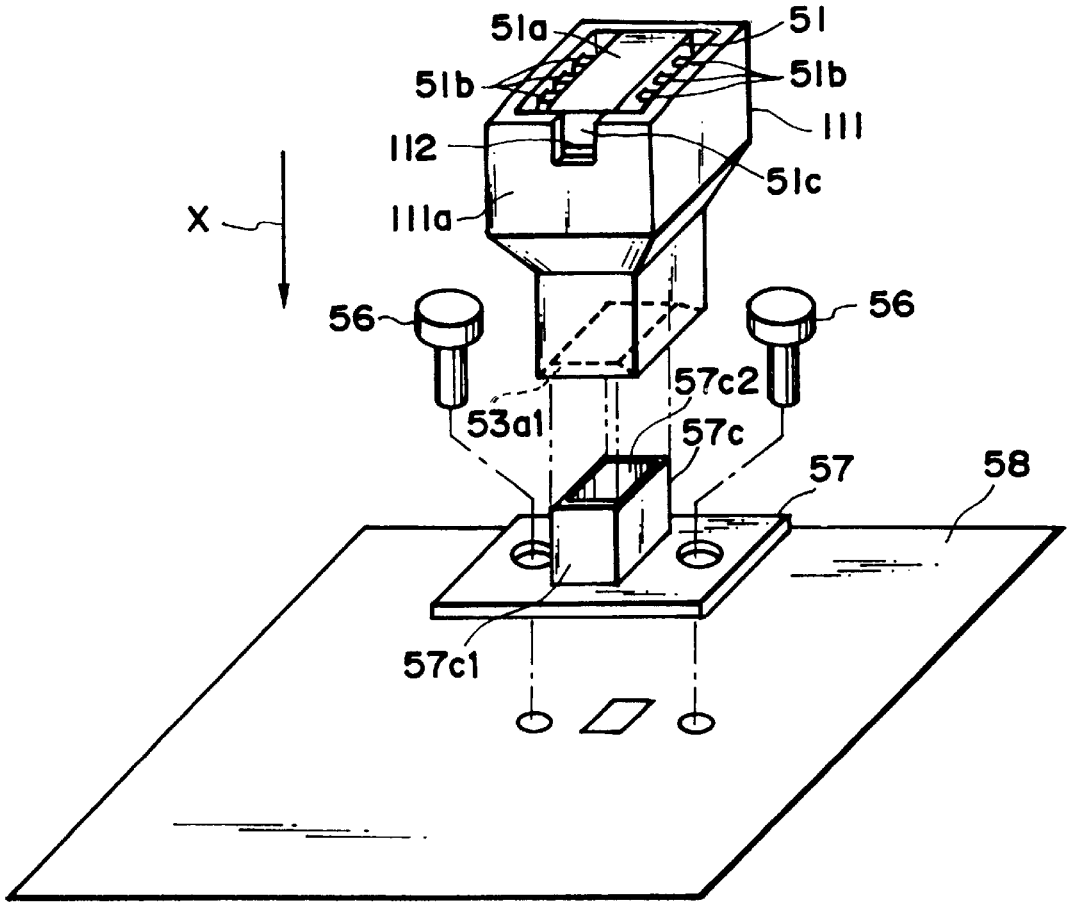
FIG. 11 is a perspective view of an example of the connector from which an IC can be easily removed.

FIG. 11 illustrates a modified version 111 of the connector main structure 90 in this embodiment. In this case of the connector main structure 111, the top edge of one or both of the opposing two sections of the external wall 111*a* is provided with a notch 112 in order to make it easier to remove the IC 51. This section of the external wall 111*a* is the section which faces the lateral surface 51*c* of the chip main structure 51*a* of the IC 51, that is, the surface from which the lead wires 51*b* are not extending. With the provision of this arrangement, when it is necessary to remove the IC 51, the IC 51 can be easily dislodged from the IC mount by placing a sharp object such as a screw driver tip below or against the IC 51 through this notch 112.

FIG. 12(*a*) is an external side view of the connector main structure 111 illustrated in FIG. 11, and FIG. 12(*b*) is a sectional view of the same. If the bottom surface of the IC 51 is flatly in contact with the IC mount 53*c,* it is difficult to insert an IC removal tool such a screw driver between the IC 51 and the IC mount 53*c*. Therefore, such projections 121 as those illustrated in FIG. 12(*b*) may be placed on the IC mount 53*c* of the connector main structure 111 on the process cartridge side to maintain a predetermined gap 122 between the IC 51 and the IC mount 53*c,* so that it becomes far easier to remove the IC 51.

Embodiment 3

Next, the third embodiment of the present invention will be described.

Figure 13:
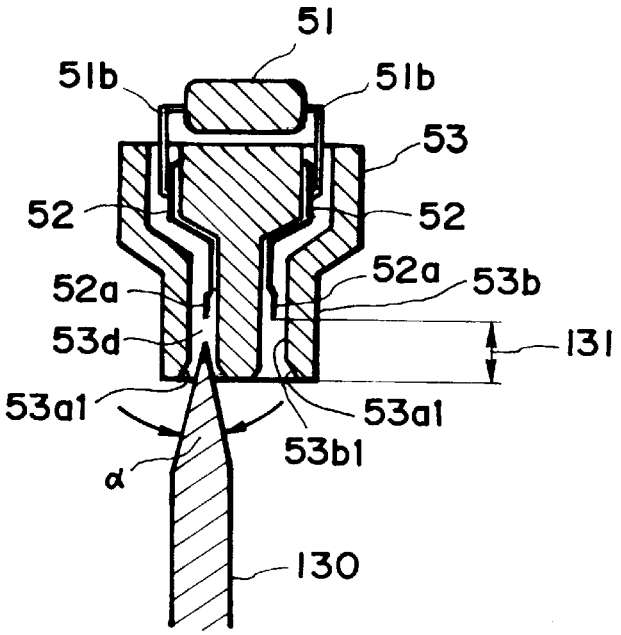
FIG. 13 is a longitudinal sectional view of a connector, depicting the connector structure for increasing the static electrical resistance of the connector.

In this embodiment, a structure designed to protect an IC from external static electricity will be described. FIG. 13 illustrates a structure designed to secure a creepage distance between the connector terminal and an electrostatically charged external object; the structure secures a sufficient distance between the connector terminal and the end surface of the connector.

More specifically, the portion of the engagement portion 53*b* below the bottom end of the contact 52 is extended in order to render the distance 131 so large that even if an object such as a probe 130 having an edge angle (α) of 25 deg. is inserted into the electrode mounting space 53*d,* it is not allowed to come in contact with the contact 52.

Next, referring to FIG. 14, a method for attaching the connector main structure 53 in accordance with the present invention to a unit such as a process cartridge will be described. A wall member 144 is attached to the frame 142 of a unit such as the process cartridge B, the developing unit, or the like, to form a pouch-like space 143 within the frame 142. The frame 142 is provided with an opening 145 which connects the space 143 and the outside. The wall member 144 is provided with ribs 144*a,* the tip of which contacts the base portion of the external wall 53*a* of the connector main structure 53 on the process cartridge side. The connector main structure 53 is attached in such a manner that the surface on which the IC 51 is mounted faces inward, and the engagement portion 53*b* fits into the opening 145 of the unit to expose itself from the unit frame 142. In other words, this arrangement shields the IC 51 from the external elements. Therefore, the IC is better protected from electrostatic charge, and also the connector failure caused by the adhesion of foreign matter such as dust can be prevented.

Further, the arrangement described in the foregoing paragraph may be modified in such a manner that the wall member 144 is integrally formed with the unit frame 142, and the portion of the unit frame 142, which covers the pouch-like space, is formed as a separated cover member to be attached to the unit frame 142.

Embodiment 4

Next, the fourth embodiment will be described.

The fourth embodiment is an embodiment of an idea for preventing an IC mounted on the IC mount 53*c* from becoming disengaged from the IC mount 53*c* when a connector main structure is disposed in a unit. FIG. 15(*a*) is a sectional view of the connector of this embodiment before its placement in the unit, and FIG. 15(*b*) is a sectional view of the same after its placement in the unit.

Referring to FIG. 15(*b*), the base portion of the external wall 53*a* of the connector main structure on the process cartridge side is formed of an elastic synthetic resin material and is provided with a fixing member 151 which comes above the lead wires 51*b* extending from the lateral portion of the chip main structure 51*a* of an IC 51. The section 53*a*1 of the base portion of the external wall 53*a,* which is parallel to the surface of the FIG. 15, and the section 53*a*2 of the base portion of the external wall 53*a,* which is perpendicular to the surface of FIG. 15, are independent from each other, being separated at a plane which coincides with the internal surface of the section 53*a*1. The exterior surface of the section 53*a*2 of the base portion of the external wall 53*a* is provided with a projection 53*e*. This protection 53*e* fits in a recess 155 provided in the wall of the opening 154 of a unit 152.

Referring to FIG. 15(*a*), the section 53*a*2 is slanted outward so that the distance between the opposing two fixing members 151 becomes wider to better expose the IC mount 53*c*. Next, referring to FIG. 15(*b*), as the connector unit is inserted into the opening 154 of the unit 152, the outwardly slanted sections 53*a*2 are elastically bent toward each other, following the correspondent walls of the opening 154. Therefore, the fixing members 151 are made to close in toward each other in a manner to cramp the IC 51, preventing the IC 51 from becoming disengaged from the IC mount 53*c*. Further, the projection 53*e* of the base portion of the external wall 53*a* of the connector main structure 53 fits in the recess 155 provided in the wall of the opening 154, and therefore, the connector mains structure 53 is not liable to be dislodged by external force.

Figure 14:
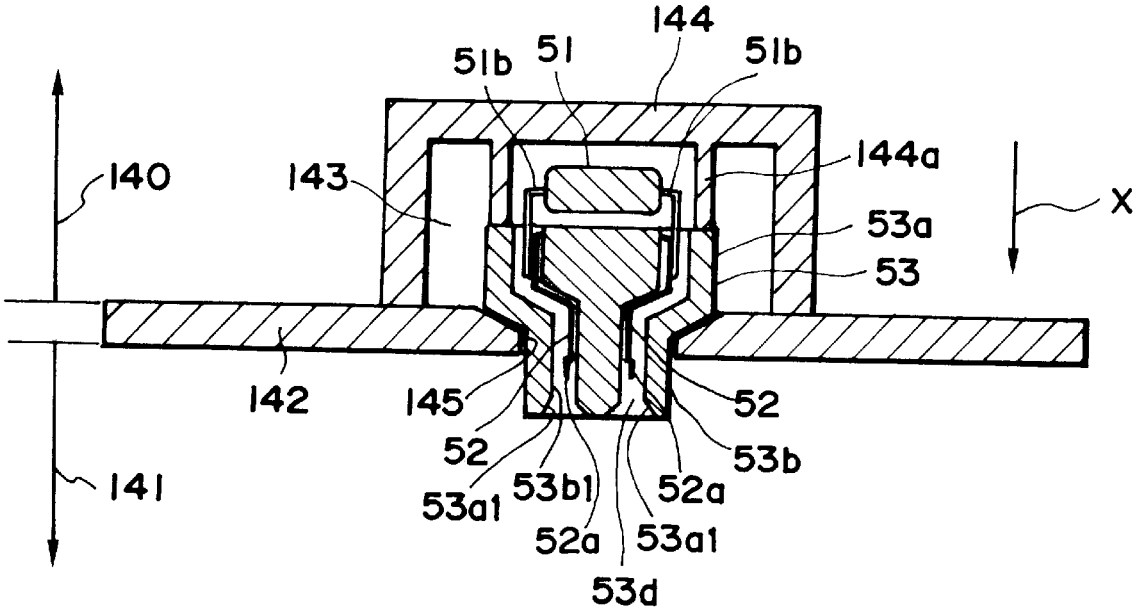
FIG. 14 is a longitudinal sectional view of a connector, and a unit comprising the connector, depicting a structure for increasing static electric resistance of the connector, and how the connector is disposed in the unit.
Figure 15A:
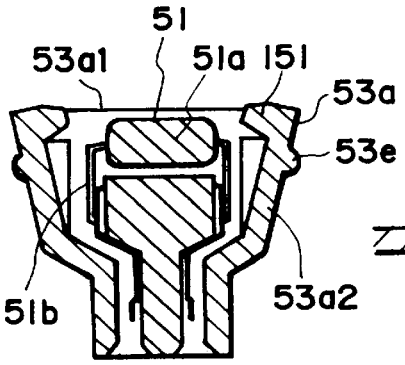
FIGS. 15(*b*) and 15(*a*) are longitudinal sectional views of a connector capable of preventing accidental IC disengagement, depicting the connector before and after its placement in the unit, respectively.
Figure 15B:
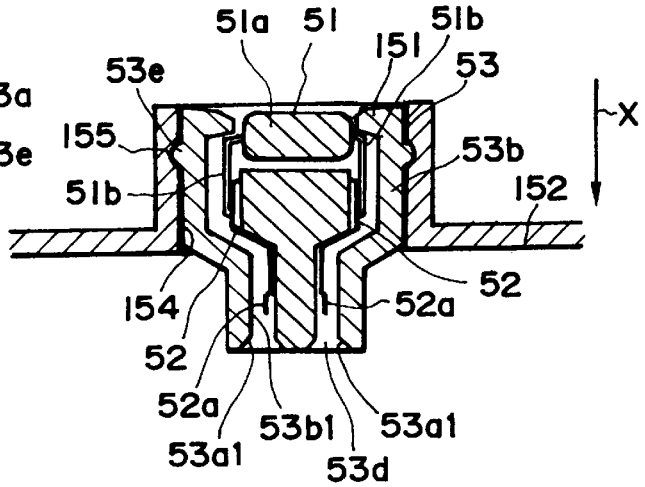

Referring to FIG. 16, in order to cramp the chip main structure 51*a* of the IC 51, a wall member 144 may be provided with a boss, instead of disposing the fixing member 151 as described above (in FIG. 16, the sections having the same functions as those illustrated in FIG. 14 are designated with the same referential codes so that the description of the structure illustrated in FIG. 14 can be quoted as the description of the structure in FIG. 16).

Further, a supporting member may be interposed between the connector main structure 53 and the frame of a unit such as a process cartridge.

Embodiment 5

Next, the fifth embodiment of the present invention will be described.

In this embodiment, the structure of the connector unit C in the first embodiment is modified in consideration of the connector unit manufacturing (assembling) conditions.

FIG. 17(*a*) illustrates a two-piece connector unit. The top piece 171 integrally comprises an I/O connector portion 171*a* and a top support member 171*b*. It is united with a bottom support member 172 to form a connector unit C.

In FIG. 17, the sections having the same functions as those illustrated in FIG. 6 are designated with the same reference numerals permitting quoting of the description of FIG. 6 as the description for FIG. 17. In the drawing, a claw 66*a* is illustrated without showing the slit provided around it. The bottom surface of the I/O connector portion 171*a* is provided with a flange 171*a*1 which extends in the direction perpendicular to the inserting direction E of the connector unit C, and the bottom support member 172 is provided with a groove 172*a* in which the I/O connector portion 171*a* is fitted. This groove 172*a* extends in the direction indicated by an arrow mark E (inserting direction of connector unit C), and is provided with a groove 172*b* in which the flange 171*a*1 of the I/O connector portion 171*a* is fitted. This groove 172*b* extends in the direction perpendicular to the groove 172*a*. The external configuration of the assembled connector unit C is the same as the connector unit C illustrated in FIG. 6.

FIG. 17(*b*) depicts a single-piece connector unit 173, in the case of this connector unit 173, an I/O connector portion 173*a* is integrally formed with a support portion 173*b*. The external configuration of the connector unit 173 is also the same as the connector unit C illustrated in FIG. 6.

Whichever design is employed among the three-piece design in the first embodiment, the two-piece design in this fifth embodiment, and the single-piece design also in this fifth embodiment, the effects of the present invention can be satisfactorily realized. Therefore, a manufacturer may select the most appropriate one among the aforementioned designs in consideration of manufacturing related concerns, for example, the metallic mold cost, the assembly cost, and the like.

As described above, according to the preceding embodiments, an electrical connector (53, 90 or 111) engageable with a counterpart connector (57) provided on the image forming apparatus main assembly side comprises a memory member (51) for storing information, and a plurality of electrical terminals (52) which are separably connected to the electrical terminals (55) of the connector (57) on the apparatus main assembly side when the connector (53, 90 or 111) is engaged with the connector (57) of the apparatus main assembly, wherein the memory member (51) is electrically connected to each of the plurality of electrical terminals (52) with the use of electrically conductive members (for example, lead wires 51*b*).

According to one of the aspects of the embodiments, the memory member (51) is disposed on the upstream side of the terminal (52) relative to the direction (direction indicated by an arrow mark X) in which the electrical connector (53, 90 or 111) is moved to be engaged with the connector (57) of the apparatus main assembly.

According to another aspect of the embodiments, the electrical connector (53, 90 or 111) comprises a wall (53*a*, 90*a* or 111*a*) extended to surround the terminals (52).

According to another aspect of the embodiments, the bottom end of the wall (53*a*, 90*a* or 111*a*), which is to be engaged with the connector (57) of the apparatus main assembly, is provided with a tapered portion (53*a*1), which guides the electrical connector (53, 90 or 111) when the electrical connector (53, 90 or 111) is engaged with the connector (57) of the apparatus main assembly. As the electrical connector (50, 90 or 111) is electrically connected to the connector (57) of the apparatus main assembly, the engagement portion (57*c*) of the connector (57) on the apparatus main assembly side fits in the space (53*d*) created between the internal surface of the wall (53*a*, 90*a* or 111*a*) and the terminal (52). The engagement portion (57*c*) is provided with a recess (57*d*), and the terminal 52 of the electrical connector (53, 90 or 111) enters the recess (57*d*) to make electrical contact with the apparatus main assembly side terminal (55) disposed in the recess (57*d*).

According to another aspect of the embodiments, the electrical connector (90 or 111) is provided with an external wall (90*a* or 111*a*) which covers both longitudinal ends of the memory member (51), wherein a plurality of lead wires (51*b*) extend from the longitudinal edges of the memory member (51).

According to another aspect of the embodiments, the electrical connector (111) is provided with an external wall (111*a*) which covers both longitudinal ends of the memory member (51), wherein a plurality of lead wires (51*b*) extend from the longitudinal edges of the memory member (51), and at least one of the longitudinal ends of the memory (51) is exposed so that a tool (130) can be inserted from the longitudinal direction of the memory member (51) to dislodge the memory member (51) from its mount.

According to another aspect of the embodiments, the electrical connector (53, 90 or 111) is provided with a wall (53*a*, 90*a* or 111*a*) which surrounds the terminal (52), and a space (53*d*) is provided between the internal surface of the wall and the terminal, wherein the terminal (52) is disposed deep inside the space (53*d*), being sufficiently away from the bottom end of the wall in the height direction of the wall to secure a distance for preventing the terminal (52) from coming in contact with a foreign object even when a foreign object, for example, a probe (130) having an edge angle of 25 deg., happens to be inserted into the space (53*d*).

The following is evident from the above descriptions:

(1) According to the preceding embodiments, it is possible to realize an inexpensive, small, and highly noise resistant structure for an electrical connector which is used to install an electronic device, for example, an IC such as an EPROM, in a unit removably mountable in the main assembly of an image forming apparatus.

(2) According to one of the aspects of the preceding embodiment, an IC is placed directly in contact with a connecting means on which the IC is mounted; therefore, the IC is automatically connected to the counterpart connector by simply engaging two connectors, eliminating the need for separate wiring which electrically connects the IC to the counterpart connector.

(3) According to another aspect of the preceding embodiment, an IC and an electric power supplying means are disposed in a connector; therefore, only one connector pair is necessary to transmit signals to and from the IC, and supply the unit with electric power.

(4) According to another aspect of the preceding embodiments, only one connector pair is necessary to transmit signals to and from the IC, to supply the unit with electric power, and to pick up the signals from the sensors connected to the connector on which the IC is mounted.

(5) According to another aspect of the preceding embodiment, at least one connector of the connector pair is mounted in a positionally adjustable manner to deal with the misalignment of the connectors; therefore, the two connectors can be reliably engaged.

(6) According to another aspect of the preceding embodiments, the IC is mounted in such a manner that the IC is surrounded by the extension of the connector main structure; therefore, the IC is not liable to come directly in contact with foreign objects.

(7) According to another aspect of the preceding embodiments, the connector main structure is provided with an external wall for surrounding the IC, wherein one, or opposing two, of the four sections of the external wall, which does not face the lead wires of the IC, is provided with a notch; therefore, it is easy to remove the IC.

(8) According to another aspect of the preceding embodiments, the surface of the connector main structure, which faces the bottom surface of the IC, is provided with projections to prevent the bottom surface of the IC from coming flatly in contact with the surface of the connector main structure; therefore, a gap useful for dislodging the IC can be secured between the IC and the connector main structure.

(9) According to another aspect of the preceding embodiments, the terminal is made to double as means for connecting the IC, and the IC and terminal are supported by the connector main structure; therefore, the structure is simplified.

(10) According to another aspect of the preceding embodiments, the connector main structure is formed of electrically insulative material, and comprises an external wall which surrounds the connection terminals, and a terminal mount disposed within the external wall, wherein one end of the external wall forms an engagement portion which is separably engaged with the counterpart connector on which the IC is not mounted, and the IC is automatically connected to the terminal as the IC is mounted on the terminal mount; therefore, the structure of the electrical connector is simple, strong, and easy to manufacture.

(11) According to another aspect of the preceding embodiments, the engagement portion is extended; therefore, forgone objects such as a probe are not liable to be allowed to reach as far into the terminal mounting space as the terminal location; in other words, the extension of the engagement portion serves as means for preventing static electricity discharge.

(12) According to another aspect of the preceding embodiments, opposing sections of the external wall of the connector main structure are slanted outward and also are rendered elastically bendable in the inward direction, wherein the top end of each of these opposing sections is provided with an IC cramping member; therefore, the IC is not liable to dislodge from the connector main structure after the connector is attached to a unit.

(13) According to another aspect of the preceding embodiments, an electronically erasable storing means is employed as the IC; therefore, the connector can hold the information of a unit to which the connector with the IC is attached.

(14) According to another aspect of the preceding embodiments, the connector with the IC is provided with a support member; therefore, the connector can be easily fitted to a member to which the connector is to be attached, and at the same time, the connector is protected by the support member.

(15) According to another aspect of the preceding embodiments, the connector is supported with two separate support members which can be easily assembled together. Therefore, component manufacturing steps can be simplified. Also, with this arrangement, the connector can be standardized, and the same connector can be attached to different types of unit simply by using different support members, affording flexibility in connector application.

(16) According to another aspect of the preceding embodiments, the connector is integrally formed with a part of the support member, and this connector integral with a part of the support member is supported by the other part of the support member; therefore, the connector main structure is reinforced.

(17) According to another aspect of the preceding embodiments, the connector and the support member are integrally formed; therefore, the connector is highly strong and rigid.

(18) According to another aspect of the preceding embodiments, the means for storing the information regarding a unit removably installable in the main assembly of an image forming apparatus is mounted in the connector which requires only a small space; therefore, it is unnecessary to increase the unit size. Also, the space in which the connector is mounted is located adjacent to the external wall of the unit, being is covered with the unit frame wall or a separate lid. Therefore, the connector can be easily attached to the unit, and can be protected from the noises generated by a high voltage member such as a charger. Further, the electronic device is prevented from being subjected to short circuit or contact failure caused by the adhesion of toner or the like. In other words, the environment in which the electronic device operates is improved in terms of noise resistance.

(19) According to another aspect of the preceding embodiments, a unit is provided with a dedicated space for accommodating the connector; therefore, the connector does not greatly protrude from the surface of the unit, rendering the unit clean in configuration, and compact in overall size.

(20) According to another aspect of the preceding embodiments, the connector is designed to interpose a support member between the connector main structure and a unit to which the connector main structure is attached; therefore, the same connector can be precisely and firmly attached to various units to make desirable electrical contact with a counterpart connector, which makes the connector virtually immune to ill effects which result from handling of the connector, for example, engaging or disengaging the connector.

(21) According to another aspect of the preceding embodiments, a developing device can be provided with means for storing various information regarding developing device conditions, without greatly increasing the size of a developing device.

(22) According to another aspect of the preceding embodiment, a toner cartridge can be provided with means for storing the information regarding toner remainder, without increasing the size of a toner cartridge.

(23) According to another aspect of the preceding embodiments, a process cartridge can be provided with means for storing a process cartridge history, simply by attaching the connector in accordance with the present invention to a process cartridge, without increasing process cartridge size. Further, the connector is also compatible with the process cartridges described in claims 24–26.

(24) According to another aspect of the preceding embodiments, the connector in accordance with the present invention is attached to a unit removably installable in the main assembly of an image forming apparatus, and the counterpart connector in accordance with the present invention is attached to the main assembly of an image forming apparatus, wherein an IC is mounted in the connector on the unit side, eliminating the need for substantially increasing the unit size; therefore, it is unnecessary to increase the image forming apparatus size.

(25) According to another aspect of the preceding embodiments, an IC is an electronically erasable storing means; therefore, the information regarding a unit, which is exchanged between the control circuit of the main assembly of an image forming apparatus and the unit, can be stored one after another in the IC.

While the invention has been described with reference to the structures disclosed herein, it is not confined to the details set forth and this application is intended to cover such modifications or changes as may come within the purposes of the improvements or the scope of the following claims.

What is claimed is:

1. An electrical connector electrically connectable with main assembly connector, provided in a main assembly of an electrophotographic image forming apparatus, comprising:

a storing member for storing information;

a mounting portion;

a plurality of electrical contacts, a plurality of which are on one side of said mounting portion, and the rest of which are on an opposite side thereof, for separably connecting with a contact of said main assembly connector, when they are connected electrically with said main assembly connector; and a wall enclosing said mounting portion with a space between the inner surface of said wall and said electrical contacts on said mounting portion, wherein said storing member is electrically connected with said electrical contacts with lead lines.

2. A connector according to claim 1, wherein said storing member is mounted at a position upstream of said electronic contacts in a direction of connection of said electrical connector with said main assembly connector.

3. A connector according to claim 1, wherein free ends of said electrical contacts are provided inside said wall in a direction of height of said wall, and in a direction in which a part of said main assembly connector enters the space.

4. An electrical connector electrically connectable with a main assembly connector, provided in a main assembly of an electrophotographic image forming apparatus, comprising:

a storing member for storing information;

a mounting portion;

a plurality of electrical contacts, a plurality of which are on one side of said mounting portion, and the rest of which are on an opposite side thereof, for separably connecting with a contact of said main assembly connector when they are connected electrically with said main assembly connector; and a wall provided so as to enclose said mounting portion with a space between the inner surface of said wall and said electrical contacts, wherein free ends of said electrical contacts are provided inside said wall in a direction of height of said wall, and wherein said storing member is electrically connected with each of said electrical contacts with lead lines, wherein said wall is provided with a taper adjacent an end for connection with said main assembly connector, wherein when said electrical connector is to be connected with the main assembly connector, it is guided by said taper.

5. An electrical connector electrically connectable with a main assembly connector, provided in a main assembly of an electrophotographic image forming apparatus, comprising:

a storing member for storing information;

a mounting portion;

a plurality of electrical contacts, a plurality of which are on one side of said mounting portion, and the rest of which are on an opposite side thereof, for separably connecting with a contact of said main assembly connector when they are connected electrically with said main assembly connector;

wherein said storing member is electrically connected with said electrical contacts with lead lines; and a wall provided so as to enclose said mounting portion with a space between the inner surface of said wall and said electrical contacts, wherein free ends of said electrical contacts, are provided inside said wall in a direction of height of said wall, wherein when said electrical connector is to be connected electrically with said main assembly connector, an engaging portion of said main assembly connector is engaged with a space formed between an inner surface of said wall and said electrical contacts, wherein said engaging portion is provided with a dimple, into which said electronic contacts of said electrical connector enter to be electrically connected with the electrical contacts.

6. A connector according to claim 5, further comprising an outer wall covering opposite longitudinal end portions of said storing member, wherein a plurality of said lead lines are extended out of said storing member at the opposite end portions thereof.

7. An electrical connector electrically connectable with a main assembly connector, provided in a main assembly of an electrophotographic image forming apparatus, comprising:

a storing member for storing information;

a mounting portion;

a plurality of electrical contacts, a plurality of which are on one side of said mounting portion, and the rest of which are on an opposite side thereof, for separably connecting with a contact of said main assembly connector when they are connected electrically with said main assembly connector, a wall enclosing said mounting portion with a space between the inner surface of said wall and said electrical contacts, wherein said storing member is electrically connected with each of said electrical contacts with lead lines; and an outer wall covering opposite longitudinal end portion of said storing member, wherein a plurality of said lead lines are extended out of said storing member at the opposite end portions thereof, wherein at least one of lateral surfaces of said storing member is exposed, and said storing member is demountable from a mounting position by inserting a tool into a lateral surface of said storing member.

8. An electrical connector electrically connectable with a main assembly connector, provided in a main assembly of an electrophotographic image forming apparatus, comprising:

a storing member for storing information;

a mounting portion;

a plurality of electrical contacts, a plurality of which are on one side of said mounting portion, and the rest of which are on an opposite side thereof, for separably connecting with a contact of said main assembly connector when they are connected electrically with said main assembly connector;

wherein said storing member is electrically connected with each of said electrical contacts with lead lines, wherein said electrical connector is provided with a wall provided so as to enclose said mounting portion, wherein a space is formed between an inner surface of said wall and said electrical contacts on said mounting portion, wherein said electrical contacts are provided inside said wall in the direction of height of said wall so as to assure such a distance that even when a probe having an angle of 25 degrees at a free end thereof is inserted into said space, said probe does not contact said electrical contacts.

9. An electrical connector electrically connectable with a main assembly connector, provided in a main assembly of an electrophotographic image forming apparatus, wherein said main assembly connector includes an engaging portion, a groove provided in said engaging portion, and a main assembly electrical contact provided in said grove, comprising:

a storing member for storing information;

a plurality of electrical contacts for separably connecting with the contact of said main assembly connector when they are connected electrically with said main assembly connector; and a wall enclosing said electrical contacts;

wherein free ends of said electrical contacts are provided inside said wall in the direction of height of said wall, wherein a space is formed between an inner surface of said wall and said electrical contacts, wherein said engaging portion is engaged with said space when said electrical connector is to be electrically connected with the main assembly connector, wherein when said engaging portion is engaged with said space, said electrical contacts of electrical connector enter said groove so that electrical contacts are electrically connected with the main assembly electrical contact provided in said groove, wherein said storing member is electrically connected with said electrical contacts with lead lines.

10. A connector according to claim 9, wherein said storing member is mounted at a position upstream of said electronic contacts in a direction of connection of said electrical connector with said main assembly connector.

11. A connector according to claim 9 or 10, wherein said wall is provided with a taper adjacent an end for connection with said main assembly connector, wherein when said electrical connector is to be connected with the main assembly connector, it is guided by said taper.

12. A connector according to claim 11, further comprising an outer wall covering opposite longitudinal end portions of said storing member, wherein a plurality of said lead lines are extended out of said storing member at the opposite end portions thereof.

13. A connector according to claim 9 or 4, further comprising an outer wall covering opposite longitudinal end portions of said storing member, wherein a plurality of said lead lines are extended out of said storing member at the opposite end portions thereof, wherein at least one of lateral surfaces of said storing member, is exposed, and said storing member is demountable from a mounting position by inserting a tool into a lateral surface of said storing member.

14. A connector according to claim 9 or 10, wherein said electrical contact is provided inside said wall in the direction of height of said wall so as to assure a such a distance that even when a probe having an angle of 25 degree at a free end thereof is inserted into said space, said probe is not contacted to said electrical contact.

15. An electrical connector electrically connectable with a main assembly connector, provided in a main assembly of an electrophotographic image forming apparatus, wherein said main assembly connector includes an engaging portion, a dimple provided in said engaging portion and a main assembly electrical contact provided in said dimple, comprising:

a storing member for storing information;

a plurality of electrical contacts for separably connecting with the contact of said main assembly connector when they are connected electrically with said main assembly connector;

a wall enclosing said electrical contacts wherein free ends of said electrical contacts are provided inside said wall in the direction of height of said wall;

an outer wall covering longitudinal opposite ends of said storing member; and a plurality of lead lines extended out of said opposite ends, wherein said lead lines are connected with said electrical contacts, by which said storing member is electrically connected with said electrical contact, wherein a least one lateral end of said storing member is exposed, and said storing member is removable from a mounting position by inserting a tool at the end portion; and wherein a space is formed between an inner surface of said wall and said electrical contacts, wherein said engaging portion is engaged with said space when said electrical connector is to be electrically connected with the main assembly connector, wherein when said engaging portion is engaged with said space, said electrical contacts of said electrical connector enter said dimple so that electrical contacts are electrically connected with the main assembly electrical contact provided in said dimple.

16. A connector according to claim 15, wherein said storing member is mounted at a position upstream of said electronic contacts in a direction of connection of said electrical connector with said main assembly connector.

17. A connector according to claim 15 or 16, wherein said wall is provided with a taper adjacent an end for connection with said main assembly connector, wherein when said electrical connector is to be connected with the main assembly connector, it is guided by said taper.

18. A connector according to claim 15 or 16, wherein said electrical contact is provided inside said wall in the direction of height of said wall so as to assure a such a distance that even when a probe having an angle of 25 degrees at a free end thereof is inserted into said space, said probe is not contacted to said electrical contact.

19. A process cartridge detachably mountable to a main assembly of an image forming apparatus, comprising:

a. an electrophotographic photosensitive member;

b. process means actable on said electrophotographic photosensitive member; and c. an electrical connector electrically connectable with a main assembly connector, provided in said main assembly of an image forming apparatus, said electrical connector comprising:

a storing member for storing information; and a plurality of electrical contacts for separably connecting with the contact of said main assembly connector when they are connected electrically with said main assembly connector, wherein said storing member is electrically connected with said electrical contacts with lead lines.

20. A process cartridge according to claim 19, wherein said process means includes at least one of a charging member for charging said electrophotographic photosensitive member, a developing member for developing a latent image formed on the photosensitive member, a cleaning member for removing toner remaining said electrophotographic photosensitive member.

21. A process cartridge according to claim 19, wherein said electrical connector is provided in a cleaning frame for supporting said electrophotographic photosensitive member, a charging member for charging said electrophotographic photosensitive member and a cleaning member for removing toner remaining on said electrophotographic photosensitive member, and said electrical connector is mounted in a mounting direction when said process cartridge is mounted to a main assembly of said device.

22. A process cartridge according to claim 19, wherein said storing member is mounted at a position upstream of said electronic contacts in a direction of connection of said electrical connector with said main assembly connector.

23. A process cartridge according to claim 19, wherein said electrical connector has a wall provided so as to enclose said electrical contacts, and free ends of said electrical contacts, are provided inside said wall in a direction of height of said wall.

24. A process cartridge according to claim 23, wherein said wall is provided with a taper adjacent an end for connection with said main assembly connector, wherein when said electrical connector is to be connected with the main assembly connector, it is guided by said taper.

25. A process cartridge according to claim 23 or 24, wherein when said electrical connector is to be connected electrically with said main assembly connector, an engaging portion of said main assembly connector is engaged with a space formed between an inner surface of said wall and said electrical contacts, wherein said engaging portion is provided with a dimple, into which said electronic contacts of said electrical connector enter to be electrically connected with the electrical contacts.

26. A process cartridge according to claim 25, further comprising an outer wall covering opposite longitudinal end portions of said storing member, wherein a plurality of said lead lines are extended out of said storing member at the opposite end portions thereof.

27. A process cartridge according to claim 19 or 24, further comprising an outer wall covering opposite longitudinal end portions of said storing member, wherein a plurality of said lead lines are extended out of said storing member at the opposite end portions thereof, wherein at least one of lateral surfaces of said storing member, is exposed, and said storing member is demountable from a mounting position by inserting a tool into a lateral surface of said storing member.

28. A process cartridge according to claim 19 or 24, wherein said electrical connector is provided with a wall provided so as to enclose said electrical contacts, wherein a space is formed between an inner surface of said wall and said electrical contact, wherein said electrical contact is provided inside said wall in the direction of height of said wall so as to assure a such a distance that even when a probe having an angle of 25 degrees at a free end thereof is inserted into said space, said probe is not contacted to said electrical contact.

29. A process cartridge according to claim 19 or 24, wherein said electrical connector is mounted on a cartridge frame such that storing member is positioned in a space constituted by a wall member provided in said cartridge frame, wherein said wall member is provided with a rib, and said rib is contacted to a base portion of a side wall of said electrical connector.

30. A process cartridge detachably mountable to a main assembly of an image forming apparatus, wherein a main assembly connector is provided in the main assembly of the image forming apparatus and includes an engaging portion, a groove provided in said engaging portion and a main assembly electrical contact provided in said groove, comprising:

a. an electrophotographic photosensitive member;

b. a charging member for charging said electrophotographic photosensitive member;

c. a cleaning member for removing toner remaining on said electrophotographic photosensitive member; and d. an electrical connector connectable electrically with said main assembly connector when said process cartridge is mounted to main assembly of the apparatus, said electrical connector comprising;

a storing member for storing information;

a plurality of electrical contacts for separably connecting with the contact of said main assembly connector when they are connected electrically with said main assembly connector; and a wall enclosing said electrical contacts;

wherein a space is formed between an inner surface of said wall and said electrical contacts, wherein said engaging portion is engaged with said space when said electrical connector is to be electrically connected with the main assembly connector, wherein when said engaging portion is engaged with said space, said electrical contacts of said electrical connector enter said groove so that electrical contacts are electrically connected with the main assembly electrical contact provided in said groove;

wherein said storing member is electrically connected with said electrical contacts with lead lines, and wherein said electrical connector is mounted in a mounting direction when said process cartridge is mounted to said main assembly.

31. A process cartridge according to claim 30, wherein said process cartridge further comprises a cleaning member for removing toner remaining on said electrophotographic photosensitive member.

32. A process cartridge according to claim 30, wherein said electrical connector is mounted to a cleaning frame for supporting said electrophotographic photosensitive member, said charging member and said cleaning member.

33. A process cartridge according to claim 30, wherein said storing member is mounted at a position upstream of said electronic contacts in a direction of connection of said electrical connector with said main assembly connector.

34. A process cartridge according to claim 30 or 33, wherein said wall is provided with a taper adjacent an end for connection with said main assembly connector, wherein when said electrical connector is to be connected with the main assembly connector, it is guided by said taper.

35. A process cartridge according to claim 34, further comprising an outer wall covering opposite longitudinal end portions of said storing member, wherein a plurality of said lead lines are extended out of said storing member at the opposite end portions thereof.

36. A process cartridge according to claim 30 or 33, further comprising an outer wall covering opposite longitudinal end portions of said storing member, wherein a plurality of said lead lines are extended out of said storing member at the opposite end portions thereof, wherein at least one of lateral surfaces of said storing member, is exposed, and said storing member is demountable from a mounting position by inserting a tool into a lateral surface of said storing member.

37. A process cartridge according to claim 30 or 33, wherein said electrical contact is provided inside said wall in the direction of height of said wall so as to assure a such a distance that even when a probe having an angle of 25 degrees at a free end thereof is inserted into said space, said probe is not contacted to said electrical contact.

38. A process cartridge detachably mountable to a main assembly of an image forming apparatus, wherein a main assembly connector includes an engaging portion, a dimple provided in said engaging portion and a main assembly electrical contact provided in said dimple, comprising:

a. an electrophotographic photosensitive member;

b. a charging member for charging said electrophotographic photosensitive member; and c. an electrical connector connectable electrically with said main assembly connector of said device when said process cartridge is mounted to main assembly of the apparatus, said electrical connector comprising:

a storing member for storing information;

a plurality of electrical contacts for separably connecting with the contact of said main assembly connector when they are connected electrically with said main assembly connector;

a wall enclosing said electrical contacts, wherein free ends of said electrical contacts are provided inside said wall in the direction of height of said wall;

an outer wall covering longitudinal opposite ends of said storing member; and a plurality of lead lines extended out of said opposite ends, wherein said lead lines are connected with said electrical contacts, by which said storing member is electrically connected with said electrical contacts;

wherein at least one lateral end of said storing member is exposed, and said storing member is removable from a mounting position by inserting a tool at the end portion; and wherein a space is formed between an inner surface of said wall and said electrical contact, wherein said engaging portion is engaged with said space when said electrical connector is to be electrically connected with the main assembly connector, and wherein when said engaging portion is engaged with said space, said electrical contacts of said electrical connector enter said dimple so that electrical contacts are electrically connected with the main assembly electrical contact provided in said dimple.

39. A process cartridge according to claim 38, wherein said process cartridge further comprises a cleaning member for removing toner remaining on said electrophotographic photosensitive member.

40. A process cartridge according to claim 38, wherein said electrical connector is mounted to a cleaning frame for supporting said electrophotographic photosensitive member, said charging member and said cleaning member.

41. A process cartridge according to claim 38, wherein said storing member is mounted at a position upstream of said electronic contacts in a direction of connection of said electrical connector with said main assembly connector.

42. A process cartridge according to claim 38 or 41, wherein said wall is provided with a taper adjacent an end for connection with said main assembly connector, wherein when said electrical connector is to be connected with the main assembly connector, it is guided by said taper.

43. A process cartridge according to claim 38 or 41, wherein said electrical contact is provided inside said wall in the direction of height of said wall so as to assure a such a distance that even when a probe having an angle of 25 degrees at a free end thereof is inserted into said space, said probe is not contacted to said electrical contact.

44. A process cartridge according to claim 38 or 41, wherein said electrical connector is mounted on a cartridge frame such that storing member is positioned in a space constituted by a wall member provided in said cartridge frame, wherein said wall member is provided with a rib, and said rib is contacted to a base portion of a side wall of said electrical connector.

45. An image forming apparatus for forming an image on a recording material, to which a process cartridge is detachably mountable, comprising:

a main assembly connector in a main assembly of the apparatus;

an electrophotographic photosensitive member;

process means actable on said electrophotographic photosensitive member;

an electrical connector electrically connectable with said main assembly connector of said electrophotographic image forming apparatus when said process cartridge is mounted to the main assembly of the image forming apparatus, said electrical connector comprising:

a storing member for storing information; and a plurality of electrical contacts for separably connecting with a contact of said main assembly connector when they are connected electrically with said main assembly connector;

wherein said storing member is electrically connected with said electrical contacts with lead lines;

a mounting portion for detachably mounting said process cartridge; and a feeding member for feeding the recording material.

46. An electrophotographic image forming apparatus for forming an image on a recording material, to which a process cartridge is detachably mountable, comprising:

a main assembly comprising a main assembly connector having an engaging portion, a dimple provided in said engaging portion and an electrical contact of the main assembly of the apparatus provided in said dimple;

an electrophotographic photosensitive member;

a charging member for charging said electrophotographic photosensitive member;

a cleaning member for removing toner remaining on said electrophotographic photosensitive member;

an electrical connector electrically connectable with said main assembly connector when said process cartridge is mounted to the main assembly, said electrical connector comprising:

a storing member for storing information;

a plurality of electrical contacts for separably connecting with the contact of said main assembly connector when they are connected electrically with said main assembly connector; and a wall enclosing said electrical contacts, wherein free ends of said electrical contacts are provided inside said wall in the direction of height of said wall;

wherein a space is formed between an inner surface of said wall and said electrical contacts, wherein said engaging portion is engaged with said space when said electrical connector is to be electrically connected with the main assembly connector, wherein when said engaging portion is engaged with said space, said electrical contacts of said electrical connector enter said dimple so that said electrical contacts are electrically connected with the main assembly electrical contact provided in said dimple, wherein said storing member is electrically connected with said electrical contacts with lead lines, and wherein said electrical connector is mounted in a mounting direction of said process cartridge when said process cartridge is mounted to the main assembly of said device;

a mounting portion for detachably mounting said process cartridge; and a feeding member for feeding the recording material.

47. An electrophotographic image forming apparatus for forming an image on a recording material, to which a process cartridge is detachably mountable, comprising:

a main assembly comprising a main assembly connector having an engaging portion, a dimple provided in said engaging portion and an electrical contact provided in said dimple;

an electrophotographic photosensitive member;

a charging member for charging said electrophotographic photosensitive member;

an electrical connector electrically connectable with said main assembly connector when said process cartridge is mounted to said main assembly, said electrical connector comprising:

a storing member for storing information;

a plurality of electrical contacts for separably connecting with the contact of said main assembly connector when they are connected electrically with said main assembly connector;

a wall enclosing said electric contacts, wherein free ends of said electrical contacts are provided inside said wall in the direction of height of said wall;

an outer wall covering longitudinal opposite ends of said storing member; and a plurality of lead lines extended out of said opposite ends, wherein said lead lines are connected with said electrical contacts, by which said storing member is electrically connected with said electrical contact, wherein at least one lateral end of said storing member is exposed, and said storing member is removable from a mounting position by inserting a tool at the end portion; and wherein a space is formed between an inner surface of said wall and said electrical contacts, wherein said engaging portion is engaged with said space when said electrical connector is to be electrically connected with the main assembly connector, wherein when said engaging portion is engaged with said space, said electrical contacts of said electrical connector enter said dimple so that said electrical contacts are electrically connected with the main assembly electrical contact provided in said dimple;

a mounting portion for detachably mounting said process cartridge; and a feeding member for feeding the recording material.

48. A couple of connectors for connection and disconnection of an electric circuit, the improvement residing in that:

one of said connectors has an IC, and said IC receives and delivers signals through the other of said connectors.

49. A couple according to claim 48, further comprising connecting means for electrically directly connecting one of said connectors and the other thereof.

50. A couple according to claim 48, wherein said one of connectors includes connecting means for effecting said receiving and delivering of the signals and for effecting supply of electric energy through the other of said connectors.

51. A couple according to claim 48, further comprising connecting means for effecting said receiving and delivering of the signals, for effecting supply of electric energy and for delivering signals from sensors connected with said connector having the IC.

52. A couple according to claim 48, wherein at least one of said connectors is mounted for movement to absorb deviation occurring at the time of connector engaging.

53. A couple according to claim 48, wherein said one of said connectors having the IC has a connector body enclosing a circumference of said IC, wherein said connector body prevents said IC from being exposed to outside.

54. A couple according to claim 53, wherein said connector body has an outer wall enclosing the IC, and the outer wall of said connector body of said one of connectors having said IC, is provided with a portion which is inside an edge of the outer wall, in a side or each of two sides of said IC not having contacts.

55. A couple according to claim 53, further comprising a projection on a surface of said connector body faced to a bottom surface of said IC to prevent surface contact between the bottom surface of said IC and the surface of said connector body.

56. A couple according to claim 48, further comprising an IC, connection contacts as said connecting means, and connector body for supporting said IC and said connection contacts.

57. A couple according to claim 56, wherein the connector body has an engaging portion for separable engagement with the counterpart connector not having the IC and made of insulating material, a base portion side outer wall portion cooperating with said engaging portion to enclose the connection contact and continuous from said engaging portion, and the IC and contact mounting portion in and over said engaging portion and said base portion outer wall, wherein said IC and said contact are mounted to said IC and contact mounting portion and are connected with each other.

58. A couple according to claim 57, wherein electrostatic discharge preventing means in the form of an extension of said engaging portion around said contact to the counterpart connector engaging portion so as to prevent a conical probe from directly contacting to the contact from said engaging portion.

59. A couple according to claim 57, wherein a part of the outer wall of the main assembly of said connector is openable, and there is provided a fixing member for sandwiching said IC, in the openable portion, and wherein when said connector is not mounted to a mounting member for the connector, said fixing member is in an open state, and when said connector is mounted thereto, said fixing member is closed state to prevent movement of said IC.

60. A couple according to claim 48, wherein said IC functions as electrically erasable memory means.

61. A couple according to claim 48, wherein said connector having said IC is supported on a supporting and is mounted to a connector mounting member through said supporting member.

62. A couple according to claim 61, wherein said connector is supported on two supporting members.

63. A couple according to claim 61, wherein said connector is integrally molded with one of said supporting members, is supported on the other supporting member.

64. A couple according to claim 61, wherein said connector and said supporting member are integrally molded.

65. A unit detachably mountable relative to a main assembly of an electrophotographic image forming apparatus, the improvement residing in the provision of a unit connector having an IC for signal communication with an electronic device in the main assembly through a main assembly connector in said main assembly, wherein said unit connector includes:

a mounting portion;

a plurality of electrical contacts, a plurality of which are on one side of said mounting portion, and the rest of which are on the other side of said mounting portion, for separably connecting with a contact of said main assembly connector when they are connected electrically with said main assembly connector; and a wall enclosing said electrical contacts with a space between inner surface of said wall and said electrical contacts, wherein said IC is electrically connected with said electrical contacts by lead lines, and wherein said unit connector is disconnectably connectable with the main assembly connector in said main assembly.

66. A unit detachably mountable relative to a main assembly of an image forming apparatus, the improvement residing in the provision of a connector having an IC for signal communication with an electronic device in the main assembly through a connector in said main assembly, wherein said connector is disconnectably connectable with the connector in said main assembly, wherein said unit further comprises:

a mounting portion:

a plurality of electrical contacts, a plurality of which are on one side of said mounting portion and the rest of which are on an opposite side thereof, for separably connecting with a contact of the main assembly connector when they are connected electrically with the main assembly connector: and a wall enclosing said mounting portion with a space between the inner surface of said wall and said electrical contacts on said mounting portion, wherein said IC is electrically connected with said electrical contacts with lead lines.

67. A unit detachably mountable relative to a main assembly of an image forming apparatus, the improvement residing in the provision of a connector having an IC for signal communication with an electronic device in the main assembly through a connector in said main assembly, wherein said connector is disconnectably connectable with the connector in said main assembly, wherein a unit side connector is mounted to said unit mounted on a supporting member for supporting said connector, wherein said unit further comprises:

a mounting portion;

a plurality of electrical contacts, a plurality of which are on one side of said mounting portion and the rest of which are on an opposite side thereof, for separably connecting with a contact of the main assembly connector when they are connected electrically with the main assembly connector; and a wall enclosing said mounting portion with a space between the inner surface of said wall and said electrical contacts on said mounting portion, wherein said IC is electrically connected with said electrical contacts with lead lines.

68. A unit detachably mountable relative to a main assembly of an image forming apparatus, the improvement residing in the provision of a connector having an IC for signal communication with an electronic device in the main assembly through a connector in said main assembly, wherein said connector is disconnectably connectable with the connector in said main assembly, wherein said unit includes developing means for developing a latent image on an electrophotographic photosensitive member, wherein said unit further comprises:

a mounting portion;

a plurality of electrical contacts, a plurality of which are on one side of said mounting portion and the rest of which are on an opposite side thereof, for separably connecting with a contact of the main assembly connector when they are connected electrically with the main assembly connector; and a wall enclosing said mounting portion with a space between the inner surface of said wall and said electrical contacts on said mounting portion, wherein said IC is electrically connected with said electrical contacts with lead lines.

69. A unit detachably mountable relative to a main assembly of an image forming apparatus, the improvement residing in the provision of a connector having an IC for signal communication with an electronic device in the main assembly through a connector in said main assembly, wherein said connector is disconnectably connectable with the connector in said main assembly, wherein said unit is a toner cartridge for supplying toner to developing means, wherein said unit further comprises:

a mounting portion;

a plurality of electrical contacts, a plurality of which are on one side of said mounting portion and the rest of which are on an opposite side thereof, for separably connecting with a contact of the main assembly connector when they are connected electrically with the main assembly connector; and a wall enclosing said mounting portion with a space between the inner surface of said wall and said electrical contacts on said mounting portion, wherein said IC is electrically connected with said electrical contacts with lead lines.

70. An electrical connector for electrically connecting a main assembly of an electrophotographic image forming apparatus with a process cartridge detachably mountable to the main assembly, said electrical connector comprising:

a main-assembly connector; and a process-cartridge connector, electrically connected to said main-assembly connector when said process cartridge is mounted on the main assembly, wherein said process-cartridge connector comprises:

a connector main structure comprising:

an integrated circuit mount inside said connector main structure;

a plurality of a plurality of electrical contacts, a plurality of which are on one side of said integrated circuit mount and the rest of which are on an opposite side thereof, for separably connecting with an electrical contact of the main assembly connector when they are connected electrically with the main assembly connector;

a wall enclosing said integrated circuit mount with a space between the inner surface of said wall and said electrical contacts on said integrated circuit mount, wherein said wall comprises:

a base portion having a base side external wall; and an engagement portion having an engagement portion side external wall connected to said base side external wall, wherein said base side external wall and said engagement portion side external wall surround said integrated circuit mount;

wherein said integrated circuit mount is spaced from said base side external wall and said engagement portion side external wall to form therewith a continuous terminal mounting space which opens outward at the top and the bottom of said connector main structure;

an integrated circuit storing member mounted on said integrated circuit mount; and an electrical contact, in contact with said integrated circuit storing member and positioned inside said continuous terminal mounting space; and a connector mount portion for mounting said process-cartridge connector to said process cartridge, wherein said main-assembly connector comprises:

a connector main structure automatically engaged with said connector main structure of said process cartridge as said process cartridge is mounted on said main assembly, wherein said connector main structure of said main-assembly connector is attachable to a connector mount of the main assembly;

wiring, attached to and extending downwardly from said connector main structure; and an electrical contact, connected to the wiring, and engaged with said electrical contact of said process-cartridge connector when said process cartridge is mounted on said main assembly and said connector main structure of said main-assembly connector automatically engages said connector main structure of said process-cartridge connector.

71. The electrical connector according to claim 70, wherein said connector main structure of said main-assembly connector comprises two screws extending downwardly therefrom, which are engagable with a connector mount of the main assembly in such a manner as to floatingly connect said connector main structure to the connector mount, thereby preventing imperfect alignment between the process cartridge and the main assembly from generating stress in said connector main structures of said main-assembly connector and said process-cartridge connector when said process cartridge is mounted on said main assembly and said connector main structure of said main-assembly connector automatically engages said connector main structure of said process-cartridge connector.

72. The electrical connector according to claim 70, wherein said connector main structure of said process-cartridge connector is composed of synthetic resin.

73. The electrical connector according to claim 70, wherein said connector main structure of said process-cartridge connector is hollow and has a substantially rectangular cross-section.

74. The electrical connector according to claim 70, wherein said base portion of said connector main structure of said process-cartridge connector is larger than said engagement portion of said connector main structure of said process-cartridge connector.

75. The electrical connector according to claim 70, wherein the longitudinal section of said integrated circuit mount is substantially T-shaped.

76. The electrical connector according to claim 70, wherein said electrical contact of said process-cartridge connector contacts said integrated circuit mount.

77. The electrical connector according to claim 76, wherein said electrical contact of said process-cartridge connector contacts said integrated circuit mount except at the bottom end thereof, wherein the bottom end of said process-cartridge-connector electrical contact is bent outward away from said integrated circuit mount.

78. The electrical connector according to claim 70, wherein said process-cartridge connector comprises a plurality of electrical contacts, wherein said integrated circuit storing member comprises lead wires, each of which directly press on one of said process-cartridge electrical contacts, wherein said integrated circuit storing member is electrically connected to said plurality of process-cartridge-connector electrical contacts by said lead wires.

79. The electrical connector according to claim 70, wherein said main-assembly-connector main structure comprises:

a mount portion comprising two screws extending downwardly therefrom for engagement with the main assembly; and an engagement portion for engaging said engagement portion of said process-cartridge-connector main structure.

80. The electrical connector according to claim 79, wherein said engagement portion of said main-assembly-connector main structure is in the form of a rectangular parallelepiped.

81. The electrical connector according to claim 79, wherein said main-assembly-connector electrical contact contacts an internal surface of said main-assembly connector engagement portion.

82. The electrical connector according to claim 79, wherein said engagement portion of said main-assembly connector main structure has a cavity therein in which said main-assembly connector electrical contact is disposed, wherein as the process cartridge is inserted into the image-forming-apparatus main assembly, an internal peripheral surface of said engagement portion of said process-cartridge connector main structure contacts the external peripheral surface of said engagement portion of said main-assembly connector main structure and the bottom portion of said process-cartridge connector electrical contact presses against said main-assembly connector electrical contact.

83. The electrical connector according to claim 70, wherein said integrated circuit storing member is positioned behind said process-cartridge-connector main structure relative to the direction in which said process-cartridge connector is connected to said main-assembly connector when said process cartridge is mounted to the main assembly.

84. The electrical connector according to claim 70, wherein said main-assembly connector main structure comprises an engagement portion for engaging with said process-cartridge-connector-main structure engagement portion, wherein the bottom end of said process-cartridge-connector engagement portion is tapered to guide said main-assembly-connector engagement portion when said process cartridge is mounted on the main assembly.

85. The electrical connector according to claims 4, 5, 7, or 8, wherein said storing member is mounted at a position upstream of said plurality of electrical contacts in a direction of connection of said plurality of electrical contacts with said main assembly connector.

86. The electrical connector according to claims 4, 5, 7, or 8, wherein free ends of said plurality of electrical contacts are provided inside said wall in a direction of the height of said wall, and in a direction in which a part of said main-assembly connector enters a space in said electrical connector.

87. The electrical connector according to claims 4, 5, 7, or 8, wherein said wall is composed of synthetic resin.

88. The electrical connector according to claims 4, 5, 7, or 8, wherein said electrical connector is hollow and has a substantially rectangular cross-section.

89. The electrical connector according to claims 4, 5, 7, or 8 wherein said electrical connector comprises a base portion and an engagement portion, wherein said storing member is attached to said base portion, wherein said plurality of electrical contacts extend through said base portion and said engagement portion, wherein said base portion is larger than said engagement portion.

90. The electrical connector according to claims 4, 5, 7, or 8, further comprising a mount for mounting said storing member, wherein the longitudinal section of said mount is substantially T-shaped.

91. The electrical connector according to claim 90, wherein said plurality of electrical contacts contact said mount except at the bottom end thereof, wherein the bottom end of said process-cartridge-connector electrical contact is bent outward away from said integrated circuit mount.

92. The unit according to claims 66, 67, 68, or 69, further comprising a plurality of electrical contacts for forming an electrical connection between said unit and the main assembly, wherein said IC is mounted on said unit connector at a position upstream of said plurality of electrical contacts in a direction of connection of said plurality of electrical contacts with said main assembly.

93. The unit according to claims 66, 67, 68, or 69 further comprising:

a plurality of electrical contacts for forming an electrical connection between said unit and the main assembly; and a wall enclosing said plurality of electrical contacts, wherein free ends of said plurality of electrical contacts are provided inside said wall in a direction of the height of said wall, and in a direction in which a part of said unit connector is connected to the main assembly connector.

94. The unit according to claims 66, 67, 68, or 69 wherein said unit connector is composed of synthetic resin.

95. The unit according to claims 66, 67, 68, or 69, wherein said unit connector has a substantially rectangular cross-section.

96. The unit according to claims 66, 67, 68, or 69, further comprising a plurality of electrical contacts for forming an electrical connection between said unit and the main assembly, wherein said unit connector comprises a base portion and an engagement portion, wherein said IC is attached to said base portion, wherein said plurality of electrical contacts extend through said base portion and said engagement portion, wherein said base portion is larger than said engagement portion.

97. The unit according to claims 66, 67, 68, or 69, further comprising a mount for mounting said IC, wherein the longitudinal section of said mount is substantially T-shaped.

98. The unit according to claims 97, further comprising a plurality of electrical contacts for forming an electrical connection between said unit and the main assembly, wherein said plurality of electrical contacts contact said mount except at the bottom end thereof, wherein the bottom end of said plurality of electrical contact is bent outward away from said mount.

99. An electrical connector electrically connectable with a main assembly connector, provided in a main assembly of an electrophotographic image forming apparatus, comprising:

a storing member for storing information;

a plurality of electrical contacts for separably connecting with a contact of said main assembly connector when they are connected electrically with said main assembly connector; and a wall provided so as to enclose said electrical contacts, wherein free ends of said electrical contacts are provided inside said wall in a direction of height of said wall, and wherein said storing member is electrically connected with each of said electrical contacts with lead lines, wherein said wall is provided with a taper adjacent an end for connection with said main assembly connector, wherein when said electrical connector is to be connected with the main assembly connector, it is guided by said taper, wherein said storing member is mounted at a position upstream of said plurality of electrical contacts in a direction of connection of said plurality of electrical contacts with said main assembly connector, wherein said free ends of said plurality of electrical contacts are provided inside said wall in a direction of the height of said wall, and in a direction in which a part of said main-assembly connector enters a space in said electrical connector, wherein said wall is composed of synthetic resin, wherein said electrical connector is hollow and has a substantially rectangular cross-section, and wherein said electrical connector comprises a base portion and an engagement portion, wherein said storing member is attached to said base portion, wherein said plurality of electrical contacts extend through said base portion and said engagement portion, and wherein said base portion is larger than said engagement portion.

100. An electrical connector electrically connectable with a main assembly connector, provided in a main assembly of an electrophotographic image forming apparatus, comprising:

a storing member for storing information;

a plurality of electrical contacts for separably connecting with a contact of said main assembly connector when they are connected electrically with said main assembly connector;

wherein said storing member is electrically connected with said electrical contacts with lead lines; and a wall provided so as to enclose said electrical contacts, and wherein free ends of said electrical contacts, are provided inside said wall in a direction of height of said wall, wherein when said electrical connector is to be connected electrically with said main assembly connector, an engaging portion of said main assembly connector is engaged with a space formed between an inner surface of said wall and said electrical contacts, wherein said engaging portion is provided with a dimple, into which said electronic contacts of said electrical connector enter to be electrically connected with the electrical contacts, wherein said storing member is mounted at a position upstream of said plurality of electrical contacts in a direction of connection of said plurality of electrical contacts with said main assembly connector, wherein said free ends of said plurality of electrical contacts are provided inside said wall in a direction of the height of said wall, and in a direction in which a part of said main-assembly connector enters a space in said electrical connector, wherein said wall is composed of synthetic resin, wherein said electrical connector is hollow and has a substantially rectangular cross-section, and wherein said electrical connector comprises a base portion and an engagement portion, wherein said storing member is attached to said base portion, wherein said plurality of electrical contacts extend through said base portion and said engagement portion, and wherein said base portion is larger than said engagement portion.

101. A process-cartridge connector of a process cartridge, electrically connectable to a main-assembly connector of a main assembly of an electrophotographic image forming apparatus, for electrically connecting the main assembly of the electrophotographic image forming apparatus with the process cartridge when said process cartridge is mounted on the main assembly, said electrical connector comprising:

a connector main structure comprising:

an integrated circuit mount inside said connector main structure;

a plurality of a plurality of electrical contacts, a plurality of which are on one side of said integrated circuit mount and the rest of which are on an opposite side thereof, for separably connecting with an electrical contact of the main assembly connector when they are connected electrically with the main assembly connector;

a wall enclosing said integrated circuit mount with a space between the inner surface of said wall and said electrical contacts on said integrated circuit mount, wherein said wall comprises:

a base portion having a base side external wall; and an engagement portion having an engagement portion side external wall connected to said base side external wall, wherein said base side external wall and said engagement portion side external wall surround said integrated circuit mount;

wherein said integrated circuit mount is spaced from said base side external wall and said engagement portion side external wall to form therewith a continuous terminal mounting space which opens outward at the top and the bottom of said connector main structure;

an integrated circuit storing member mounted on said integrated circuit mount;

an electrical contact, in contact with said integrated circuit storing member and positioned inside said continuous terminal mounting space; and a connector mount portion for mounting said process-cartridge connector to said process cartridge, wherein said connector main structure of said process cartridge automatically engages the connector main structure of the main-assembly connector as said process cartridge is mounted on said main assembly, and wherein electrical contact of said process-cartridge connector engages an electrical contact of the main-assembly connector when said process cartridge is mounted on the main assembly and the connector main structure of the main-assembly connector automatically engages said connector main structure of said process-cartridge connector.

102. The process-cartridge connector according to claim 101, wherein said connector main structure of said process-cartridge connector is composed of synthetic resin.

103. The process-cartridge connector according to claim 101, wherein said connector main structure of said process-cartridge connector is hollow and has a substantially rectangular cross-section.

104. The process-cartridge connector according to claim 101, wherein said base portion of said connector main structure of said process-cartridge connector is larger than said engagement portion of the connector main structure of said process-cartridge connector.

105. The process-cartridge connector according to claim 101, wherein the longitudinal section of said integrated circuit mount is substantially T-shaped.

106. The process-cartridge connector according to claim 101, wherein said electrical contact of said process-cartridge connector contacts said integrated circuit mount.

107. The process-cartridge connector according to claim 106, wherein said electrical contact of said process-cartridge connector contacts said integrated circuit mount except at the bottom end thereof, wherein the bottom end of said process-cartridge-connector electrical contact is bent outward away from said integrated circuit mount.

108. The process-cartridge connector according to claim 101, wherein said integrated circuit storing member comprises lead wires, each of which directly press on one of said process-cartridge electrical contacts, wherein said integrated circuit storing member is electrically connected to said plurality of process-cartridge-connector electrical contacts by said lead wires.

109. The process-cartridge connector according to claim 101, wherein said integrated circuit storing member is positioned behind said process-cartridge-connector main structure relative to the direction in which said process-cartridge connector is connected to the main-assembly connector when said process cartridge is mounted to the main assembly.

* * * * *

UNITED STATES PATENT AND TRADEMARK OFFICE

CERTIFICATE OF CORRECTION

PATENT NO. : 6,097,908
DATED : August 1, 2000
INVENTOR(S) : Seiji Uchiyama et al.

It is certified that error appears in the above-identified patent and that said Letters Patent is hereby corrected as shown below:

Replace Title Page and subsequent pages with this Title Page and attached pages.

United States Patent [19]
Uchiyama et al.

[11] Patent No.: 6,097,908
[45] **Date of Patent: *Aug. 1, 2000**

[54] ELECTRICAL CONNECTOR, PROCESS CARTRIDGE AND ELECTROPHOTOGRAPHIC IMAGE FORMING APPARATUS

[75] Inventors: Seiji Uchiyama, Numazu; Kazushi Watanabe; Atsushi Numagami, both of Mishima; Katsunori Yokoyama, Susono, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/787,327

[22] Filed: Jan. 28, 1997

[30] Foreign Application Priority Data

Jan. 31, 1996 [JP] Japan ..... 8-017304

[51] Int. Cl.[7] ..... G03G 2/16; G03G 15/00; H01R 13/42

[52] U.S. Cl. ..... 399/111; 399/90; 439/248

[58] Field of Search ..... 399/111, 90, 1; 399/83; 439/248

[56] References Cited

U.S. PATENT DOCUMENTS

| | | | |
|---|---|---|---|
| 4,963,939 | 10/1990 | Kurando et al. | |
| 4,995,033 | 10/1990 | Sarti | |
| 5,095,335 | 3/1992 | Watanabe et al. | 355/210 |
| 5,125,846 | 6/1992 | Sampson et al. | 439/66 |
| 5,283,613 | 2/1994 | Midgley, Sr. | |
| 5,286,222 | 2/1994 | Yagi et al. | 439/607 |
| 5,299,942 | 4/1994 | Burke et al. | |
| 5,331,372 | 7/1994 | Tsuda et al. | 355/200 |
| 5,345,294 | 9/1994 | Nomura et al. | 355/200 |
| 5,360,753 | 11/1994 | Kinoshita | |
| 5,404,198 | 4/1995 | Noda et al. | 355/200 |
| 5,470,635 | 11/1995 | Shirai et al. | 428/131 |
| 5,475,470 | 12/1995 | Sasago et al. | 355/210 |
| 5,485,245 | 1/1996 | Kobayashi et al. | |
| 5,488,459 | 1/1996 | Tsuda et al. | 355/211 |
| 5,500,714 | 3/1996 | Yamaro et al. | 355/200 |
| 5,510,878 | 4/1996 | Noda et al. | 355/211 |
| 5,512,988 | 4/1996 | Donaldson | |
| 5,543,898 | 8/1996 | Shishido et al. | 355/210 |
| 5,583,613 | 12/1996 | Kobayashi et al. | 355/200 |
| 5,602,623 | 2/1997 | Nishibata et al. | 399/111 |
| 5,608,509 | 3/1997 | Shirai et al. | 399/351 |
| 5,708,912 | 1/1998 | Lee | 399/24 |

FOREIGN PATENT DOCUMENTS

| | | |
|---|---|---|
| 4 114 921 | 11/1992 | Germany |
| 42 18793 | 12/1993 | Germany |
| 0 395 320 | 4/1990 | European Pat. Off. |
| 0 525 664 | 2/1993 | European Pat. Off. |
| 0 612 124 | 8/1994 | European Pat. Off. |
| 1995-31736 | 11/1995 | Korea . |
| 195998 | 12/1992 | Taiwan . |

OTHER PUBLICATIONS

Patent Abstract of Japan, vol. 007, No. 249, (P-234), Nov. 4, 1983 (JP 58-132258)
Patent Abstract of Japan, vol. 017, No. 424 (E-1410), Aug. 6, 1993 (JP 05-080935)
Patent Abstract of Japan, vol. 13, No. 537 (P-958), Nov. 30, 1989 (JP 01-221765).
Patent Abstract of Japan, vol. 017, No. 525 (E-1436), Sep. 21, 1993 (JP 05-144598).

*Primary Examiner*—Richard Moses
*Attorney, Agent, or Firm*—Fitzpatrick, Cella, Harper & Scinto

[57] ABSTRACT

An electrical connector electrically connectable with a main assembly connector, provided in a main assembly of an electrophotographic image forming apparatus includes storing member for storing information; a plurality of electrical contacts for separably connecting with a contact of the main assembly connector, when they are connected electrically with the main assembly connector; wherein the storing member is electrically connected with each of the electrical contacts with lead lines.

109 Claims, 13 Drawing Sheets

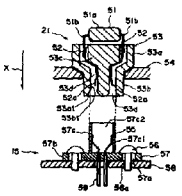

Signed and Sealed this

Twenty-fourth Day of February, 2004

JON W. DUDAS
*Acting Director of the United States Patent and Trademark Office*

United States Patent [19]

Uchiyama et al.

[11] Patent No.: 6,097,908

[45] **Date of Patent: *Aug. 1, 2000**

[54] ELECTRICAL CONNECTOR, PROCESS CARTRIDGE AND ELECTROPHOTOGRAPHIC IMAGE FORMING APPARATUS

[75] Inventors: Seiji Uchiyama, Numazu; Kazushi Watanabe; Atsushi Numagami, both of Mishima; Katsunori Yokoyama, Susono, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/787,327

[22] Filed: Jan. 28, 1997

[30] Foreign Application Priority Data

Jan. 31, 1996 (JP) Japan ..... 8-037304

[51] Int. Cl.[7] ..... G03G 2/16; G03G 15/00; H01R 13/42

[52] U.S. Cl. ..... 399/111; 399/90; 439/248

[58] Field of Search ..... 399/111, 90, 1, 399/83; 439/248

[56] References Cited

U.S. PATENT DOCUMENTS

| | | | |
|---|---|---|---|
| 4,963,939 | 10/1990 | Kurando et al. | |
| 4,965,633 | 10/1990 | Surti . | |
| 5,095,335 | 3/1992 | Watanabe et al. | 355/210 |
| 5,125,846 | 6/1992 | Sampson et al. | 439/66 |
| 5,283,613 | 2/1994 | Midgley, Sr. | |
| 5,286,222 | 2/1994 | Yagi et al. | 439/607 |
| 5,299,942 | 4/1994 | Burke et al. | |
| 5,331,372 | 7/1994 | Tsuda et al. | 355/200 |
| 5,345,294 | 9/1994 | Nomura et al. | 355/200 |
| 5,360,353 | 11/1994 | Kinoshita | |
| 5,404,198 | 4/1995 | Noda et al. | 355/200 |
| 5,470,635 | 11/1995 | Shirai et al. | 428/131 |
| 5,475,470 | 12/1995 | Sasago et al. | 355/210 |
| 5,485,245 | 1/1996 | Kobayashi et al. | |
| 5,488,459 | 1/1996 | Tsuda et al. | 355/211 |
| 5,500,714 | 3/1996 | Yashiro et al. | 355/200 |
| 5,510,878 | 4/1996 | Noda et al. | 355/211 |
| 5,512,988 | 4/1996 | Donaldson | |
| 5,543,898 | 8/1996 | Shishido et al. | 355/210 |
| 5,583,613 | 12/1996 | Kobayashi et al. | 355/200 |
| 5,602,623 | 2/1997 | Nishibata et al. | 399/111 |
| 5,608,509 | 3/1997 | Shirai et al. | 399/351 |
| 5,708,912 | 1/1998 | Lee | 399/24 |

FOREIGN PATENT DOCUMENTS

| | | |
|---|---|---|
| 4 114 921 | 11/1992 | Germany . |
| 42 18793 | 12/1993 | Germany . |
| 0 395 320 | 4/1990 | European Pat. Off. . |
| 0 525 604 | 2/1993 | European Pat. Off. . |
| 0 612 124 | 8/1994 | European Pat. Off. . |
| 1995-31736 | 11/1995 | Korea . |
| 195998 | 12/1992 | Taiwan . |

OTHER PUBLICATIONS

Patent Abstract of Japan, vol. 007, No. 249, (P–234), Nov. 4, 1983 (JP 58–132758).

Patent Abstract of Japan, vol. 017, No. 424 (E–1410), Aug. 6, 1993 (JP 05–089933).

Patent Abstract of Japan, vol. 13, No. 537 (P–968), Nov. 30, 1989 (JP 01–221765).

Patent Abstract of Japan, vol. 017, No. 525 (E–1436), Sep. 21, 1993 (JP 05–144498).

*Primary Examiner*—Richard Moses

*Attorney, Agent, or Firm*—Fitzpatrick, Cella, Harper & Scinto

[57] ABSTRACT

An electrical connector electrically connectable with a main assembly connector, provided in a main assembly of an electrophotographic image forming apparatus includes storing member for storing information; a plurality of electrical contacts for separably connecting with a contact of the main assembly connector, when they are connected electrically with the main assembly connector; wherein the storing member is electrically connected with each of the electrical contacts with lead lines.

109 Claims, 13 Drawing Sheets

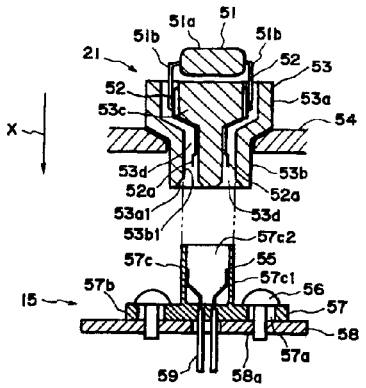

Figure 12A:
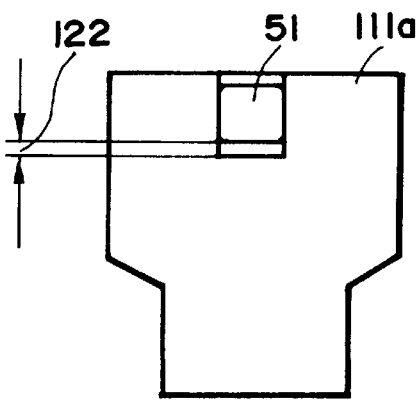
FIGS. 12(*a*) and 12(*b*) are a front view, and a sectional view as seen from the front, respectively, of the example of the connector from which an IC can be easily removed.
Figure 12B:
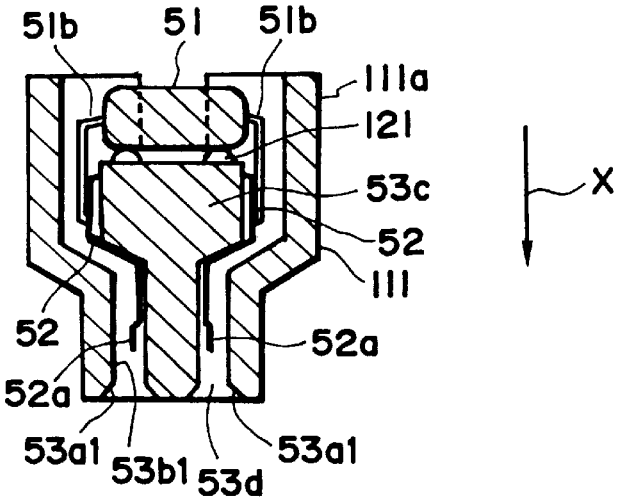

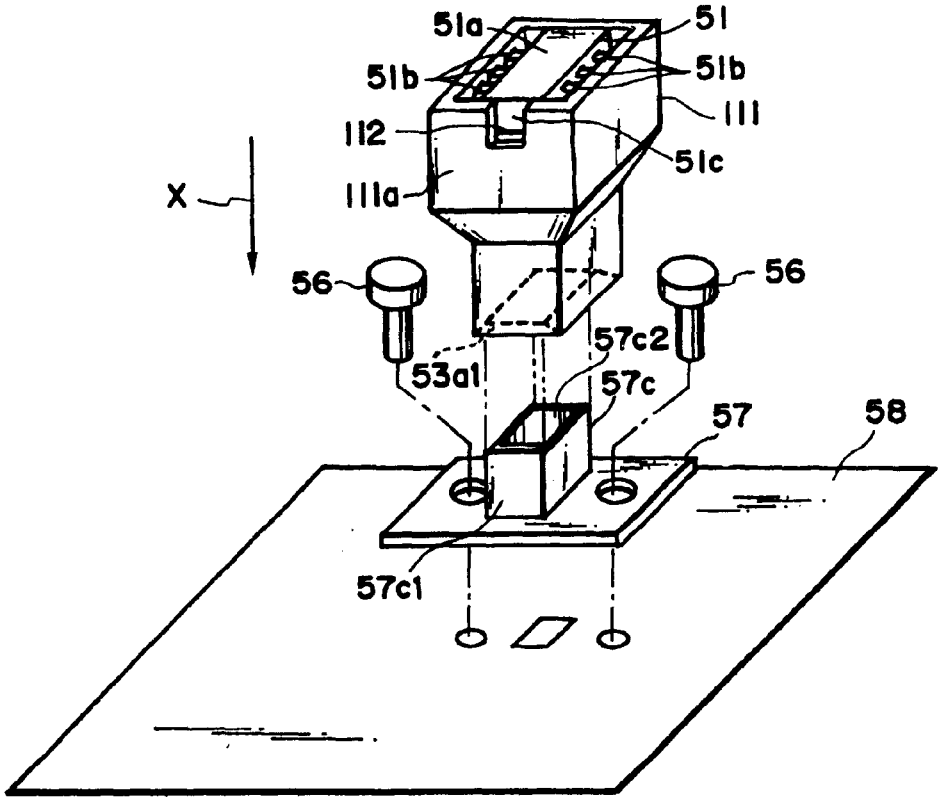
FIG. 11
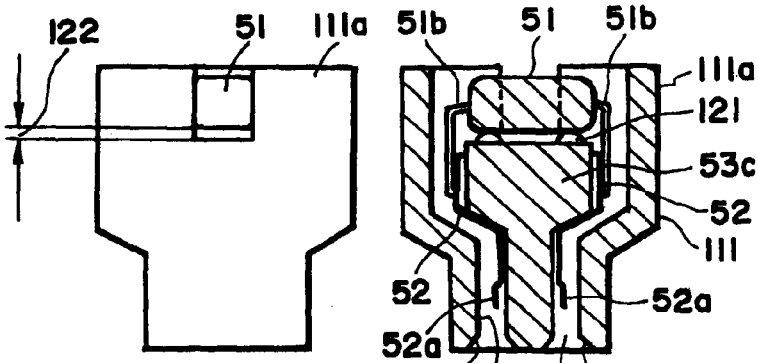
FIG. 12a
FIG. 12b

ELECTRICAL CONNECTOR, PROCESS CARTRIDGE AND ELECTROPHOTOGRAPHIC IMAGE FORMING APPARATUS

FIELD OF THE INVENTION AND RELATED ART

The present invention relates to an electrical connector, a process cartridge, and an electrophotographic image forming apparatus.

As discussed in this specification, an electrophotographic image forming apparatus includes an electrophotographic copy machine, an electrophotographic printer (LED printer, laser beam printer, and the like), an electrophotographic facsimile apparatus, an electrophotographic word processor, and the like. Also as used in this specification, the term process cartridge refers to such a process cartridge that is removably installable in the main assembly of an electrophotographic image forming apparatus, and integrally comprises an electrophotographic photosensitive member, as well as a charging means, a developing means, and/or a cleaning means. It also refers to a process cartridge that is removably installable in the main assembly of an image forming apparatus, and integrally comprises an electrophotographic photosensitive member, and at least a developing means.

Further, the present invention relates to any unit removably installable in the main assembly of an image forming apparatus. More specifically, it relates to any unit such as a developing device, a toner cartridge, a process cartridge, or the like, which is removably installable in the main assembly of an image forming apparatus.

It is common knowledge that some image forming apparatuses, such as a copy machine or a laser beam printer, which employ an electrophotographic image formation process, can be rendered maintenance-free with the use of a process cartridge which integrally comprises an electrophotographic photosensitive member, and one or a plurality of processing means, such as a cleaning unit or a development unit, which acts on the electrophotographic photosensitive member.

In the case of such an image forming apparatus as described above, after the functions of the structural components in a process cartridge deteriorate due to usage, the process cartridge is entirely replaced with a fresh process cartridge. This process, cartridge replacement operation is an extremely simply operation comprising a step of opening the main assembly of the image forming apparatus, a step of removing the process cassette with worn components out of the main assembly of the image forming apparatus, and a step of installing a fresh process cartridge in the main assembly of the image forming apparatus. Therefore, such an image forming apparatus can be easily maintained by a user alone.

Recently, the aforementioned conventional art has been further developed to improve the usability of the above described image forming apparatus. More specifically, it has been considered to add the following functions to the above image forming apparatus:

(1) Data storing function: data regarding manufacturing conditions and the like are written into an electronic device such as a memory provided in a process cartridge, at the time of manufacturing or shipment, and when the process cartridge is installed in the main assembly of an image forming apparatus, the data is looked up by the image forming apparatus in order to carry out an image forming operation under the optimum condition for the process cartridge.

(2) Toner remainder reporting function: the amount of the remaining toner is sequentially detected during the image forming operation, and is stored in the memory so that the data regarding the amount of the remaining toner can be sequentially looked up.

(3) Self diagnostic function: the diagnosis data for the main assembly of an image forming apparatus is stored in the memory of the process cartridge, in order to allow a service supplier to look up the stored diagnostic data to provide fast maintenance service, or to efficiently deal with an anomaly.

In order to add the above functions to an image forming apparatus, it is necessary to mount an electronic device, such as an EEPROM or the like, in a unit such as a process cartridge which is removably installable in the image forming apparatus. As the means for mounting the electronic device in the process cartridge, it is conceivable to provide the process cartridge with a printed circuit on which electronic devices such as a memory, and a connector, have been mounted.

Generally, the aforementioned non-volatile memory and connector are mounted on the printed circuit provided in a process cartridge, along with the electrically functional components such as a diode, a resistor, or a condenser, which protects the IC from an electrical surge.

SUMMARY OF THE INVENTION

A primary object of the present invention is to provide an electrical connector which makes it easier to mount a memory in a unit such as a process cartridge which is removably mountable in an image forming apparatus, as well as to provide a unit which is removably mountable in an image forming apparatus and comprises such an electrical connector, and an image forming apparatus compatible with such a unit.

Another object of the present invention is to provide an electrical connector which makes it possible to compactly mount a memory in a unit such as a process cartridge which is removably mountable in an image forming apparatus, as well as to provide a unit which is removably mountable in an image forming apparatus and comprises such an electrical connector, and an image forming apparatus compatible with such a unit.

Another object of the present invention is to provide an electrical connector which makes it possible to reliably establish an electrical connection between a memory and the main assembly of an electrophotographic image forming apparatus, as well as to provide a unit which is removably mountable in an image forming apparatus, and an image forming apparatus compatible with such a unit.

Another object of the present invention is to provide an electrical connector comprising a memory, a unit comprising such an electrical connector, and an image forming apparatus compatible with such a unit.

According to an aspect of the present invention, there is provided an electrical connector electrically connectable with a main assembly connector, provided in a main assembly of an electrophotographic image forming apparatus, comprising a storing member for storing information; a plurality of electrical contacts for separably connecting with a contact of the main assembly connector, when they are connected electrically with the main assembly connector; wherein the storing member is electrically connected with each of the electrical contacts with lead lines.

According to another aspect of the present invention, an electrical connector comprises storing means for storing data, and a plurality of electrical terminals which are connected to, or disconnected from, the corresponding electrical terminals of the counterpart connector provided on the main assembly side of an image forming apparatus, wherein the storing means is electrically connected to each of the plurality of electrical terminals by a lead wire, and a unit removably installable in an image forming apparatus comprises such an electrical connector. Further, an image forming apparatus is rendered compatible with such a unit.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 1 is a longitudinal sectional view of a process cartridge comprising a connector in accordance with the present invention, and an image forming apparatus containing such a process cartridge.

FIG. 2 is across-sectional view of a process cartridge comprising a connector in accordance with the present invention.

FIG. 3 is a block diagram for controlling the image forming apparatus illustrated in FIG. 1.

FIG. 4 is a perspective view of the connector in the first embodiment of the present invention, depicting the structure thereof.

FIG. 5 is a longitudinal sectional view of the connector in the first embodiment of the present invention, depicting the structure thereof.

FIG. 6 is a perspective view of the connector assembly in accordance with the present invention, and a process cartridge, depicting the structures therefore.

FIGS. 7(*a*) and 7(*b*) are a longitudinal sectional view of the connector assembly in the first embodiment of the present invention depicting the thereof.

FIGS. 8(*a*), 8(*b*) 8(*c*) are schematic longitudinal sections of the connector assembly and process cartridge, depicting how they are fitted together.

FIG. 9 is a perspective view of the connector in the second embodiment of the present invention, depicting the structure thereof.

FIG. 10 is a longitudinal sectional view of the connector in the second embodiment of the present invention, depicting the structure thereof.

FIG. 11 is a perspective view of an example of the connector from which an IC can be easily removed.

FIGS. 12(*a*) and 12(*b*) are a front view, and a sectional view as seen from the front, respectively, of the example of the connector from which an IC can be easily removed.

FIG. 13 is a longitudinal sectional view of a connector, depicting the connector structure for increasing the static electrical resistance of the connector.

FIG. 14 is a longitudinal sectional view of a connector, and a unit comprising the connector, depicting a structure for increasing static electric resistance of the connector, and how the connector is disposed in the unit.

FIGS. 15(*b*) and 15(*a*) are longitudinal sectional views of a connector capable of preventing accidental IC disengagement, depicting the connector before and after its placement in the unit, respectively.

Figure 16:
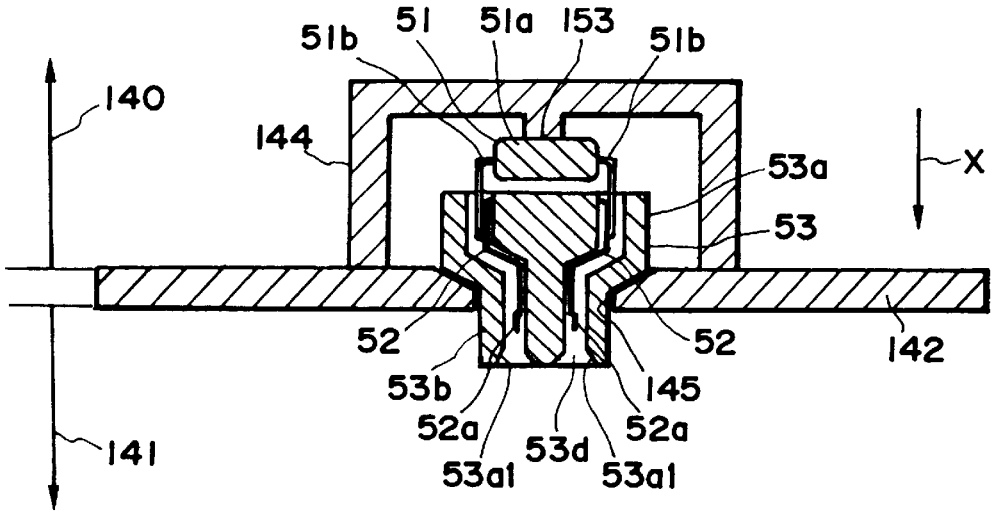
FIG. 16 is a longitudinal section of a connector and a unit comprising the connector, depicting a structural arrangement for preventing the accidental IC disengagement by the unit side.
Figure 17A:
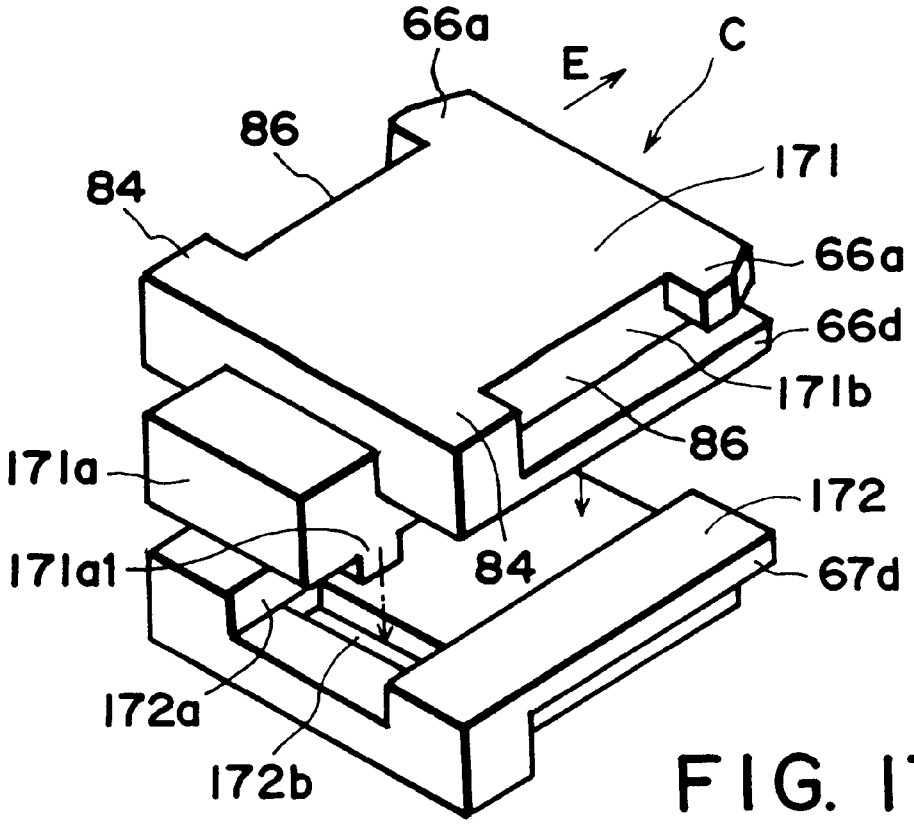
FIGS. 17(*a*) and 17(*b*) are perspective views of a connector assembly, depicting a two piece structure and a one piece structure, respectively.
Figure 17B:
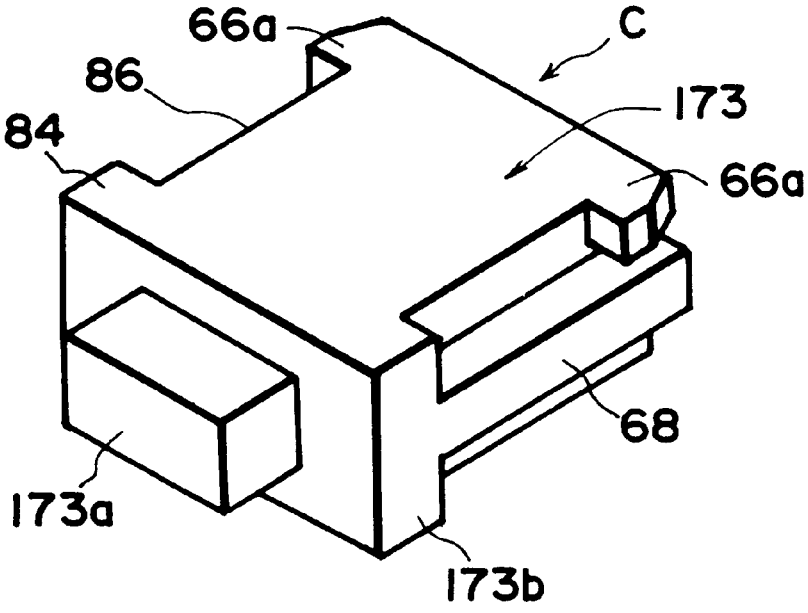
Figure 1:
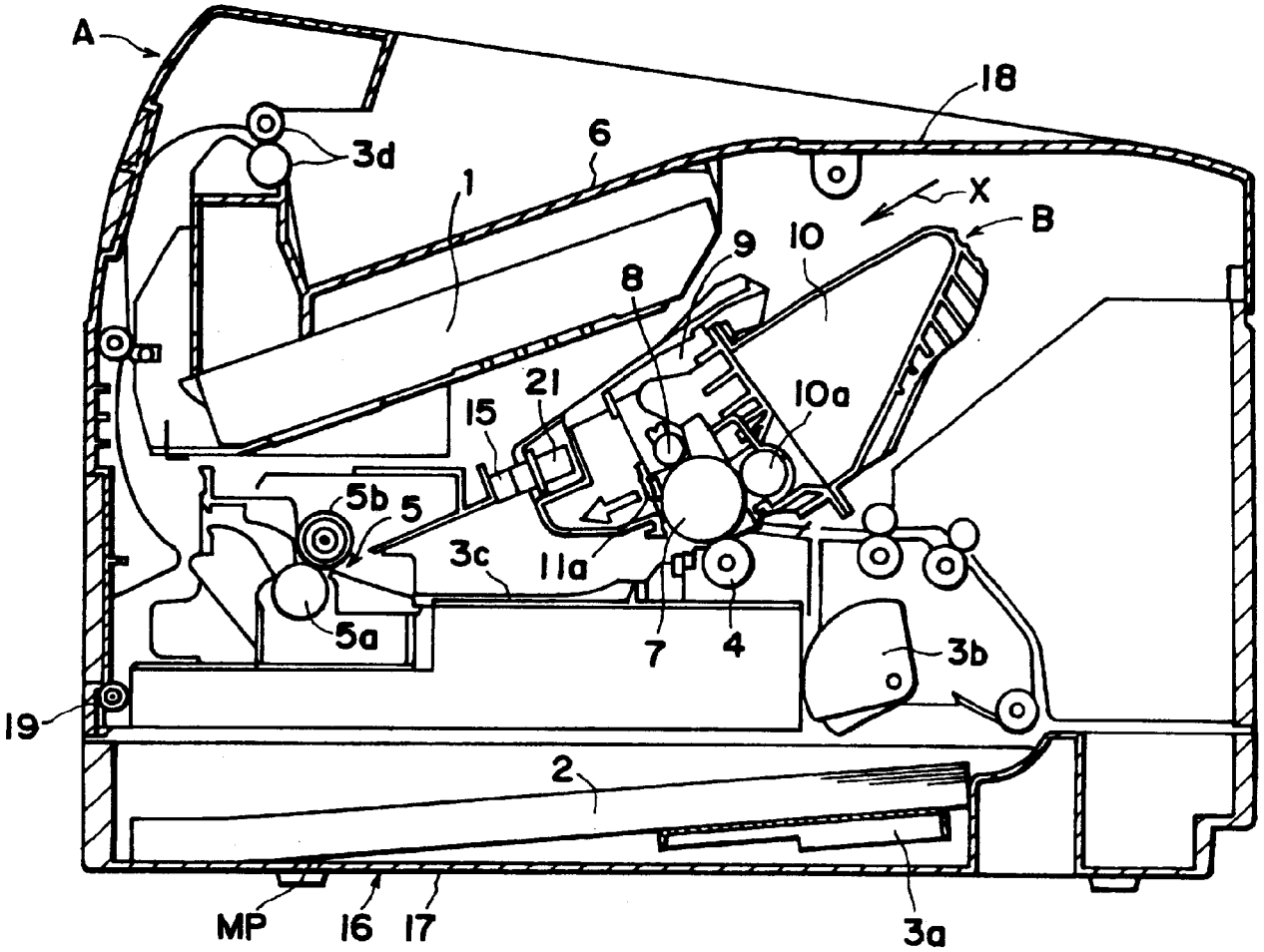
Figure 2:
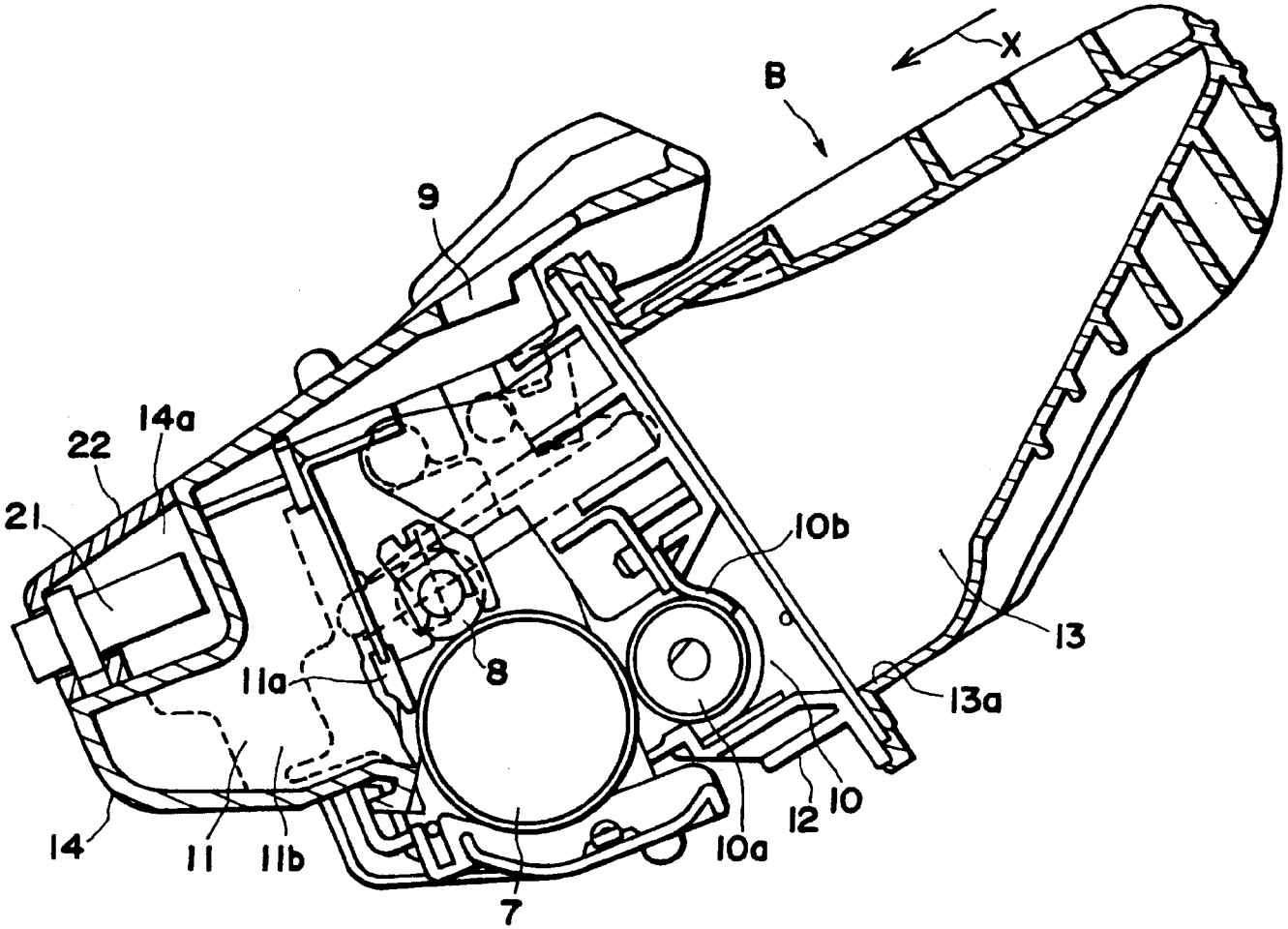
Figure 3:
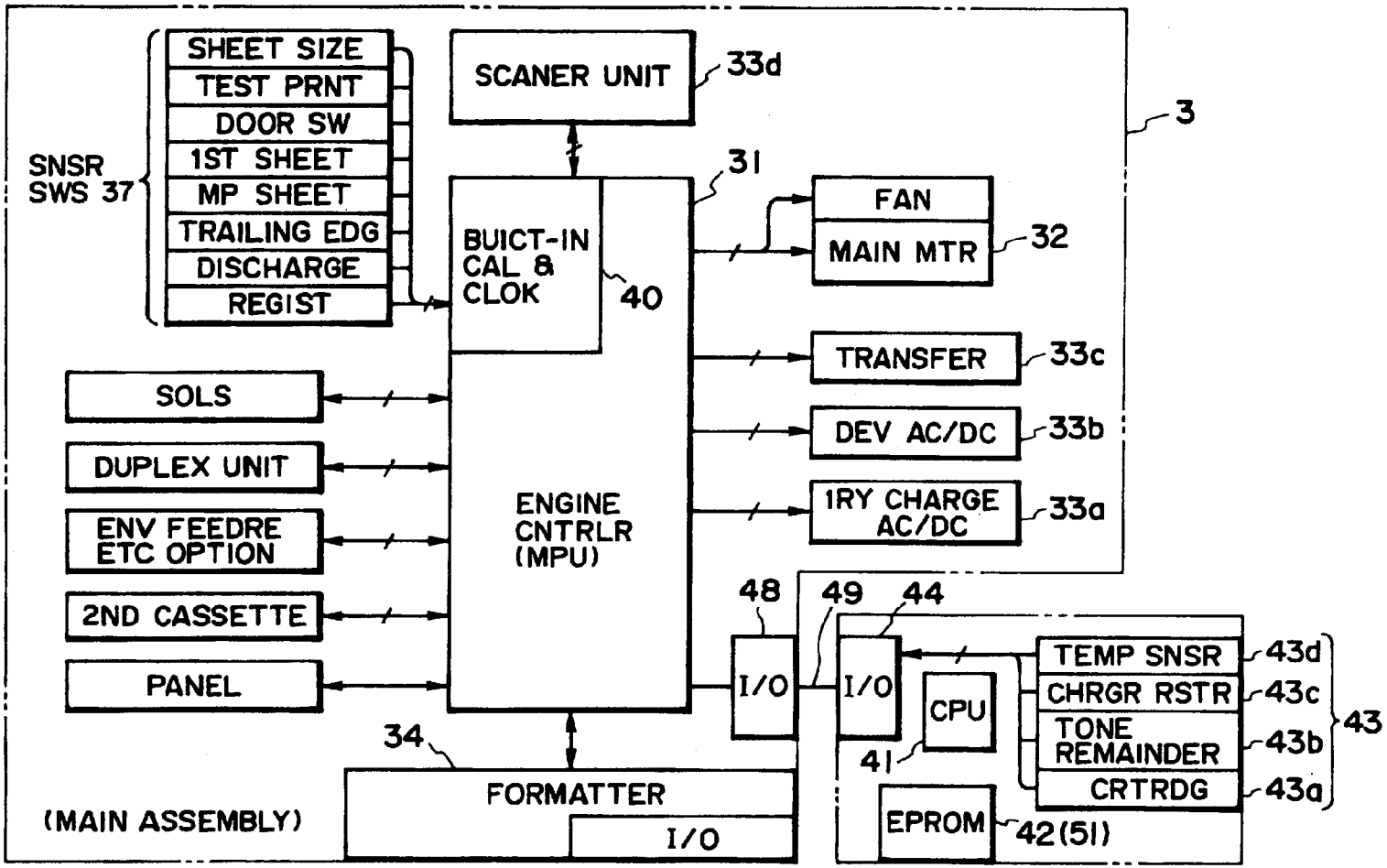
Figure 4:
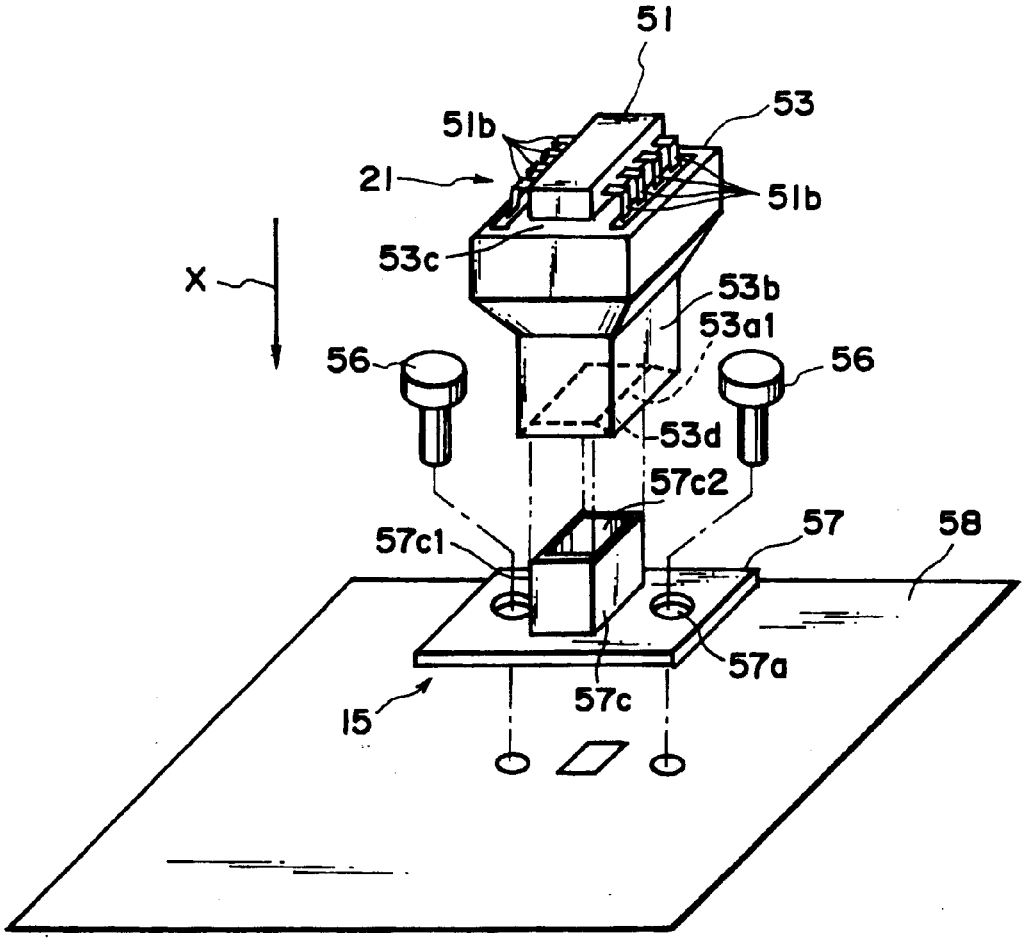
Figure 5:
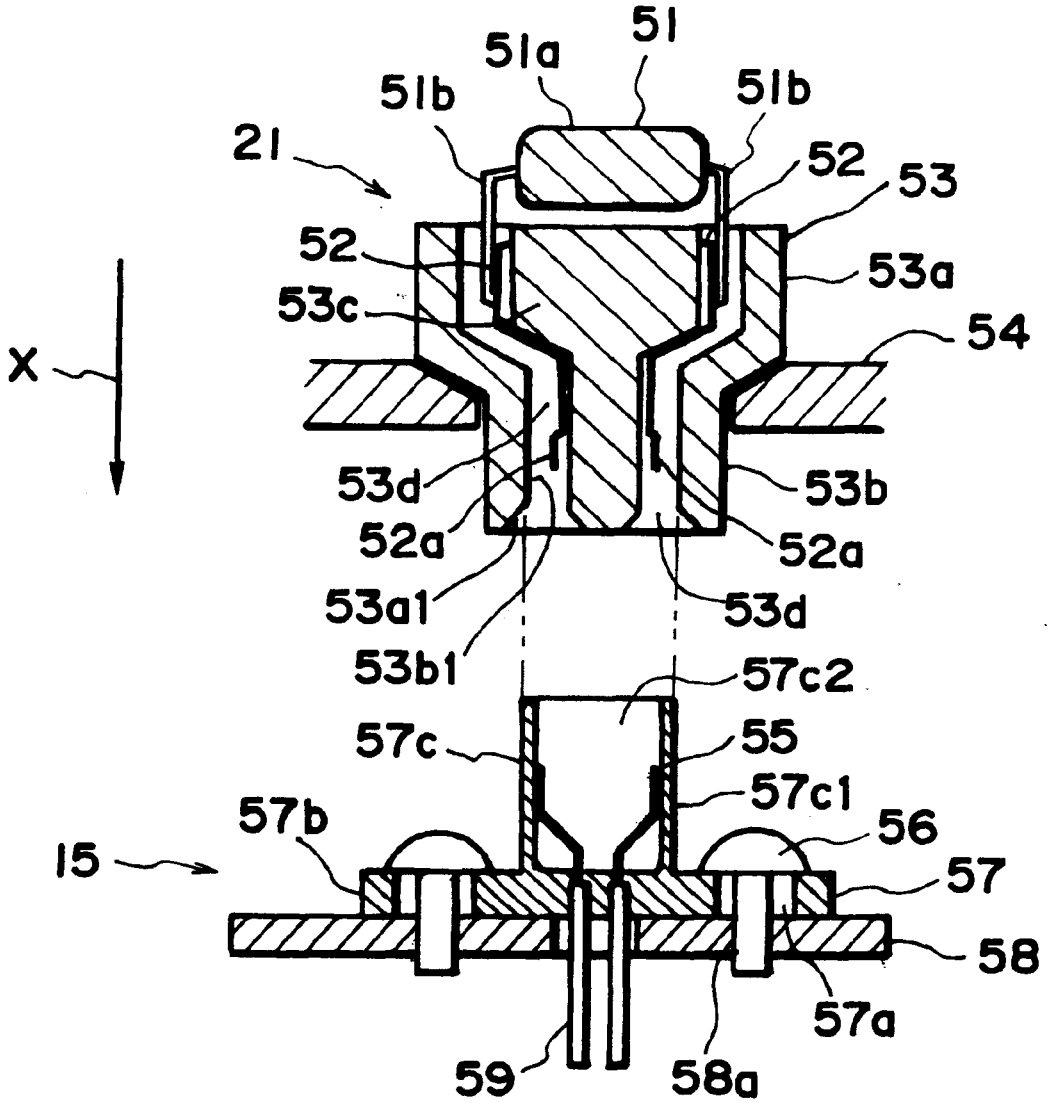
Figure 6:
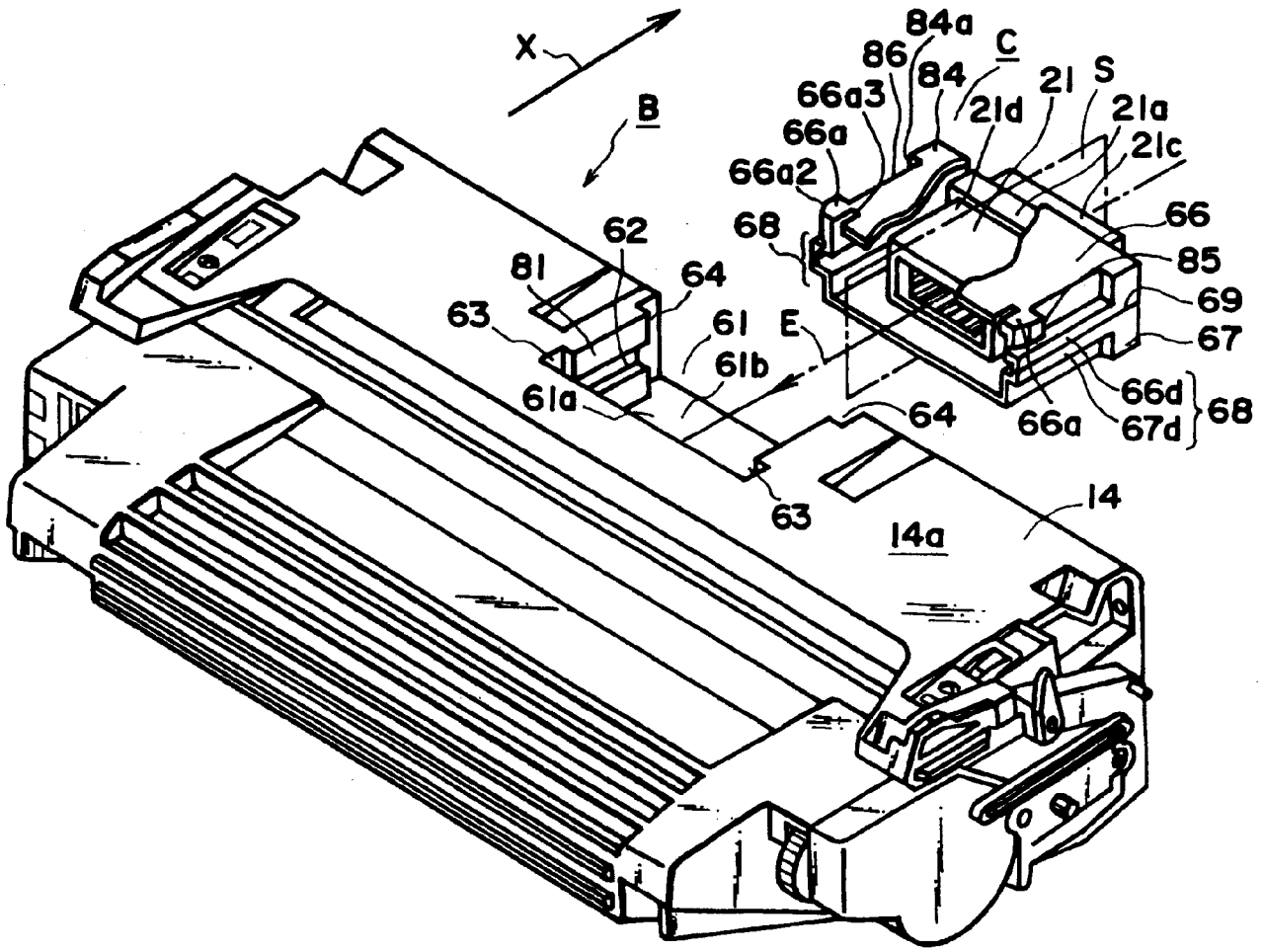
Figure 7A:
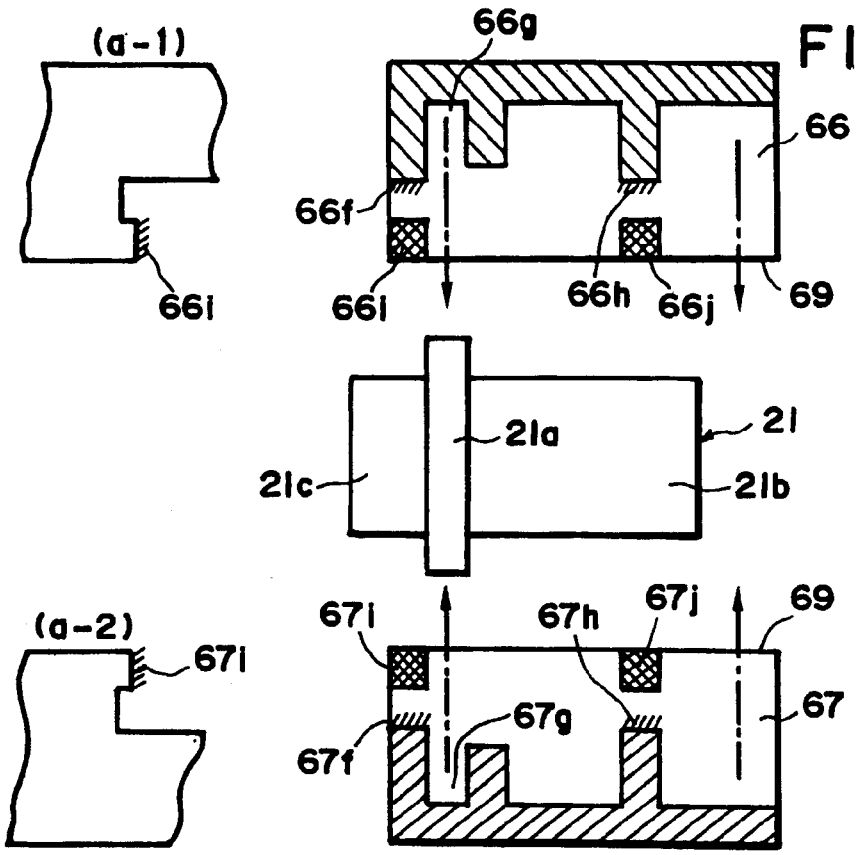
Figure 7B:
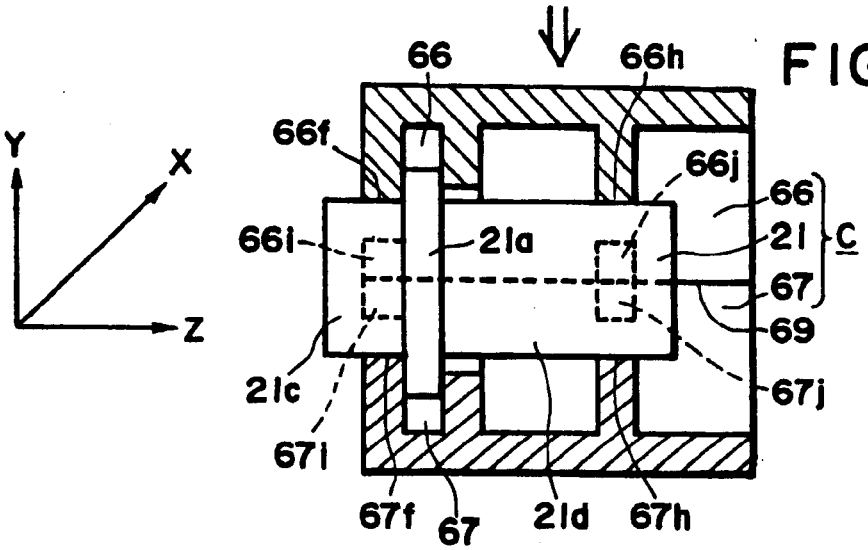
Figure 8A:
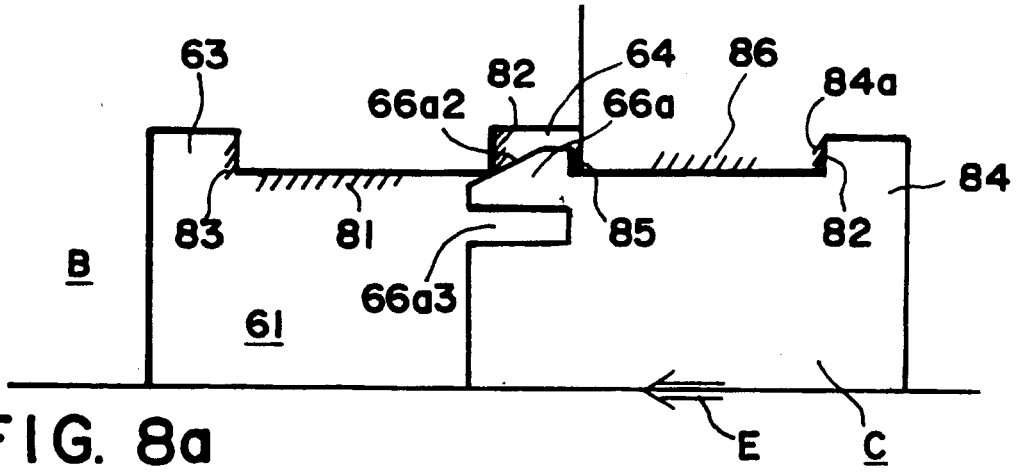
Figure 8B:
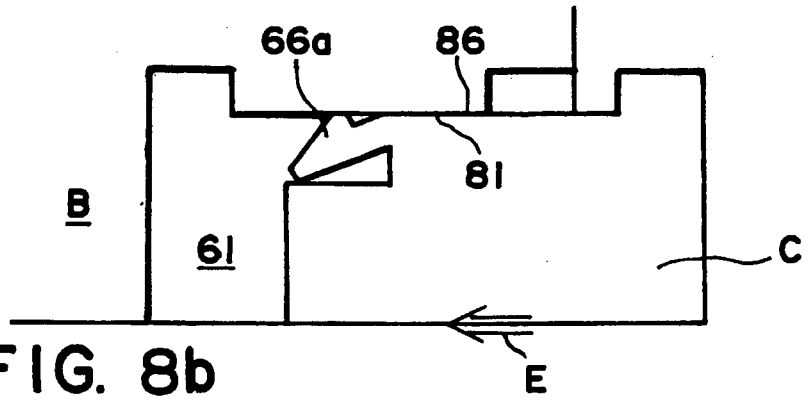
Figure 8C:
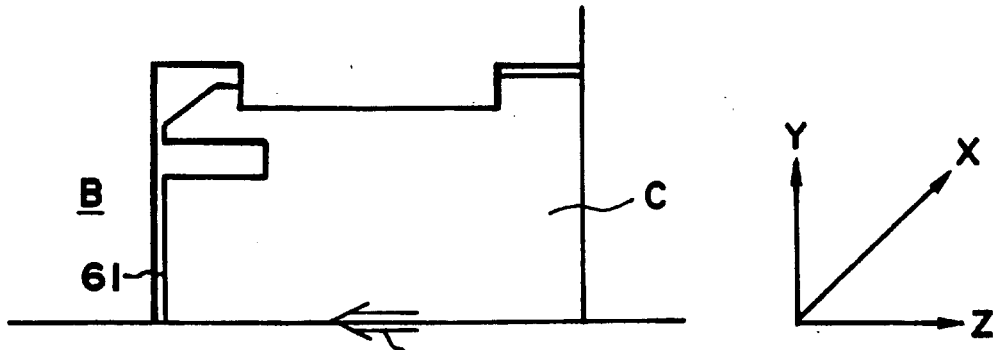
Figure 9:
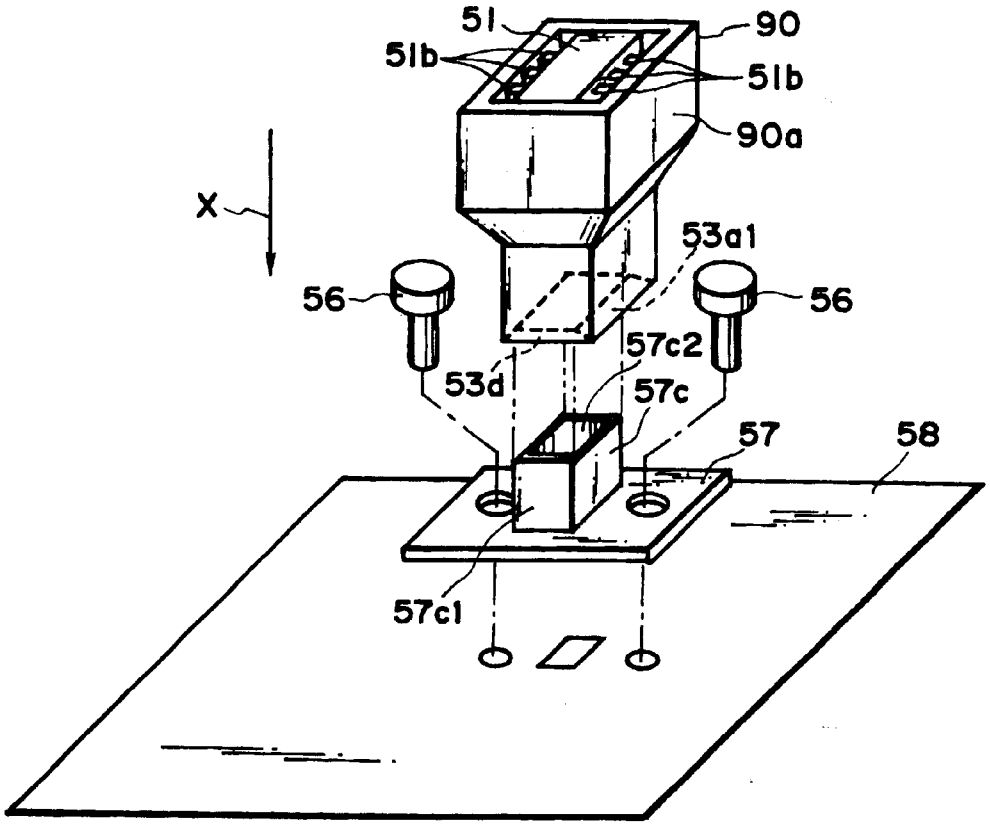
Figure 10:
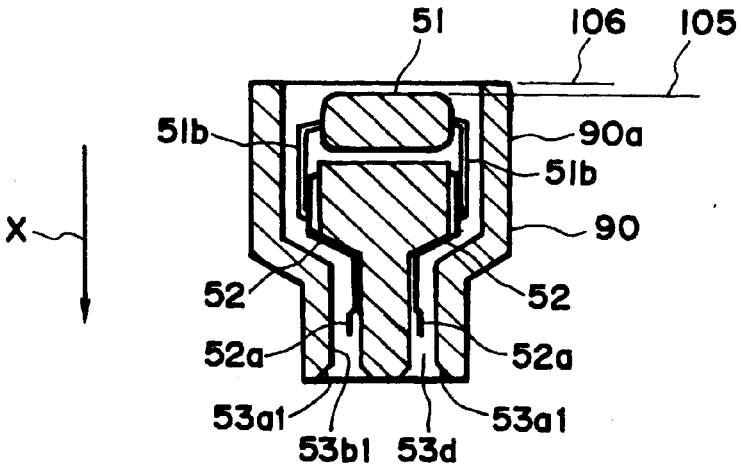
Figure 13:
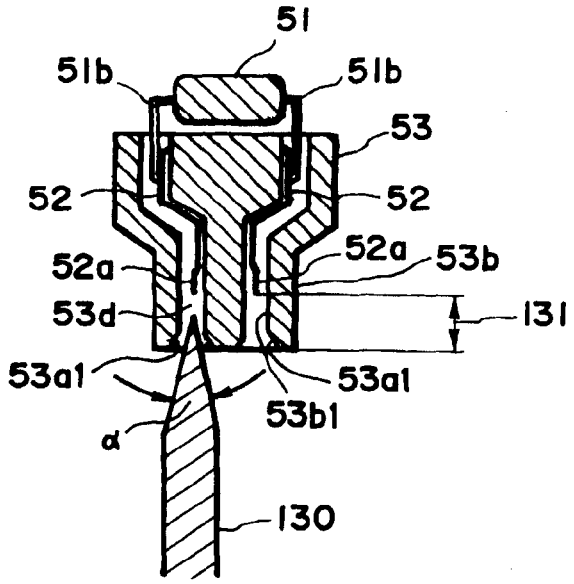
Figure 14:
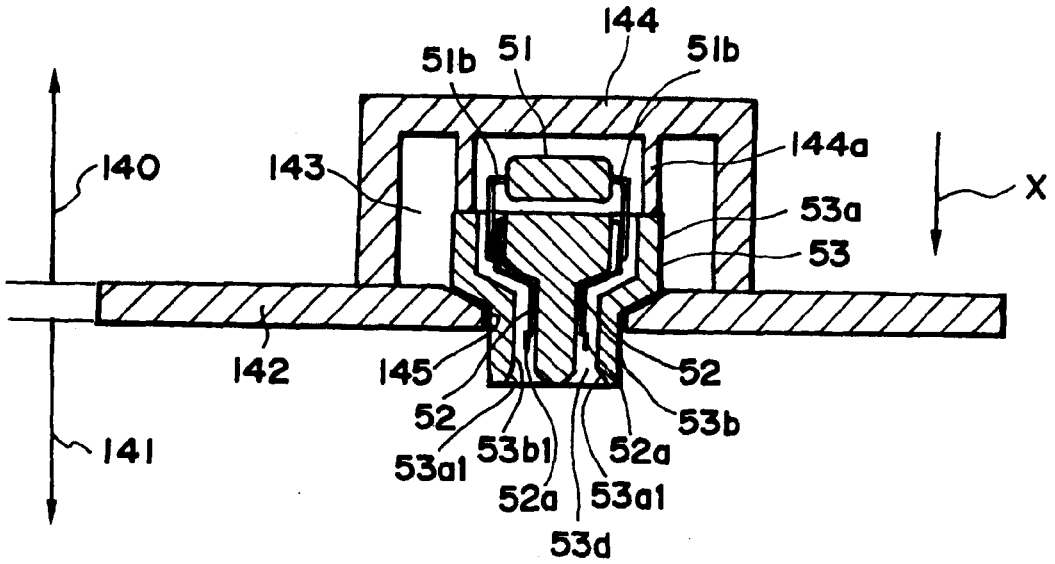
Figure 15A:
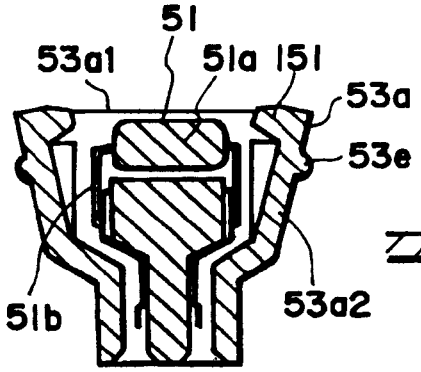
Figure 15B:
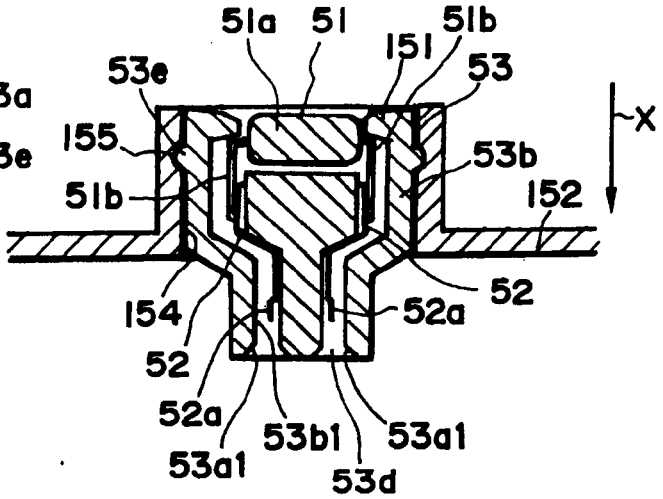
Figure 16:
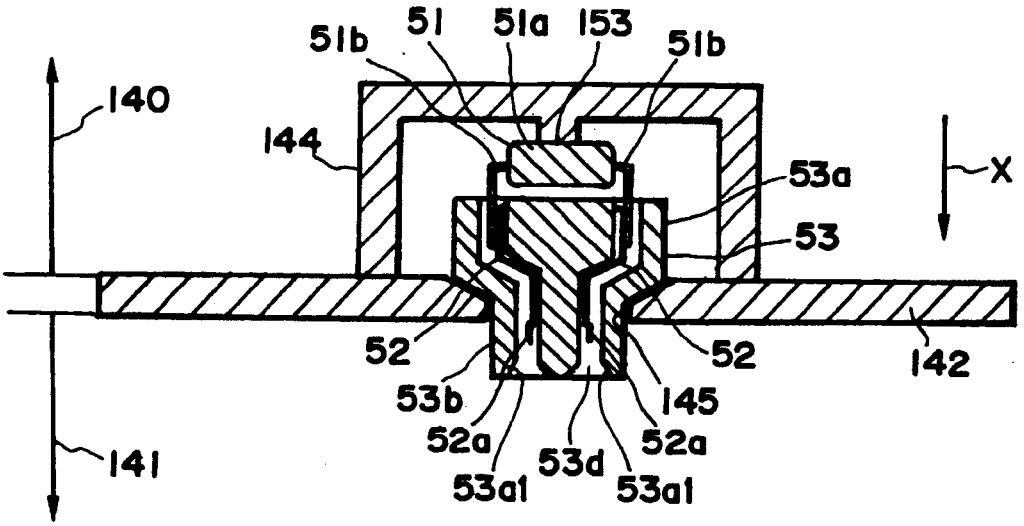
Figure 17A:
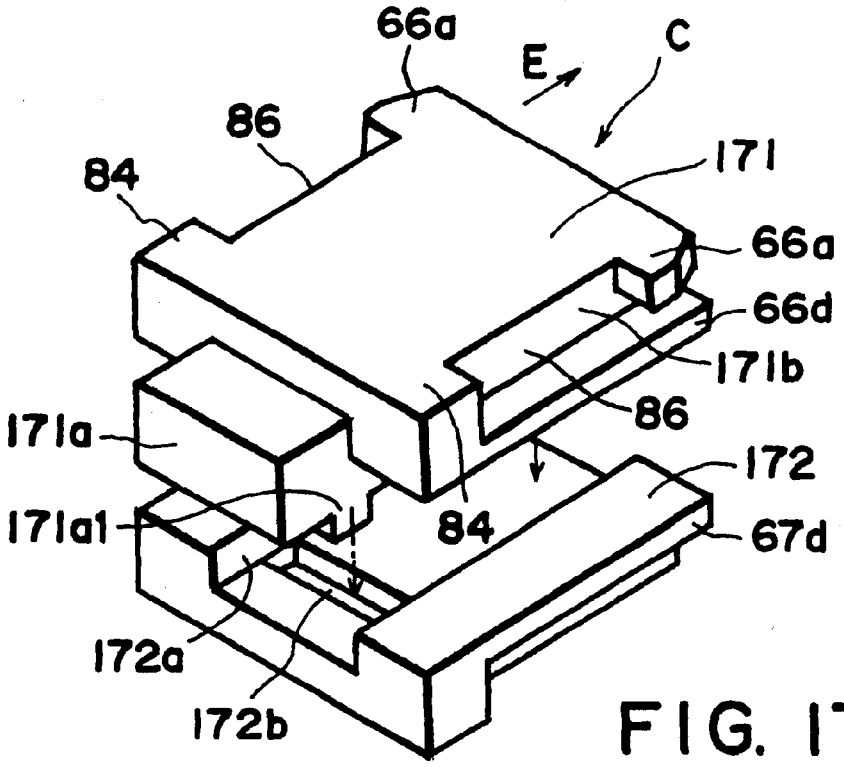
Figure 17B:
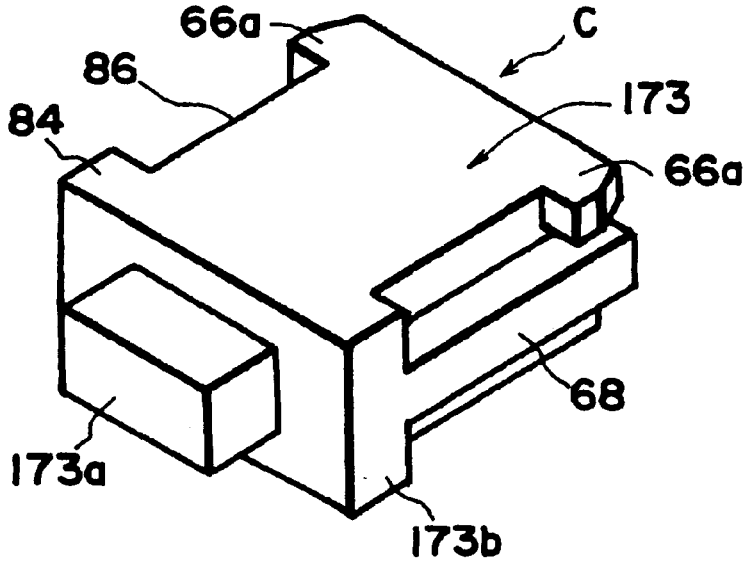

FIG. 16 is a longitudinal section of a connector and a unit comprising the connector, depicting a structural arrangement for preventing the accidental IC disengagement by the unit side.

FIGS. 17(*a*) and 17(*b*) are perspective views of a connector assembly, depicting a two piece structure and a one piece structure, respectively.

DESCRIPTION OF THE PREFERRED EMBODIMENTS

Hereinafter, preferred embodiments of the present invention will be described in detail with reference to the drawings.

Embodiment 1

FIG. 1 is a sectional view of an image forming apparatus in which a process cartridge in accordance with the present invention is disposed. In this embodiment, the image forming apparatus in the form of a laser beam printer. FIG. 2 is a sectional view of the process cartridge disposed in the image forming apparatus illustrated in FIG. 1.

Referring to FIG. 1, the image forming apparatus A in this embodiment contains a process cartridge B comprising a photosensitive drum, that is, an electrophotographic photosensitive member in the form of a drum. An optical image reflecting image data is projected from an optical system 1 onto this photosensitive drum 7 to form an electrostatic latent image. The electrostatic latent image is developed into a visible image, that is, a toner image, by the developing means 10 of the process cartridge, and the developer contained in the developing means. In synchronism with the toner image formation, a recording medium 2 is delivered by a conveying means 3*a* and 3*b*. The toner image, having been formed on the photosensitive drum 7, is transferred onto the recording medium 2 by a transferring means 4, and then, the recording medium 2 is conveyed to a fixing means 5 by a conveying means 3*c*. After the transferred toner image is fixed to the recording medium 2 by the pressure roller 5*a* and fixing roller 5*b* of the fixing means 5, the recording medium 2 is discharged into a delivery portion 6 by a conveying means 3*d*.

The main assembly 16 of the image forming apparatus A comprises a bottom frame 17 and a top frame 18. The bottom and top frames 17 and 18 are connected with a hinge 19 so that the top frame 18 can be opened or closed relative to the bottom frame 17. The bottom frame 17 holds a paper magazine MP in which the recording medium 2 is loaded, the major portion of the conveying means 3*a*, 3*b* and 3d, the transferring means 4, the fixing means 5, and the like. The top frame 18 holds the optical system 1, and the rest of the conveying means.

In order to install the process cartridge B, first, the top frame 18 is rotated about the hinge 19 in the counterclockwise direction in FIG. 1 to create an opening between the top and bottom frames 17 and 18. Then, the process cartridge B is inserted through the opening, diagonally downward from the top right to the bottom left along the guide portion (unillustrated) provided in the bottom frame 17. As the process cartridge B is inserted, its position is fixed by an unillustrated positioning member, and at the same time, an I/O connector 15 provided in the bottom frame 17 is engaged with the I/O connector 21 of the process cartridge B.

In order to remove the process cartridge B from the image forming apparatus main assembly 16, the top frame 18 is opened, and the process cartridge B is pulled out in the diagonally upward direction from the bottom left to the top right of FIG. 1. During this removal, the I/O connectors 15 and 21 are automatically disengaged from each other.

Referring to FIG. 2, the process cartridge B in this embodiment comprises the aforementioned photosensitive member 7, and processing means, which act on the photosensitive member 7. The processing means includes a charging means 8 (for example, charge roller illustrated in FIG. 2) for charging the surface of the photosensitive drum 7, an exposing portion 9 through which an optical image is projected onto the charged surface of the photosensitive member 7 from the optical system 1, the aforementioned developing means 10 for developing the latent image formed on the photosensitive member 7, and a cleaning means 11 comprising a cleaning blade 11*a* and a toner collector 11*b*. The developing means 10 comprises a developer container 13, a development roller 10*a*, and a toner regulator blade 10*b*. The developer container 13 holds the toner. The development roller 10*a* is disposed in a development frame 12 in a manner to adjoin the photosensitive drum 7. The toner regulator blade 10*b* is placed in contact with the development roller 10*a*. The development frame 12 is united with the developer container 13, wherein their internal spaces are connected through an opening 13*a*.

After the toner image is transferred onto the recording medium 2 by the transferring means 4 (transfer roller), the photosensitive drum 7 of the process cartridge B is cleaned by the cleaning blade 11*a* to remove the toner remaining on the photosensitive drum 7, becoming prepared for the following image formation.

FIG. 3 is a block diagram for controlling the electrophotographic image forming apparatus and process cartridge in this embodiment. In this diagram, only the diagram portion related to the actual control system is depicted, without depicting the electric power source and the like. First, the basic control of the image forming apparatus will be described.

In FIG. 3, the portion of the electronic device, which is in the image forming apparatus main assembly 16, is surrounded with a double-dot chain line 30. An engine controller (MPU) 31 has a computing function, a memory function, an internal clock function, and a function to input/output signals. Normally, it is a device in the form of an ASiC or the like. To this engine controller 31, a main motor control block 32, a primary charge voltage/current control block 33*a*, a development bias voltage control block 33*b*, a transfer voltage control block 33*c*, and a scanner unit control block 33*d* are connected to control each unit by the programs in the engine controller 31.

Also within the image forming apparatus main assembly 16, various sensor switches constituting a sensor switch group 37 are disposed at appropriate locations, and the output of the sensor switch group 37 is transmitted to the engine controller 31 so that the operational conditions of the various portions of the apparatus can be monitored by the engine controller 31 throughout a printing operation sequence. Also, a formatter 34 is connected to the engine controller 31. The formatter 34 is a device which has a function for storing printing formats, a function for developing the printing formats into image data, and also functions as an input/output port. In other words, it functions as a pre-processor for the engine controller 31.

In FIG. 3, the area surrounded by a double-dot chain line, which is designated by a reference code C', is the portion which is mounted in the process cartridge B. At the same time as the process cartridge B is installed into the image forming apparatus main assembly 16, the engine controller 31 of the image forming apparatus main assembly 16 and the circuit portion C' mounted in the process cartridge B are electrically connected through the I/O connector 49. The engine controller 31 is connected to the input/output device (I/O port) 44 of the process cartridge B through the input/output port of the circuit portion of the image forming apparatus main assembly 16 and the input/output connector 49, so that the engine controller 31 is allowed to communicate with the computing device of the process cartridge B, and also to refer to the data from the sensor group 43 of the process cartridge B.

Next, the functions of the portion C' mounted on the process cartridge side will be described. The sensor group 43 on the process cartridge side comprises a cartridge sensor 43*a* based on a limit switch or the like, a toner remainder detection sensor 43*a* based on capacitance detection or light quantity detection, a charger resistance sensor 43*c* for detecting condensation and short circuit by detecting the electrical resistance of a charging means 8, a temperature sensor 34*d* for detecting the temperature increase of the process cartridge B, and the like. These sensors are connected to the input/output port 44 of the process cartridge B.

Also, a memory device 42 is mounted in the process cartridge B. In this embodiment, a rewritable EP ROM is employed as the memory device 42 (storing member). Also in this embodiment, a serial port is employed as an input/output port for exchanging and output signals between the aforementioned engines controller 31 of the image forming apparatus main assembly 16 and the computing device 41 on the process cartridge side, to reduce the number of contact points so that contact failure or the like can be prevented.

An example of how the control circuit portion C' is mounted in the process cartridge B is depicted in FIG. 2. This portion C' of the control circuit may be disposed anywhere in the process cartridge B. In this embodiment, however, it is disposed in a cleaning frame 14 which plays a role of a positional reference for fixing the position of the process cartridge B in the image forming apparatus main assembly 16. More specifically, it is attached to the end portion of the cleaning frame 14, that is, a point farthest from the noise source such as the charge unit, the transfer unit, and the like. Also, more specifically, the cleaning frame 14 is provided with a recess 14*a*, as seen from outside, and an I/O connector 21 is disposed under a cover 22 which is fixed to the cleaning frame 14 in a manner to cover the recess 14a. As shown in FIG. 2, the cleaning frame 14 holds the photosensitive drum 7, the charging means 8, and the cleaning means 11. The development frame holds the developing means 10, and is connected to the cleaning frame 14 in a manner to allow them to pivot relative to each other.

Referring again to FIG. 1 in which a process cartridge comprising the aforementioned control circuit portion is in the image forming apparatus main assembly 16, the I/O connector portion 21 of the process cartridge B in the image forming apparatus main assembly 16 is connected to the I/O connector portion 15 of the image forming apparatus main assembly 16, forming the I/O connector 49 illustrated in FIG. 3. These connector portion 21 and 15 are structured in such a manner that they are automatically engaged with each other as the process cartridge B is inserted into the image forming apparatus main assembly 16.

In this embodiment, the I/O connector portions 15 and 21, which constitute the I/O connector 49, is described as components comprising the contacts, for connecting the IC and the engine controller 31. However, they may comprise contacts for connecting the sensor group 42 on the process cartridge side to the engine controller 31, in addition to the contacts for connecting the IC and the engine controller 31, or they may comprise only the contact for connecting the IC and the engine controller 31.

Referring to FIG. 4 which depicts the aforementioned I/O connector portions 15 and 21, the connectors employed in this embodiment will be described. FIG. 4 is a perspective view of a connector, and depicts the structure thereof. An IC (integrated circuit) 51 (storing member) is mounted in the connector main structure 53 on the process cartridge side. The connector main structure 53 is a structural component which integrally comprises an IC socket and the connector. A connector main structure 57 on the image forming apparatus main assembly side, which is the counterpart of the connector main structure 53 on the process cartridge side, is also a structural component, and is mounted on the connector mount 58 with the use of small screws 56. The small screw 56 is put through hole 57*a* of the connector main structure 57, and is screwed into the female screw 58*a* of the connector mounts 58 of the image forming apparatus main assembly 16.

FIG. 5 is a sectional view of the connector illustrated in FIG. 4.

In this embodiment, the connector main structure 53 on the process cartridge side contains a contact 52 which is placed in contact with the IC 51. This connector main structure 53 on the process cartridge side is fixed to the process cartridge B. As for the connector main structure 58 on the image forming apparatus main assembly side, which is the counterpart of the connector main structure 53 on the process cartridge side, is fixed to the connector mount 58, that is, a part of the image forming apparatus main assembly 16, with the use of the small screw 56. However, since the connector main structure 53 attached to the process cartridge B side is firmly fixed to the process cartridge B, it is necessary to make it sure that imperfect alignment between the process cartridge B and the image forming apparatus main assembly 16 does not generate stress in the connector main structures 53 and 57. Therefore, the connector main structure 57 on the image forming apparatus main assembly side must be floatingly attached to the connector mount 58 of the image forming apparatus main assembly 16. FIG. 5, a sectional view, depicts a connector designed in consideration of such a requirement. More specifically, the diameter of the hole 57*a* of the connector main structure 57 on the image forming apparatus main assembly side is rendered slightly larger than that of the small screw 56 to create a gap large enough to compensate for the aforementioned misalignment. Therefore, even though the small screw 56 is firmly screwed into the female screw 58*a* of the connector attachment portion 58 of the image forming apparatus main assembly 16, the connector main structure 57 on the image forming apparatus main assembly side is floatingly attached to the connector mount 58 of the image forming apparatus main assembly 16.

Next, the structures of the I/O connectors 15 and 21 will be described.

The connector main structure 53 on the process cartridge side is formed of synthetic resin. It is hollow, and has a substantially square cross-section. Its base side half (top side in the drawings) is larger than its engagement portion side (bottom side in the drawings). In the internal space of the connector main structure on the process cartridge side is occupied by the IC mount 53*c*. The IC mount 53*c* is integrally formed with the connector main structure 53, or is first formed independently from the connector main structure 53, and then attached to the external wall portion 53*a* and engagement portion wall 53*b* of the connector main structure 53. The longitudinal section of the IC mount 53 is in the form of a character T as shown in FIG. 5. The surface of the IC mount 53*c* and the base side external wall 53*a*, and the surface of the IC mount 53*c* and the engagement portion side external wall 53*b*, form a continuous terminal mounting space 53*d* which opens outward at the top and bottom. The contact 52 is disposed in the IC mounting space, substantially in contact with the IC mount 53*c* except for a contact portion 52*a*, the bottom end portion. More specifically, in order to assure that the contact 52 is reliably placed in contact with the contact 53 on the image forming apparatus main assembly side, the bottom end of the contact 52 is bent outward to form the contact portion 52*a*. As for the IC 51, the main structure 51*a* of a chip is disposed directly above the IC mount 53*c*, with the provision of a predetermined gap. The lead wires 51*b* of the IC 51 are inserted from above into the electrode mounting space 53*d*, and made to directly press on the contact 52. The IC 51 is electrically connected to each of the contacts 52, by one of the lead wires 51*b*.

The connector main structure 57 on the image forming apparatus main assembly side integrally comprises a mount portion 57*b* provided with the aforementioned hole 57*a* for the small screw, and an engagement portion 57*c* in the form of a rectangular parallelepiped. Wiring 59 is connected to a contact 55 fixed to the contact main structure 57 on the image forming apparatus main assembly side. The contact 55 is in contact with the internal surface of the engagement portion 57*c*. A reference symbol 57*c*2 designates a cavity provided in the engagement portion 57*c*. As the process cartridge B is inserted into the image forming apparatus main assembly 16, the internal periphery 53*b*1 of the engagement portion 53*b* of the connector main structure 53 on the process cartridge side fits against the external periphery 57*c*1 of the engagement portion 57*c* of the connector main structure 57 on the image forming apparatus main assembly side, and the contact portion 52*a* of the contact 52 on the process cartridge side is pressed against the contact 55 on the image forming apparatus main assembly side, being elastically bent inward, and establishes an electrical connection. In other words, when the connector main structure 53 on the process cartridge side is electrically connected to the connector main structure 57 on the image forming apparatus main assembly side, the engagement portion 57*c* of the image forming apparatus main assembly side fits into the space 53*d* of the connector main structure 53 on the process cartridge side. As a result, the contact 52 of the connector main structure 53 fits into the aforementioned cavity 57*c*2, and comes in contact with the contact 55 disposed in the cavity 57*c*2. The IC 51 is behind the contact 52 relative to the direction (direction of an arrow mark X) in which the connector main structure 53 is fitted with the connector main structure 57. The bottom end of the external wall 53*a*of the connector main structure 53, which first comes in contact with the connector main structure 57 when the two are connected, is provided with a tapered portion 53*a*1 by which the connector main structure 53 is guided.

In the drawing, the connector main structure 53 on the process cartridge side, and the mount portion 54 for the connector main structure 53 are schematically drawn to show the direct attachment of the former to the latter. However, the manner in which the I/O connector portion 21 is attached to the process cartridge B is not limited to the direct attachment depicted in the drawing. The connector mount portion 54 on the process cartridge side may be, for example, a part of the cover 22 attached to the cleaning frame 14 of the process cartridge B shown in FIG. 2.

Next an example of how to attach the connector on the process cartridge side to the process cartridge with the use of a support member will be described.

FIG. 6 is a perspective drawing which depicts a method for attaching a connector supported by a support member, to a process cartridge.

FIG. 6 depicts a specific example of how a connector is attached to a process cartridge in this embodiment. In the drawing, the left and right sides of the I/O connector portion 21 and connector support members 66 and 67 are symmetrical relative to a symmetry plane S (which will be described later).

Also referring to FIG. 6, the cleaning frame 14 of the process cartridge B is provided with a connector mounting space 61. Each of the opposing lateral surfaces 81 of the space 61 is provide with a guide groove 62 (one of the lateral walls 81 and one of the guide groove are not illustrated). This guide groove 62 extends in the same direction as the inserting direction of the process cartridge B indicated by an arrow mark E. Also, each lateral surface 81 is provided with a vertical groove 63, which is located at the deepest corner 61*a* of the space 61, and extends from the top surface 14*a* of the cleaning frame 14 to the bottom surface 61*b* of the space 61 in the direction perpendicular to the guide groove 62. Further, each lateral surface 81 is provided with a rabbet-like portion 64, which also vertically extends from the top surface 14*a* of the cleaning frame 14 to the bottom surface 61*b* of the space 61 in the direction perpendicular to the guide groove 62.

On the other hand, the I/O connector portion 21 on the process cartridge side is supported by two support members composed of resin material, that is, a top support member 66 and a bottom support member 67 which are separable from each other at a separation plane 69; the I/O connector portion 21 and the connector support member 66 and 67 form a connector unit C. Both external lateral surfaces of the connector unit C are provided with a straight tongue-like portion 68 which extends along the separation plane 69 of the top and bottom connector support members 66 and 67. Also, the left and right ends of the top connector support member 66 are provided with a locking claw 66*a*.

Next, the configuration of the locking claw 66*a* will be described. The left and right locking claws 66*a* are symmetrical relative to the vertical plane S which includes the line coinciding with the stem line of the arrow mark E which indicates the inserting direction of the top connector support member 66. The outward front corner of the claw 66*a* forms a guide portion 66*a*2, which first comes in contact with the entrance side of the lateral surface 81 of the space 61 when the connector support member 66 is inserted into the space 61 in the direction of the arrow mark E. Further, the claw 66*a* is provided with a slit 66*a*3, which is cut into the claw 66*a* from the inserting end of the claw 66*a*. The lateral surface 86 of the top connector support member 66, which fits against the lateral surface 81 of the space 61, is provided with a stopper 84, which is located at the trailing end side relative to the inserting direction of the top connector support member 66.

The width of the vertical groove 63 located at the corner of the space 61 of the process cartridge B is greater than the length of the claw 66*a* of the connector support member 66 in the inserting direction of the connector support member 66. The distance between the surface of the claw 66*a* on the trailing end side and the bumping surface 84*a* of the stopper 84 equals to the sum of the length of the lateral surface 81 in the inserting direction of the connector support member 66, and the engagement margin.

Further, the claw 66*a* is separated by the slit from the top half portion 66*d* of the tongue-like portion 68, which belongs to the top connector support member 66.

Referring to FIG. 7(*a*) this figure is a sectional view of the I/O connector portion 21 on the process cartridge side, and the top and bottom connector support members 66 and 67, in the disassembled state. FIGS. 7(*a*-1) and 7(*a*-2) illustrate the trailing end thereof relative to the inserting direction of the connector support members 66 and 67. The sectional view of the connector support members 66 and 67 in the assembled state is given as FIG. 7(*b*). In FIG. 7, the details of the external periphery of the connector support members 66 and 67 are omitted to simplify the drawing.

The I/O connector portion 21 on the process cartridge side comprises central structure portions 21*c* and 21*d*, and a flange portion 21*a* which fits around the central structure, between the portion 21*c* and 21*d*. The central structure portions 21*c* and 21*d* are substantially square in section area. The flange portion 21*a* comprises four pieces, forming a complete square, or comprises at least two pieces which are attached to the top and bottom surfaces, respectively of the central structure.

The inward facing surfaces of the connector support members 66 and 67 are provided with grooves 66*g* and 67*g*, respectively, in which the top and bottom pieces of the flange portion 21*a* of the I/O connector portion 21 on the process cartridge side are fitted. Also, they are provided with projections 66*h* and 67*h* which cramp the central structure portions 21*d* from above and below, respectively. The rear end portions of the connector support members 66 and 67, relative to the direction in which the connector unit C is inserted into the space 61 of the process cartridge B, forms projections 66*f* and 67*f* which cramp the central structure portion 21*c* from above and below, respectively. These projections 66*f* and 67*f* double as the side walls of the grooves 66*g* and 67*g*. The inward facing surface of the left lateral wall of the connector support members 66, and the inward facing surface of the right lateral wall of the connector support member 66, are provided with projections 66*i* and 66*j*. Also, the inward facing surface of the left lateral wall of the connector support member 67, and the inward facing surface of the right lateral wall of the connector support member 67, are provided with the projection 67*i* and 67*j*, respectively. The projections 66*i* and 67*i*, and the projection 66*j* and 67*j*, cramp the central structure portions 21*c* and 21*d*, respectively, from the horizontal direction.

FIG. 7(*b*) is a sectional view of the connector unit C illustrated in FIG. 6, at the plane S (this plane S is perpendicular to the separation plane 69, and divides the connector unit C into symmetrical left and right halves).

Next, the positional fixation of the I/O connector portion 21 on the process cartridge side in the connector unit C will be described with reference to directions X, Y and Z shown in FIG. 7 (X direction is perpendicular to the surface of FIG. 7; Z direction is the direction in which the connector unit C is inserted or removed, and coincide with the arrow E direction in FIG. 6).

First, regarding the Z direction, the I/O connector portion 21 is fixed in the connector unit C as the flange portion 21*a* of the I/O connector portion 21 is cramped into the grooves 66*g* and 67*g* of the connector support members 66 and 67, respectively. As for the Y direction, the I/O connector portion 21 is fixed in the connector unit C as the central structure portion 21*c* of the I/O connector portion 21, that is, the central structure portion located on the rear side of the flange portion 21*a*, is cramped from above and below by the projections 66*f* and 67*f* which double as one of the walls of the grooves 66*g* and 67*g* of the connector support members 66 and 67, respectively. Further, the central structure portion 21*d*, that is, the central structure portion located on the front side of the flange portion 21*a*, is cramped from above and below by the protection 66*h* and 67*h*, respectively, to prevent the rotational movement of the I/O connector portion 21 about the axis X. As for the X direction, the I/O connector portion 21 is positionally fixed as the lateral surfaces of the central structure portion 21*c* of the I/O connector portion 21 are cramped by a pair of projections 66*i* and a pair of projections 67*i* (projections on the opposing side are not illustrated) provided on the corresponding internal lateral surfaces of the connector support members 66 and 67. Further, a pair of protections 66*j* and a pair of projections 67*j* (projections on the opposing side are not illustrated) cramp on the lateral surfaces of the central structure portion 21*d* of the I/O connector portion 21 to prevent the rotational movement of the I/O connector portion 21 about the axis Y. As these components are assembled as described above, the top and bottom connector support members 66 and 67 join with each other at the separation plane 69. The connector support members 66 and 67 may be glued together by coating in advance the connector support members 66 and 67 with adhesive, on the surfaces facing the separation plane 69. However, even without gluing, the connector support members 66 and 67 do not separated from each other once the connector support members 66 and 67 are inserted into the space 61 of the process cartridge B after the I/O connector portion 21 is disposed in the connector support members 66 and 67.

With the employment of the structure illustrated in FIG. 7, it is possible to precisely and solidly fix the I/O connector portions 21 on the process cartridge side in the connector unit C.

Next, a method for attaching the aforementioned connector unit C to the process cartridge B will be described.

The connector unit C is inserted in a straight line into the space 61 of the process cartridge B, in the direction of the arrow mark E, with its tongue-like portions being fitted in the corresponding guide grooves 62 of the process cartridge B. This tongue-like portion is constituted of the portions 66*d* and 67*d* of the connector support members 66 and 67, respectively, that is, the straight portions which have an L-shaped cross-section and extend along the separation plane 69.

FIG. 8 is a schematic drawing for describing how the connector unit C is inserted into the connector mounting space 61 of the process cartridge B. In the drawing, only one of the left and right sides of the connector unit C and space 61 is illustrated. The left and right sides of the connector unit C are symmetrical relative to the arrow mark E in FIG. 6.

FIG. 8(*a*) depicts the first stage of the insertion, in which the guide portion 66*a*2 of the locking claw 66*a* of the connector unit C comes in contact with the lateral surface 81 of the space 61 of the process cartridge B, on the front side as seen from the direction from which the connector unit C is inserted.

As pressure is applied to the connector unit C in the arrow mark E direction, the locking claw 66*a* is elastically bent toward the slit 66*a*, and as the connector unit C is inserted deeper, the lateral surfaces 86 of the connector unit 86 come in contact with the correspondent lateral surfaces 81 of the space 61 (FIG. 8(*b*)).

Then, as the connector unit C is further inserted to the final position, that is, the position where it is to be fixed, the hooking surface 85 reaches the vertical groove 63 on the process cartridge side, allowing the claw 66*a* to restore its original shape due to its resiliency. As a result, the lateral wall 83 of the vertical groove 63 flatly joins with the hooking surface 85 of the claw 66*a*, and the front surface 82 of the rabbet-like portion 64 also flatly joins with the bumping surface 84*a* of the stopper 84, whereby the connector unit C is positionally fixed in term of the Z direction. As for the Y direction, the guide grooves 62 of the process cartridge B engage with the tongue-like portions 68 of the connector unit C to positionally fix the connector unit C.

As for the X direction, the left and right lateral surfaces 81 of the space 61 of the process cartridge B engage with the lateral surfaces 86 of the connector unit C to fix the position of the connector unit C.

Therefore, the employment of the connector unit C and process cartridge B which have the above described structures makes it possible to precisely and solidly fix the connector unit C to the process cartridge B.

Embodiment 2

Next, the second embodiment of the present invention will be described. This embodiment is similar in structure to the first embodiment illustrated in FIG. 5, except that the base side of the exterior wall 53*a* of the connector main structure 53 on the process cartridge side is extended upward. Therefore, the description of the first embodiment may be quoted as the description of this embodiment, except for the difference which will be described next.

Referring to FIG. 9, in the case of the connector main structure 90 on the process cartridge side, an IC 51 is surrounded with the base portion of the external wall 90*a* of the connector main structure 90 on the process cartridge side. With the provision of this structure, even if the connector main structure 90 on the process cartridge side is carelessly handled after the installation of the IC 51, the IC 50 can be prevented from being subjected to destructive force.

FIG. 10 is a sectional view of the connector main structure 90 on the process cartridge side in this embodiment. As shown in the drawing, it is structured in such a manner that the top end surface 106 of the external wall 90*a* comes above the top surface 105 of the IC 51.

FIG. 11 illustrates a modified version 111 of the connector main structure 90 in this embodiment. In this case of the connector main structure 111, the top edge of one or both of the opposing two sections of the external wall 111*a* is provided with a notch 112 in order to make it easier to remove the IC 51. This section of the external wall 111*a* is the section which faces the lateral surface 51*c* of the chip main structure 51*a* of the IC 51, that is, the surface from which the lead wires 51*b* are not extending. With the provision of this arrangement, when it is necessary to remove the IC 51, the IC 51 can be easily dislodged from the IC mount by placing a sharp object such as a screw driver tip below or against the IC 51 through this notch 112.

FIG. 12(*a*) is an external side view of the connector main structure 111 illustrated in FIG. 11, and FIG. 12(*b*) is a sectional view of the same. If the bottom surface of the IC 51 is flatly in contact with the IC mount 53*c*, it is difficult to insert an IC removal tool such a screw driver between the IC 51 and the IC mount 53*c*. Therefore, such projections 121 as those illustrated in FIG. 12(*b*) may be placed on the IC mount 53*c* of the connector main structure 111 on the process cartridge side to maintain a predetermined gap 122 between the IC 51 and the IC mount 53*c*, so that it becomes far easier to remove the IC 51.

Embodiment 3

Next, the third embodiment of the present invention will be described.

In this embodiment, a structure designed to protect an IC from external static electricity will be described. FIG. 13 illustrates a structure designed to secure a creepage distance between the connector terminal and an electrostatically charged external object; the structure secures a sufficient distance between the connector terminal and the end surface of the connector.

More specifically, the portion of the engagement portion 53*b* below the bottom end of the contact 52 is extended in order to render the distance 131 so large that even if an object such as a probe 130 having an edge angle (α) of 25 deg. is inserted into the electrode mounting space 53*d*, it is not allowed to come in contact with the contact 52.

Next, referring to FIG. 14, a method for attaching the connector main structure 53 in accordance with the present invention to a unit such as a process cartridge will be described. A wall member 144 is attached to the frame 142 of a unit such as the process cartridge B, the developing unit, or the like, to form a pouch-like space 143 within the frame 142. The frame 142 is provided with an opening 145 which connects the space 143 and the outside. The wall member 144 is provided with ribs 144*a*, the tip of which contacts the base portion of the external wall 53*a* of the connector main structure 53 on the process cartridge side. The connector main structure 53 is attached in such a manner that the surface on which the IC 51 is mounted faces inward, and the engagement portion 53*b* fits into the opening 145 of the unit to expose itself from the unit frame 142. In other words, this arrangement shields the IC 51 from the external elements. Therefore, the IC is better protected from electrostatic charge, and also the connector failure caused by the adhesion of foreign matter such as dust can be prevented.

Further, the arrangement described in the foregoing paragraph may be modified in such a manner that the wall member 144 is integrally formed with the unit frame 142, and the portion of the unit frame 142, which covers the pouch-like space, is formed as a separated cover member to be attached to the unit frame 142.

Embodiment 4

Next, the fourth embodiment will be described.

The fourth embodiment is an embodiment of an idea for preventing an IC mounted on the IC mount 53*c* from becoming disengaged from the IC mount 53*c* when a connector main structure is disposed in a unit. FIG. 15(*a*) is a sectional view of the connector of this embodiment before its placement in the unit, and FIG. 15(*b*) is a sectional view of the same after its placement in the unit.

Referring to FIG. 15(*b*), the base portion of the external wall 53*a* of the connector main structure on the process cartridge side is formed of an elastic synthetic resin material and is provided with a fixing member 151 which comes above the lead wires 51*b* extending from the lateral portion of the chip main structure 51*a* of an IC 51. The section 53*a*1 of the base portion of the external wall 53*a*, which is parallel to the surface of the FIG. 15, and the section 53*a*2 of the base portion of the external wall 53*a*, which is perpendicular to the surface of FIG. 15, are independent from each other, being separated at a plane which coincides with the internal surface of the section 53*a*1. The exterior surface of the section 53*a*2 of the base portion of the external wall 53*a* is provided with a projection 53*e*. This protection 53*e* fits in a recess 155 provided in the wall of the opening 154 of a unit 152.

Referring to FIG. 15(*a*), the section 53*a*2 is slanted outward so that the distance between the opposing two fixing members 151 becomes wider to better expose the IC mount 53*c*. Next, referring to FIG. 15(*b*), as the connector unit is inserted into the opening 154 of the unit 152, the outwardly slanted sections 53*a*2 are elastically bent toward each other, following the correspondent walls of the opening 154. Therefore, the fixing members 151 are made to close in toward each other in a manner to cramp the IC 51, preventing the IC 51 from becoming disengaged from the IC mount 53*c*. Further, the projection 53*e* of the base portion of the external wall 53*a* of the connector main structure 53 fits in the recess 155 provided in the wall of the opening 154, and therefore, the connector mains structure 53 is not liable to be dislodged by external force.

Referring to FIG. 16, in order to cramp the chip main structure 51*a* of the IC 51, a wall member 144 may be provided with a boss, instead of disposing the fixing member 151 as described above (in FIG. 16, the sections having the same functions as those illustrated in FIG. 14 are designated with the same referential codes so that the description of the structure illustrated in FIG. 14 can be quoted as the description of the structure in FIG. 16).

Further, a supporting member may be interposed between the connector main structure 53 and the frame of a unit such as a process cartridge.

Embodiment 5

Next, the fifth embodiment of the present invention will be described.

In this embodiment, the structure of the connector unit C in the first embodiment is modified in consideration of the connector unit manufacturing (assembling) conditions.

FIG. 17(*a*) illustrates a two-piece connector unit. The top piece 171 integrally comprises an I/O connector portion 171*a* and a top support member 171*b*. It is united with a bottom support member 172 to form a connector unit C.

In FIG. 17, the sections having the same functions as those illustrated in FIG. 6 are designated with the same reference numerals permitting quoting of the description of FIG. 6 as the description for FIG. 17. In the drawing, a claw 66*a* is illustrated without showing the slit provided around it. The bottom surface of the I/O connector portion 171*a* is provided with a flange 171*a*1 which extends in the direction perpendicular to the inserting direction E of the connector unit C, and the bottom support member 172 is provided with a groove 172*a* in which the I/O connector portion 171*a* is fitted. This groove 172*a* extends in the direction indicated by an arrow mark E (inserting direction of connector unit C), and is provided with a groove 172*b* in which the flange 171*a*1 of the I/O connector portion 171*a* is fitted. This groove 172*b* extends in the direction perpendicular to the groove 172*a*. The external configuration of the assembled connector unit C is the same as the connector unit C illustrated in FIG. 6.

FIG. 17(*b*) depicts a single-piece connector unit 173, in the case of this connector unit 173, an I/O connector portion 173*a* is integrally formed with a support portion 173*b*. The external configuration of the connector unit 173 is also the same as the connector unit C illustrated in FIG. 6.

Whichever design is employed among the three-piece design in the first embodiment, the two-piece design in this fifth embodiment, and the single-piece design also in this fifth embodiment, the effects of the present invention can be satisfactorily realized. Therefore, a manufacturer may select the most appropriate one among the aforementioned designs in consideration of manufacturing related concerns, for example, the metallic mold cost, the assembly cost, and the like.

As described above, according to the preceding embodiments, an electrical connector (53, 90 or 111) engageable with a counterpart connector (57) provided on the image forming apparatus main assembly side comprises a memory member (51) for storing information, and a plurality of electrical terminals (52) which are separably connected to the electrical terminals (55) of the connector (57) on the apparatus main assembly side when the connector (53, 90 or 111) is engaged with the connector (57) of the apparatus main assembly, wherein the memory member (51) is electrically connected to each of the plurality of electrical terminals (52) with the use of electrically conductive members (for example, lead wires 51*b*).

According to one of the aspects of the embodiments, the memory member (51) is disposed on the upstream side of the terminal (52) relative to the direction (direction indicated by an arrow mark X) in which the electrical connector (53, 90 or 111) is moved to be engaged with the connector (57) of the apparatus main assembly.

According to another aspect of the embodiments, the electrical connector (53, 90 or 111) comprises a wall (53*a*, 90*a* or 111*a*) extended to surround the terminals (52).

According to another aspect of the embodiments, the bottom end of the wall (53*a*, 90*a* or 111*a*), which is to be engaged with the connector (57) of the apparatus main assembly, is provided with a tapered portion (53*a*1), which guides the electrical connector (53, 90 or 111) when the electrical connector (53, 90 or 111) is engaged with the connector (57) of the apparatus main assembly. As the electrical connector (50, 90 or 111) is electrically connected to the connector (57) of the apparatus main assembly, the engagement portion (57*c*) of the connector (57) on the apparatus main assembly side fits in the space (53*d*) created between the internal surface of the wall (53*a*, 90*a* or 111*a*) and the terminal (52). The engagement portion (57*c*) is provided with a recess (57*d*), and the terminal 52 of the electrical connector (53, 90 or 111) enters the recess (57*d*) to make electrical contact with the apparatus main assembly side terminal (55) disposed in the recess (57*d*).

According to another aspect of the embodiments, the electrical connector (90 or 111) is provided with an external wall (90*a* or 111*a*) which covers both longitudinal ends of the memory member (51), wherein a plurality of lead wires (51*b*) extend from the longitudinal edges of the memory member (51).

According to another aspect of the embodiments, the electrical connector (111) is provided with an external wall (111*a*) which covers both longitudinal ends of the memory member (51), wherein a plurality of lead wires (51*b*) extend from the longitudinal edges of the memory member (51), and at least one of the longitudinal ends of the memory (51) is exposed so that a tool (130) can be inserted from the longitudinal direction of the memory member (51) to dislodge the memory member (51) from its mount.

According to another aspect of the embodiments, the electrical connector (53, 90 or 111) is provided with a wall (53*a*, 90*a* or 111*a*) which surrounds the terminal (52), and a space (53*d*) is provided between the internal surface of the wall and the terminal, wherein the terminal (52) is disposed deep inside the space (53*d*), being sufficiently away from the bottom end of the wall in the height direction of the wall to secure a distance for preventing the terminal (52) from coming in contact with a foreign object even when a foreign object, for example, a probe (130) having an edge angle of 25 deg., happens to be inserted into the space (53*d*).

The following is evident from the above descriptions:

(1) According to the preceding embodiments, it is possible to realize an inexpensive, small, and highly noise resistant structure for an electrical connector which is used to install an electronic device, for example, an IC such as an EPROM, in a unit removably mountable in the main assembly of an image forming apparatus.

(2) According to one of the aspects of the preceding embodiment, an IC is placed directly in contact with a connecting means on which the IC is mounted; therefore, the IC is automatically connected to the counterpart connector by simply engaging two connectors, eliminating the need for separate wiring which electrically connects the IC to the counterpart connector.

(3) According to another aspect of the preceding embodiment, an IC and an electric power supplying means are disposed in a connector; therefore, only one connector pair is necessary to transmit signals to and from the IC, and supply the unit with electric power.

(4) According to another aspect of the preceding embodiments, only one connector pair is necessary to transmit signals to and from the IC, to supply the unit with electric power, and to pick up the signals from the sensors connected to the connector on which the IC is mounted.

(5) According to another aspect of the preceding embodiment, at least one connector of the connector pair is mounted in a positionally adjustable manner to deal with the misalignment of the connectors; therefore, the two connectors can be reliably engaged.

(6) According to another aspect of the preceding embodiments, the IC is mounted in such a manner that the IC is surrounded by the extension of the connector main structure; therefore, the IC is not liable to come directly in contact with foreign objects.

(7) According to another aspect of the preceding embodiments, the connector main structure is provided with an external wall for surrounding the IC, wherein one, or opposing two, of the four sections of the external wall, which does not face the lead wires of the IC, is provided with a notch; therefore, it is easy to remove the IC.

(8) According to another aspect of the preceding embodiments, the surface of the connector main structure, which faces the bottom surface of the IC, is provided with projections to prevent the bottom surface of the IC from coming flatly in contact with the surface of the connector main structure; therefore, a gap useful for dislodging the IC can be secured between the IC and the connector main structure.

(9) According to another aspect of the preceding embodiments, the terminal is made to double as means for connecting the IC, and the IC and terminal are supported by the connector main structure; therefore, the structure is simplified.

(10) According to another aspect of the preceding embodiments, the connector main structure is formed of electrically insulative material, and comprises an external wall which surrounds the connection terminals, and a terminal mount disposed within the external wall, wherein one end of the external wall forms an engagement portion which is separably engaged with the counterpart connector on which the IC is not mounted, and the IC is automatically connected to the terminal as the IC is mounted on the terminal mount; therefore, the structure of the electrical connector is simple, strong, and easy to manufacture.

(11) According to another aspect of the preceding embodiments, the engagement portion is extended; therefore, forgone objects such as a probe are not liable to be allowed to reach as far into the terminal mounting space as the terminal location; in other words, the extension of the engagement portion serves as means for preventing static electricity discharge.

(12) According to another aspect of the preceding embodiments, opposing sections of the external wall of the connector main structure are slanted outward and also are rendered elastically bendable in the inward direction, wherein the top end of each of these opposing sections is provided with an IC cramping member; therefore, the IC is not liable to dislodge from the connector main structure after the connector is attached to a unit.

(13) According to another aspect of the preceding embodiments, an electronically erasable storing means is employed as the IC; therefore, the connector can hold the information of a unit to which the connector with the IC is attached.

(14) According to another aspect of the preceding embodiments, the connector with the IC is provided with a support member; therefore, the connector can be easily fitted to a member to which the connector is to be attached, and at the same time, the connector is protected by the support member.

(15) According to another aspect of the preceding embodiments, the connector is supported with two separate support members which can be easily assembled together. Therefore, component manufacturing steps can be simplified. Also, with this arrangement, the connector can be standardized, and the same connector can be attached to different types of unit simply by using different support members, affording flexibility in connector application.

(16) According to another aspect of the preceding embodiments, the connector is integrally formed with a part of the support member, and this connector integral with a part of the support member is supported by the other part of the support member; therefore, the connector main structure is reinforced.

(17) According to another aspect of the preceding embodiments, the connector and the support member are integrally formed; therefore, the connector is highly strong and rigid.

(18) According to another aspect of the preceding embodiments, the means for storing the information regarding a unit removably installable in the main assembly of an image forming apparatus is mounted in the connector which requires only a small space: therefore, it is unnecessary to increase the unit size. Also, the space in which the connector is mounted is located adjacent to the external wall of the unit, being is covered with the unit frame wall or a separate lid. Therefore, the connector can be easily attached to the unit, and can be protected from the noises generated by a high voltage member such as a charger. Further, the electronic device is prevented from being subjected to short circuit or contact failure caused by the adhesion of toner or the like. In other words, the environment in which the electronic device operates is improved in terms of noise resistance.

(19) According to another aspect of the preceding embodiments, a unit is provided with a dedicated space for accommodating the connector; therefore, the connector does not greatly protrude from the surface of the unit, rendering the unit clean in configuration, and compact in overall size.

(20) According to another aspect of the preceding embodiments, the connector is designed to interpose a support member between the connector main structure and a unit to which the connector main structure is attached; therefore, the same connector can be precisely and firmly attached to various units to make desirable electrical contact with a counterpart connector, which makes the connector virtually immune to ill effects which result from handling of the connector, for example, engaging or disengaging the connector.

(21) According to another aspect of the preceding embodiments, a developing device can be provided with means for storing various information regarding developing device conditions, without greatly increasing the size of a developing device.

(22) According to another aspect of the preceding embodiment, a toner cartridge can be provided with means for storing the information regarding toner remainder, without increasing the size of a toner cartridge.

(23) According to another aspect of the preceding embodiments, a process cartridge can be provided with means for storing a process cartridge history, simply by attaching the connector in accordance with the present invention to a process cartridge, without increasing process cartridge size. Further, the connector is also compatible with the process cartridges described in claims 24–26.

(24) According to another aspect of the preceding embodiments, the connector in accordance with the present invention is attached to a unit removably installable in the main assembly of an image forming apparatus, and the counterpart connector in accordance with the present invention is attached to the main assembly of an image forming apparatus, wherein an IC is mounted in the connector on the unit side, eliminating the need for substantially increasing the unit size; therefore, it is unnecessary to increase the image forming apparatus size.

(25) According to another aspect of the preceding embodiments, an IC is an electronically erasable storing means; therefore, the information regarding a unit, which is exchanged between the control circuit of the main assembly of an image forming apparatus and the unit, can be stored one after another in the IC.

While the invention has been described with reference to the structures disclosed herein, it is not confined to the details set forth and this application is intended to cover such modifications or changes as may come within the purposes of the improvements or the scope of the following claims.

What is claimed is:

1. An electrical connector electrically connectable with a main assembly connector, provided in a main assembly of an electrophotographic image forming apparatus, comprising:

a storing member for storing information;

a mounting portion;

a plurality of electrical contacts, a plurality of which are on one side of said mounting portion, and the rest of which are on an opposite side thereof, for separably connecting with a contact of said main assembly connector, when they are connected electrically with said main assembly connector; and a wall enclosing said mounting portion with a space between the inner surface of said wall and said electrical contacts on said mounting portion, wherein said storing member is electrically connected with said electrical contacts with lead lines.

2. A connector according to claim 1, wherein said storing member is mounted at a position upstream of said electronic contacts in a direction of connection of said electrical connector with said main assembly connector.

3. A connector according to claim 1, wherein free ends of said electrical contacts are provided inside said wall in a direction of height of said wall, and in a direction in which a part of said main assembly connector enters the space.

4. An electrical connector electrically connectable with a main assembly connector, provided in a main assembly of an electrophotographic image forming apparatus, comprising:

a storing member for storing information;

a mounting portion;

a plurality of electrical contacts, a plurality of which are on one side of said mounting portion, and the rest of which are on an opposite side thereof, for separably connecting with a contact of said main assembly connector when they are connected electrically with said main assembly connector; and a wall provided so as to enclose said mounting portion with a space between the inner surface of said wall and said electrical contacts, wherein free ends of said electrical contacts are provided inside said wall in a direction of height of said wall, and wherein said storing member is electrically connected with each of said electrical contacts with lead lines;

wherein said wall is provided with a taper adjacent an end for connection with said main assembly connector, wherein when said electrical connector is to be connected with the main assembly connector, it is guided by said taper.

5. An electrical connector electrically connectable with a main assembly connector, provided in a main assembly of an electrophotographic image forming apparatus, comprising:

a storing member for storing information;

a mounting portion;

a plurality of electrical contacts, a plurality of which are on one side of said mounting portion, and the rest of which are on an opposite side thereof, for separably connecting with a contact of said main assembly connector when they are connected electrically with said main assembly connector;

wherein said storing member is electrically connected with said electrical contacts with lead lines; and a wall provided so as to enclose said mounting portion with a space between the inner surface of said wall and said electrical contacts, wherein free ends of said electrical contacts, are provided inside said wall in a direction of height of said wall, wherein when said electrical connector is to be connected electrically with said main assembly connector, an engaging portion of said main assembly connector is engaged with a space formed between an inner surface of said wall and said electrical contacts, wherein said engaging portion is provided with a dimple, into which said electronic contacts of said electrical connector enter to be electrically connected with the electrical contacts.

6. A connector according to claim 5, further comprising an outer wall covering opposite longitudinal end portions of said storing member, wherein a plurality of said lead lines are extended out of said storing member at the opposite end portions thereof.

7. An electrical connector electrically connectable with a main assembly connector, provided in a main assembly of an electrophotographic image forming apparatus, comprising:

a storing member for storing information;

a mounting portion;

a plurality of electrical contacts, a plurality of which are on one side of said mounting portion, and the rest of which are on an opposite side thereof, for separably connecting with a contact of said main assembly connector when they are connected electrically with said main assembly connector, a wall enclosing said mounting portion with a space between the inner surface of said wall and said electrical contacts, wherein said storing member is electrically connected with each of said electrical contacts with lead lines; and an outer wall covering opposite longitudinal end portion of said storing member, wherein a plurality of said lead lines are extended out of said storing member at the opposite end portions thereof, wherein at least one of lateral surfaces of said storing member is exposed, and said storing member is demountable from a mounting position by inserting a tool into a lateral surface of said storing member.

8. An electrical connector electrically connectable with a main assembly connector, provided in a main assembly of an electrophotographic image forming apparatus, comprising:

a storing member for storing information;

a mounting portion;

a plurality of electrical contacts, a plurality of which are on one side of said mounting portion, and the rest of which are on an opposite side thereof, for separably connecting with a contact of said main assembly connector when they are connected electrically with said main assembly connector;

wherein said storing member is electrically connected with each of said electrical contacts with lead lines, wherein said electrical connector is provided with a wall provided so as to enclose said mounting portion, wherein a space is formed between an inner surface of said wall and said electrical contacts on said mounting portion, wherein said electrical contacts are provided inside said wall in the direction of height of said wall so as to assure such a distance that even when a probe having an angle of 25 degrees at a free end thereof is inserted into said space, said probe does not contact said electrical contacts.

9. An electrical connector electrically connectable with a main assembly connector, provided in a main assembly of an electrophotographic image forming apparatus, wherein said main assembly connector includes an engaging portion, a groove provided in said engaging portion, and a main assembly electrical contact provided in said grove, comprising:

a storing member for storing information;

a plurality of electrical contacts for separably connecting with the contact of said main assembly connector when they are connected electrically with said main assembly connector; and a wall enclosing said electrical contacts;

wherein free ends of said electrical contacts are provided inside said wall in the direction of height of said wall, wherein a space is formed between an inner surface of said wall and said electrical contacts, wherein said engaging portion is engaged with said space when said electrical connector is to be electrically connected with the main assembly connector, wherein when said engaging portion is engaged with said space, said electrical contacts of electrical connector enter said groove so that electrical contacts are electrically connected with the main assembly electrical contact provided in said groove, wherein said storing member is electrically connected with said electrical contacts with lead lines.

10. A connector according to claim 9, herein said storing member is mounted at a position upstream of said electronic contacts in a direction of connection of said electrical connector with said main assembly connector.

11. A connector according to claim 9 or 10, wherein said wall is provided with a taper adjacent an end for connection with said main assembly connector, wherein when said electrical connector is to be connected with the main assembly connector, it is guided by said taper.

12. A connector according to claim 11, further comprising an outer wall covering opposite longitudinal end portions of said storing member, wherein a plurality of said lead lines are extended out of said storing member at the opposite end portions thereof.

13. A connector according to claim 9 or 4, further comprising an outer wall covering opposite longitudinal end portions of said storing member, wherein a plurality of said lead lines are extended out of said storing member at the opposite end portions thereof, wherein at least one of lateral surfaces of said storing member is exposed, and said storing member is demountable from a mounting position by inserting a tool into a lateral surface of said storing member.

14. A connector according to claim 9 or 10, wherein said electrical contact is provided inside said wall in the direction of height of said wall so as to assure a such a distance that even when a probe having an angle of 25 degree at a free end thereof is inserted into said space, said probe is not contacted to said electrical contact.

15. An electrical connector electrically connectable with a main assembly connector, provided in a main assembly of an electrophotographic image forming apparatus, wherein said main assembly connector includes an engaging portion, a dimple provided in said engaging portion and a main assembly electrical contact provided in said dimple, comprising:

a storing member for storing information;

a plurality of electrical contacts for separably connecting with the contact of said main assembly connector when they are connected electrically with said main assembly connector;

a wall enclosing said electrical contacts, wherein free ends of said electrical contacts are provided inside said wall in the direction of height of said wall;

an outer wall covering longitudinal opposite ends of said storing member; and a plurality of lead lines extended out of said opposite ends, wherein said lead lines are connected with said electrical contacts, by which said storing member is electrically connected with said electrical contacts, wherein a least one lateral end of said storing member is exposed, and said storing member is removable from a mounting position by inserting a tool at the end portion; and wherein a space is formed between an inner surface of said wall and said electrical contacts, wherein said engaging portion is engaged with said space when said electrical connector is to be electrically connected with the main assembly connector, wherein when said engaging portion is engaged with said space, said electrical contacts of said electrical connector enter said dimple so that electrical contacts are electrically connected with the main assembly electrical contact provided in said dimple.

16. A connector according to claim 15, wherein said storing member is mounted at a position upstream of said electrical contacts in a direction of connection of said electrical connector with said main assembly connector.

17. A connector according to claim 15 or 16, wherein said wall is provided with a taper adjacent an end for connection with said main assembly connector, wherein when said electrical connector is to be connected with the main assembly connector, it is guided by said taper.

18. A connector according to claim 15 or 16, wherein said electrical contact is provided inside said wall in the direction of height of said wall so as to assure a such a distance that even when a probe having an angle of 25 degrees at a free end thereof is inserted into said space, said probe is not contacted to said electrical contact.

19. A process cartridge detachably mountable to a main assembly of an image forming apparatus, comprising:

a) an electrophotographic photosensitive member;

b) process means actable on said electrophotographic photosensitive member; and c) an electrical connector electrically connectable with a main assembly connector, provided in said main assembly of an image forming apparatus, said electrical connector comprising:

a storing member for storing information; and a plurality of electrical contacts for separably connecting with the contact of said main assembly connector when they are connected electrically with said main assembly connector, wherein said storing member is electrically connected with said electrical contacts with lead lines.

20. A process cartridge according to claim 19, wherein said process means includes at least one of a charging member for charging said electrophotographic photosensitive member, a developing member for developing a latent image formed on the photosensitive member, a cleaning member for removing toner remaining said electrophotographic photosensitive member.

21. A process cartridge according to claim 19, wherein said electrical connector is provided in a cleaning frame for supporting said electrophotographic photosensitive member, a charging member for charging said electrophotographic photosensitive member and a cleaning member for removing toner remaining on said electrophotographic photosensitive member, and said electrical connector is mounted in a mounting direction when said process cartridge is mounted to a main assembly of said device.

22. A process cartridge according to claim 19, wherein said storing member is mounted at a position upstream of said electronic contacts in a direction of connection of said electrical connector with said main assembly connector.

23. A process cartridge according to claim 19, wherein said electrical connector has a wall provided so as to enclose said electrical contacts, and free ends of said electrical contacts, are provided inside said wall in a direction of height of said wall.

24. A process cartridge according to claim 23, wherein said wall is provided with a taper adjacent an end for connection with said main assembly connector, wherein when said electrical connector is to be connected with the main assembly connector, it is guided by said taper.

wherein said engaging portion is engaged with said space when said electrical connector is to be electrically connected with the main assembly connector, wherein when said engaging portion is engaged with said space, said electrical contacts of electrical connector enter said groove so that electrical contacts are electrically connected with the main assembly electrical contact provided in said groove, wherein said storing member is electrically connected with said electrical contacts with lead lines.

10. A connector according to claim 9, herein said storing member is mounted at a position upstream of said electronic contacts in a direction of connection of said electrical connector with said main assembly connector.

11. A connector according to claim 9 or 10, wherein said wall is provided with a taper adjacent an end for connection with said main assembly connector, wherein when said electrical connector is to be connected with the main assembly connector, it is guided by said taper.

12. A connector according to claim 11, further comprising an outer wall covering opposite longitudinal end portions of said storing member, wherein a plurality of said lead lines are extended out of said storing member at the opposite end portions thereof.

13. A connector according to claim 9 or 4, further comprising an outer wall covering opposite longitudinal end portions of said storing member, wherein a plurality of said lead lines are extended out of said storing member at the opposite end portions thereof, wherein at least one of lateral surfaces of said storing member is exposed, and said storing member is demountable from a mounting position by inserting a tool into a lateral surface of said storing member.

14. A connector according to claim 9 or 10, wherein said electrical contact is provided inside said wall in the direction of height of said wall so as to assure a such a distance that even when a probe having an angle of 25 degree at a free end thereof is inserted into said space, said probe is not contacted to said electrical contact.

15. An electrical connector electrically connectable with a main assembly connector, provided in a main assembly of an electrophotographic image forming apparatus, wherein said main assembly connector includes an engaging portion, a dimple provided in said engaging portion and a main assembly electrical contact provided in said dimple, comprising:

a storing member for storing information;

a plurality of electrical contacts for separably connecting with the contact of said main assembly connector when they are connected electrically with said main assembly connector;

a wall enclosing said electrical contacts, wherein free ends of said electrical contacts are provided inside said wall in the direction of height of said wall;

an outer wall covering longitudinal opposite ends of said storing member; and a plurality of lead lines extended out of said opposite ends, wherein said lead lines are connected with said electrical contacts, by which said storing member is electrically connected with said electrical contacts, wherein a least one lateral end of said storing member is exposed, and said storing member is removable from a mounting position by inserting a tool at the end portion; and wherein a space is formed between an inner surface of said wall and said electrical contacts, wherein said engaging portion is engaged with said space when said electrical connector is to be electrically connected with the main assembly connector, wherein when said engaging portion is engaged with said space, said electrical contacts of said electrical connector enter said dimple so that electrical contacts are electrically connected with the main assembly electrical contact provided in said dimple.

16. A connector according to claim 15, wherein said storing member is mounted at a position upstream of said electrical contacts in a direction of connection of said electrical connector with said main assembly connector.

17. A connector according to claim 15 or 16, wherein said wall is provided with a taper adjacent an end for connection with said main assembly connector, wherein when said electrical connector is to be connected with the main assembly connector, it is guided by said taper.

18. A connector according to claim 15 or 16, wherein said electrical contact is provided inside said wall in the direction of height of said wall so as to assure a such a distance that even when a probe having an angle of 25 degrees at a free end thereof is inserted into said space, said probe is not contacted to said electrical contact.

19. A process cartridge detachably mountable to a main assembly of an image forming apparatus, comprising:

a) an electrophotographic photosensitive member;

b) process means actable on said electrophotographic photosensitive member; and c) an electrical connector electrically connectable with a main assembly connector, provided in said main assembly of an image forming apparatus, said electrical connector comprising:

a storing member for storing information; and a plurality of electrical contacts for separably connecting with the contact of said main assembly connector when they are connected electrically with said main assembly connector, wherein said storing member is electrically connected with said electrical contacts with lead lines.

20. A process cartridge according to claim 19, wherein said process means includes at least one of a charging member for charging said electrophotographic photosensitive member, a developing member for developing a latent image formed on the photosensitive member, a cleaning member for removing toner remaining said electrophotographic photosensitive member.

21. A process cartridge according to claim 19, wherein said electrical connector is provided in a cleaning frame for supporting said electrophotographic photosensitive member, a charging member for charging said electrophotographic photosensitive member and a cleaning member for removing toner remaining on said electrophotographic photosensitive member, and said electrical connector is mounted in a mounting direction when said process cartridge is mounted to a main assembly of said device.

22. A process cartridge according to claim 19, wherein said storing member is mounted at a position upstream of said electronic contacts in a direction of connection of said electrical connector with said main assembly connector.

23. A process cartridge according to claim 19, wherein said electrical connector has a wall provided so as to enclose said electrical contacts, and free ends of said electrical contacts, are provided inside said wall in a direction of height of said wall.

24. A process cartridge according to claim 23, wherein said wall is provided with a taper adjacent an end for connection with said main assembly connector, wherein when said electrical connector is to be connected with the main assembly connector, it is guided by said taper.

25. A process cartridge according to claim 23 or 24, wherein when said electrical connector is to be connected electrically with said main assembly connector, an engaging portion of said main assembly connector is engaged with a space formed between an inner surface of said wall and said electrical contacts, wherein said engaging portion is provided with a dimple, into which said electronic contacts of said electrical connector enter to be electrically connected with the electrical contacts.

26. A process cartridge according to claim 25, further comprising an outer wall covering opposite longitudinal end portions of said storing member, wherein a plurality of said lead lines are extended out of said storing member at the opposite end portions thereof.

27. A process cartridge according to claim 19 or 24, further comprising an outer wall covering opposite longitudinal end portions of said storing member, wherein a plurality of said lead lines are extended out of said storing member at the opposite end portions thereof, wherein at least one of lateral surfaces of said storing member, is exposed, and said storing member is demountable from a mounting position by inserting a tool into a lateral surface of said storing member.

28. A process cartridge according to claim 19 or 24, wherein said electrical connector is provided with a wall provided so as to enclose said electrical contacts, wherein a space is formed between an inner surface of said wall and said electrical contact, wherein said electrical contact is provided inside said wall in the direction of height of said wall so as to assure a such a distance that even when a probe having an angle of 25 degrees at a free end thereof is inserted into said space, said probe is not contacted to said electrical contact.

29. A process cartridge according to claim 19 or 24, wherein said electrical connector is mounted on a cartridge frame such that storing member is positioned in a space constituted by a wall member provided in said cartridge frame, wherein said wall member is provided with a rib, and said rib is contacted to a base portion of a side wall of said electrical connector.

30. A process cartridge detachably mountable to a main assembly of an image forming apparatus, wherein a main assembly connector is provided in the main assembly of the image forming apparatus and includes an engaging portion, a groove provided in said engaging portion and a main assembly electrical contact provided in said groove, comprising:

a) an electrophotographic photosensitive member;

b) a charging member for charging said electrophotographic photosensitive member;

c) a cleaning member for removing toner remaining on said electrophotographic photosensitive member; and d) an electrical connector connectable electrically with said main assembly connector when said process cartridge is mounted to main assembly of the apparatus, said electrical connector comprising;

a storing member for storing information;

a plurality of electrical contacts for separably connecting with the contact of said main assembly connector when they are connected electrically with said main assembly connector; and a wall enclosing said electrical contacts;

wherein a space is formed between an inner surface of said wall and said electrical contacts, wherein said engaging portion is engaged with said space when said electrical connector is to be electrically connected with the main assembly connector, wherein when said engaging portion is engaged with said space, said electrical contacts of said electrical connector enter said groove so that electrical contacts are electrically connected with the main assembly electrical contact provided in said groove;

wherein said storing member is electrically connected with said electrical contacts with lead lines, and wherein said electrical connector is mounted in a mounting direction when said process cartridge is mounted to said main assembly.

31. A process cartridge according to claim 30, wherein said process cartridge further comprises a cleaning member for removing toner remaining on said electrophotographic photosensitive member.

32. A process cartridge according to claim 30, wherein said electrical connector is mounted to a cleaning frame for supporting said electrophotographic photosensitive member, said charging member and said cleaning member.

33. A process cartridge according to claim 30, wherein said storing member is mounted at a position upstream of said electronic contacts in a direction of connection of said electrical connector with said main assembly connector.

34. A process cartridge according to claim 30 or 33, wherein said wall is provided with a taper adjacent an end for connection with said main assembly connector, wherein when said electrical connector is to be connected with the main assembly connector, it is guided by said taper.

35. A process cartridge according to claim 34, further comprising an outer wall covering opposite longitudinal end portions of said storing member, wherein a plurality of said lead lines are extended out of said storing member at the opposite end portions thereof.

36. A process cartridge according to claim 30 or 33, further comprising an outer wall covering opposite longitudinal end portions of said storing member, wherein a plurality of said lead lines are extended out of said storing member at the opposite end portions thereof, wherein at least one of lateral surfaces of said storing member, is exposed, and said storing member is demountable from a mounting position by inserting a tool into a lateral surface of said storing member.

37. A process cartridge according to claim 30 or 33, wherein said electrical contact is provided inside said wall in the direction of height of said wall so as to assure a such a distance that even when a probe having an angle of 25 degrees at a free end thereof is inserted into said space, said probe is not contacted to said electrical contact.

38. A process cartridge detachably mountable to a main assembly of an image forming apparatus, wherein a main assembly connector includes an engaging portion, a dimple provided in said engaging portion and a main assembly electrical contact provided in said dimple, comprising:

a) an electrophotographic photosensitive member;

b) a charging member for charging said electrophotographic photosensitive member; and c) an electrical connector connectable electrically with said main assembly connector of said device when said process cartridge is mounted to main assembly of the apparatus, said electrical connector comprising:

a storing member for storing information;

a plurality of electrical contacts for separably connecting with the contact of said main assembly connector when they are connected electrically with said main assembly connector;

a wall enclosing said electrical contacts, wherein free ends of said electrical contacts are provided inside said wall in the direction of height of said wall;

25. A process cartridge according to claim 23 or 24, wherein when said electrical connector is to be connected electrically with said main assembly connector, an engaging portion of said main assembly connector is engaged with a space formed between an inner surface of said wall and said electrical contacts, wherein said engaging portion is provided with a dimple, into which said electronic contacts of said electrical connector enter to be electrically connected with the electrical contacts.

26. A process cartridge according to claim 25, further comprising an outer wall covering opposite longitudinal end portions of said storing member, wherein a plurality of said lead lines are extended out of said storing member at the opposite end portions thereof.

27. A process cartridge according to claim 19 or 24, further comprising an outer wall covering opposite longitudinal end portions of said storing member, wherein a plurality of said lead lines are extended out of said storing member at the opposite end portions thereof, wherein at least one of lateral surfaces of said storing member, is exposed, and said storing member is demountable from a mounting position by inserting a tool into a lateral surface of said storing member.

28. A process cartridge according to claim 19 or 24, wherein said electrical connector is provided with a wall provided so as to enclose said electrical contacts, wherein a space is formed between an inner surface of said wall and said electrical contact, wherein said electrical contact is provided inside said wall in the direction of height of said wall so as to assure a such a distance that even when a probe having an angle of 25 degrees at a free end thereof is inserted into said space, said probe is not contacted to said electrical contact.

29. A process cartridge according to claim 19 or 24, wherein said electrical connector is mounted on a cartridge frame such that storing member is positioned in a space constituted by a wall member provided in said cartridge frame, wherein said wall member is provided with a rib, and said rib is contacted to a base portion of a side wall of said electrical connector.

30. A process cartridge detachably mountable to a main assembly of an image forming apparatus, wherein a main assembly connector is provided in the main assembly of the image forming apparatus and includes an engaging portion, a groove provided in said engaging portion and a main assembly electrical contact provided in said groove, comprising:

a) an electrophotographic photosensitive member;

b) a charging member for charging said electrophotographic photosensitive member;

c) a cleaning member for removing toner remaining on said electrophotographic photosensitive member; and d) an electrical connector connectable electrically with said main assembly connector when said process cartridge is mounted to main assembly of the apparatus, said electrical connector comprising;

a storing member for storing information;

a plurality of electrical contacts for separably connecting with the contact of said main assembly connector when they are connected electrically with said main assembly connector; and a wall enclosing said electrical contacts;

wherein a space is formed between an inner surface of said wall and said electrical contacts, wherein said engaging portion is engaged with said space when said electrical connector is to be electrically connected with the main assembly connector, wherein when said engaging portion is engaged with said space, said electrical contacts of said electrical connector enter said groove so that electrical contacts are electrically connected with the main assembly electrical contact provided in said groove;

wherein said storing member is electrically connected with said electrical contacts with lead lines, and wherein said electrical connector is mounted in a mounting direction when said process cartridge is mounted to said main assembly.

31. A process cartridge according to claim 30, wherein said process cartridge further comprises a cleaning member for removing toner remaining on said electrophotographic photosensitive member.

32. A process cartridge according to claim 30, wherein said electrical connector is mounted to a cleaning frame for supporting said electrophotographic photosensitive member, said charging member and said cleaning member.

33. A process cartridge according to claim 30, wherein said storing member is mounted at a position upstream of said electronic contacts in a direction of connection of said electrical connector with said main assembly connector.

34. A process cartridge according to claim 30 or 33, wherein said wall is provided with a taper adjacent an end for connection with said main assembly connector, wherein when said electrical connector is to be connected with the main assembly connector, it is guided by said taper.

35. A process cartridge according to claim 34, further comprising an outer wall covering opposite longitudinal end portions of said storing member, wherein a plurality of said lead lines are extended out of said storing member at the opposite end portions thereof.

36. A process cartridge according to claim 30 or 33, further comprising an outer wall covering opposite longitudinal end portions of said storing member, wherein a plurality of said lead lines are extended out of said storing member at the opposite end portions thereof, wherein at least one of lateral surfaces of said storing member, is exposed, and said storing member is demountable from a mounting position by inserting a tool into a lateral surface of said storing member.

37. A process cartridge according to claim 30 or 33, wherein said electrical contact is provided inside said wall in the direction of height of said wall so as to assure a such a distance that even when a probe having an angle of 25 degrees at a free end thereof is inserted into said space, said probe is not contacted to said electrical contact.

38. A process cartridge detachably mountable to a main assembly of an image forming apparatus, wherein a main assembly connector includes an engaging portion, a dimple provided in said engaging portion and a main assembly electrical contact provided in said dimple, comprising:

a) an electrophotographic photosensitive member;

b) a charging member for charging said electrophotographic photosensitive member; and c) an electrical connector connectable electrically with said main assembly connector of said device when said process cartridge is mounted to main assembly of the apparatus, said electrical connector comprising:

a storing member for storing information;

a plurality of electrical contacts for separably connecting with the contact of said main assembly connector when they are connected electrically with said main assembly connector;

a wall enclosing said electrical contacts, wherein free ends of said electrical contacts are provided inside said wall in the direction of height of said wall;

an outer wall covering longitudinal opposite ends of said storing member; and a plurality of lead lines extended out of said opposite ends, wherein said lead lines are connected with said electrical contacts, by which said storing member is electrically connected with said electrical contacts;

wherein at least one lateral end of said storing member is exposed, and said storing member is removable from a mounting position by inserting a tool at the end portion; and wherein a space is formed between an inner surface of said wall and said electrical contacts, wherein said engaging portion is engaged with said space when said electrical connector is to be electrically connected with the main assembly connector, and wherein when said engaging portion is engaged with said space, said electrical contacts of said electrical connector enter said dimple so that electrical contacts are electrically connected with the main assembly electrical contact provided in said dimple.

39. A process cartridge according to claim 38, wherein said process cartridge further comprises a cleaning member for removing toner remaining on said electrophotographic photosensitive member.

40. A process cartridge according to claim 38, wherein said electrical connector is mounted to a cleaning frame for supporting said electrophotographic photosensitive member, said charging member and said cleaning member.

41. A process cartridge according to claim 38, wherein said storing member is mounted at a position upstream of said electronic contacts in a direction of connection of said electrical connector with said main assembly connector.

42. A process cartridge according to claim 38 or 41, wherein said wall is provided with a taper adjacent an end for connection with said main assembly connector, wherein when said electrical connector is to be connected with the main assembly connector, it is guided by said taper.

43. A process cartridge according to claim 38 or 41, wherein said electrical contact is provided inside said wall in the direction of height of said wall so as to assure a such a distance that even when a probe having an angle of 25 degrees at a free end thereof is inserted into said space, said probe is not contacted to said electrical contact.

44. A process cartridge according to claim 38 or 41, wherein said electrical connector is mounted on a cartridge frame such that storing member is positioned in a space constituted by a wall member provided in said cartridge frame, wherein said wall member is provided with a rib, and said rib is contacted to a base portion of a side wall of said electrical connector.

45. An electrophotographic image forming apparatus for forming an image on a recording material, to which a process cartridge is detachably mountable, comprising:

a) a main assembly connector in a main assembly of the apparatus;

b) a mounting portion for detachably mounting said process cartridge, said process cartridge comprising:

an electrophotographic photosensitive member;

process means actable on said electro photographic photosensitive member;

an electrical connector electrically connectable with said main assembly connector, provided in said main assembly of the image forming apparatus, said electrical connector comprising:

a storing member for storing information; and a plurality of electrical -contacts for separably connecting with a contact of said main assembly connector when they are connected electrically with said main assembly connector;

wherein said storing member is electrically connected with said electrical contacts with lead lines; and c) a feeding member for feeding the recording material.

46. An electrophotographic image forming apparatus for forming an image on a recording material, to which a process cartridge is detachably mountable, comprising:

a) a main assembly connector having an engaging portion, a groove provided in said engaging portion, and a main assembly electrical contact provided in said groove;

b) a mounting portion for detachably mounting said process cartridge, said process cartridge comprising, an electrophotographic photosensitive member;

a charging member for charging said electrophotographic photosensitive member;

a cleaning member for removing toner remaining on said electrophotographic photosensitive member; and an electrical connector electrically connectable with said main assembly connector when said process cartridge is mounted to the main assembly, said electrical connector comprising:

a storing member for storing information;

a plurality of electrical contacts for separably connecting with the contact of said main assembly connector when they are connected electrically with said main assembly connector; and a wall enclosing said electrical contacts, wherein free ends of said electrical contacts are provided inside said wall in the direction of height of said wall;

wherein a space is formed between an inner surface of said wall and said electrical contacts, wherein said engaging portion is engaged with said space when said electrical connector is to be electrically connected with the main assembly connector, wherein when said engaging portion is engaged with said space, said electrical contacts of said electrical connector enter said groove so that said electrical contacts are electrically connected with the main assembly electrical contact provided in said groove, wherein said storing member is electrically connected with said electrical contacts with lead lines, and wherein said electrical connector is mounted in a mounting direction of said process cartridge when said process cartridge is mounted to the main assembly of said apparatus; and c) a feeding member for feeding the recording material.

47. An electrophotographic image forming apparatus for forming an image on a recording material, to which a process cartridge is detachably mountable, comprising:

a. a main assembly connector having an engaging portion, a) a dimple provided in said engaging portion and a main assembly electrical contact provided in said dimple;

b) a mounting portion for detachably mounting said process cartridge, said process cartridge comprising:

an electrophotographic photosensitive member; a charging member for charging said electrophotographic photosensitive member;

an electrical connector electrically connectable with said main assembly connector when said process cartridge is mounted to said main assembly, said electrical connector comprising:

an outer wall covering longitudinal opposite ends of said storing member; and a plurality of lead lines extended out of said opposite ends, wherein said lead lines are connected with said electrical contacts, by which said storing member is electrically connected with said electrical contacts;

wherein at least one lateral end of said storing member is exposed, and said storing member is removable from a mounting position by inserting a tool at the end portion; and wherein a space is formed between an inner surface of said wall and said electrical contacts, wherein said engaging portion is engaged with said space when said electrical connector is to be electrically connected with the main assembly connector, and wherein when said engaging portion is engaged with said space, said electrical contacts of said electrical connector enter said dimple so that electrical contacts are electrically connected with the main assembly electrical contact provided in said dimple.

39. A process cartridge according to claim 38, wherein said process cartridge further comprises a cleaning member for removing toner remaining on said electrophotographic photosensitive member.

40. A process cartridge according to claim 38, wherein said electrical connector is mounted to a cleaning frame for supporting said electrophotographic photosensitive member, said charging member and said cleaning member.

41. A process cartridge according to claim 38, wherein said storing member is mounted at a position upstream of said electronic contacts in a direction of connection of said electrical connector with said main assembly connector.

42. A process cartridge according to claim 38 or 41, wherein said wall is provided with a taper adjacent an end for connection with said main assembly connector, wherein when said electrical connector is to be connected with the main assembly connector, it is guided by said taper.

43. A process cartridge according to claim 38 or 41, wherein said electrical contact is provided inside said wall in the direction of height of said wall so as to assure a such a distance that even when a probe having an angle of 25 degrees at a free end thereof is inserted into said space, said probe is not contacted to said electrical contact.

44. A process cartridge according to claim 38 or 41, wherein said electrical connector is mounted on a cartridge frame such that storing member is positioned in a space constituted by a wall member provided in said cartridge frame, wherein said wall member is provided with a rib, and said rib is contacted to a base portion of a side wall of said electrical connector.

45. An electrophotographic image forming apparatus for forming an image on a recording material, to which a process cartridge is detachably mountable, comprising:

a) a main assembly connector in a main assembly of the apparatus;

b) a mounting portion for detachably mounting said process cartridge, said process cartridge comprising:

an electrophotographic photosensitive member;

process means actable on said electro photographic photosensitive member;

an electrical connector electrically connectable with said main assembly connector, provided in said main assembly of the image forming apparatus, said electrical connector comprising:

a storing member for storing information; and a plurality of electrical -contacts for separably connecting with a contact of said main assembly connector when they are connected electrically with said main assembly connector;

wherein said storing member is electrically connected with said electrical contacts with lead lines; and c) a feeding member for feeding the recording material.

46. An electrophotographic image forming apparatus for forming an image on a recording material, to which a process cartridge is detachably mountable, comprising:

a) a main assembly connector having an engaging portion, a groove provided in said engaging portion, and a main assembly electrical contact provided in said groove;

b) a mounting portion for detachably mounting said process cartridge, said process cartridge comprising.

an electrophotographic photosensitive member;

a charging member for charging said electrophotographic photosensitive member;

a cleaning member for removing toner remaining on said electrophotographic photosensitive member; and an electrical connector electrically connectable with said main assembly connector when said process cartridge is mounted to the main assembly, said electrical connector comprising:

a storing member for storing information;

a plurality of electrical contacts for separably connecting with the contact of said main assembly connector when they are connected electrically with said main assembly connector; and a wall enclosing said electrical contacts, wherein free ends of said electrical contacts are provided inside said wall in the direction of height of said wall;

wherein a space is formed between an inner surface of said wall and said electrical contacts, wherein said engaging portion is engaged with said space when said electrical connector is to be electrically connected with the main assembly connector, wherein when said engaging portion is engaged with said space, said electrical contacts of said electrical connector enter said groove so that said electrical contacts are electrically connected with the main assembly electrical contact provided in said groove, wherein said storing member is electrically connected with said electrical contacts with lead lines, and wherein said electrical connector is mounted in a mounting direction of said process cartridge when said process cartridge is mounted to the main assembly of said apparatus; and c) a feeding member for feeding the recording material.

47. An electrophotographic image forming apparatus for forming an image on a recording material, to which a process cartridge is detachably mountable, comprising:

a. a main assembly connector having an engaging portion, a) a dimple provided in said engaging portion and a main assembly electrical contact provided in said dimple;

b) a mounting portion for detachably mounting said process cartridge, said process cartridge comprising:

an electrophotographic photosensitive member; a charging member for charging said electrophotographic photosensitive member;

an electrical connector electrically connectable with said main assembly connector when said process cartridge is mounted to said main assembly, said electrical connector comprising:

a storing member for storing information;

a plurality of electrical contacts for separably connecting with the contact of said main assembly connector when they are connected electrically with said main assembly connector;

a wall enclosing said electric contacts, wherein free ends of said electrical contacts are provided inside said wall in the direction of height of said wall;

an outer wall covering longitudinal opposite ends of said storing member; and a plurality of lead lines extended out of said opposite ends, wherein said lead lines are connected with said electrical contacts, by which said storing member is electrically connected with said electrical contact, wherein at least one lateral end of said storing member is exposed, and said storing member is removable from a mounting position by inserting a tool at the end portion;

wherein a space is formed between an inner surface of said wall and said electrical contacts, wherein said engaging portion is engaged with said space when said electrical connector is to be electrically connected with the main assembly connector, wherein when said engaging portion is engaged with said space, said electrical contacts of said electrical connector enter said dimple so that said electrical contacts are electrically connected with the main assembly electrical contact provided in said dimple; and c) a feeding member for feeding the recording material.

48. A couple of connectors for connection and disconnection of an electric circuit, the improvement residing in that:

one of said connectors has an IC, and said IC receives and delivers signals through the other of said connectors.

49. A couple according to claim 48, further comprising connecting means for electrically directly connecting one of said connectors and the other thereof.

50. A couple according to claim 48, wherein said one of connectors includes connecting means for effecting said receiving and delivering of the signals and for effecting supply of electric energy through the other of said connectors.

51. A couple according to claim 48, further comprising connecting means for effecting said receiving and delivering of the signals, for effecting supply of electric energy and for delivering signals from sensors connected with said connector having the IC.

52. A couple according to claim 48, wherein at least one of said connectors is mounted for movement to absorb deviation occurring at the time of connector engaging.

53. A couple according to claim 48, wherein said one of said connectors having the IC has a connector body enclosing a circumference of said IC, wherein said connector body prevents said IC from being exposed to outside.

54. A couple according to claim 53, wherein said connector body has an outer wall enclosing the IC, and the outer wall of said connector body of said one of connectors having said IC, is provided with a portion which is inside an edge of the outer wall, in a side or each of two sides of said IC not having contacts.

55. A couple according to claim 53, further comprising a projection on a surface of said connector body faced to a bottom surface of said IC to prevent surface contact between the bottom surface of said IC and the surface of said connector body.

56. A couple according to claim 48, further comprising an IC, connection contacts as said connecting means, and connector body for supporting said IC and said connection contacts.

57. A couple according to claim 56, wherein the connector body has an engaging portion for separable engagement with the counterpart connector not having the IC and made of insulating material, a base portion side outer wall portion cooperating with said engaging portion to enclose the connection contact and continuous from said engaging portion, and the IC and contact mounting portion in and over said engaging portion and said base portion outer wall, wherein said IC and said contact are mounted to said IC and contact mounting portion and are connected with each other.

58. A couple according to claim 57, wherein electrostatic discharge preventing means in the form of an extension of said engaging portion around said contact to the counterpart connector engaging portion o as to prevent a conical probe from directly contacting to the contact from said engaging portion.

59. A couple according to claim 57, wherein part of the outer wall of the main assembly of said connector is openable, and there is provided a fixing member for sandwiching said IC, in the openable portion, and wherein when said connector is not mounted to a mounting member for the connector, said fixing member is in an open state, and when said connector is mounted thereto, said fixing member is closed state to prevent movement of said IC.

60. A couple according to claim 48, wherein said IC functions as electrically erasable memory means.

61. A couple according to claim 48, wherein said connector having said IC is supported on a supporting and is mounted to a connector mounting member through said supporting member.

62. A couple according to claim 61, wherein said connector is supported on two supporting members.

63. A couple according to claim 61, wherein said connector is integrally molded with one of said supporting members, is supported on the other supporting member.

64. A couple according to claim 61, wherein said connector and said supporting member are integrally molded.

65. A unit detachably mountable relative to a main assembly of an electrophotographic image forming apparatus, the improvement residing in the provision of a unit connector having an IC for signal communication with an electronic device in the main assembly through a main assembly connector in said main assembly, wherein said unit connector includes:

a mounting portion;

a plurality of electrical contacts, a plurality of which are on one side of said mounting portion, and the rest of which are on the other side of said mounting portion, for separably connecting with a contact of said main assembly connector when they are connected electrically with said main assembly connector; and a wall enclosing said electrical contacts with a space between inner surface of said wall and said electrical contacts, wherein said IC is electrically connected with said electrical contacts by lead lines, and wherein said unit connector is disconnectably connectable with the main assembly connector in said main assembly.

66. A unit detachably mountable relative to a main assembly of an image forming apparatus, the improvement residing in the provision of a connector having an IC for signal communication with an electronic device in the main assembly through a connector in said main assembly, wherein said connector is disconnectably connectable with the connector in said main assembly, wherein said unit further comprises:

a storing member for storing information;

a plurality of electrical contacts for separably connecting with the contact of said main assembly connector when they are connected electrically with said main assembly connector;

a wall enclosing said electric contacts, wherein free ends of said electrical contacts are provided inside said wall in the direction of height of said wall;

an outer wall covering longitudinal opposite ends of said storing member; and a plurality of lead lines extended out of said opposite ends, wherein said lead lines are connected with said electrical contacts, by which said storing member is electrically connected with said electrical contact, wherein at least one lateral end of said storing member is exposed, and said storing member is removable from a mounting position by inserting a tool at the end portion;

wherein a space is formed between an inner surface of said wall and said electrical contacts, wherein said engaging portion is engaged with said space when said electrical connector is to be electrically connected with the main assembly connector, wherein when said engaging portion is engaged with said space, said electrical contacts of said electrical connector enter said dimple so that said electrical contacts are electrically connected with the main assembly electrical contact provided in said dimple; and c) a feeding member for feeding the recording material.

48. A couple of connectors for connection and disconnection of an electric circuit, the improvement residing in that:

one of said connectors has an IC, and said IC receives and delivers signals through the other of said connectors.

49. A couple according to claim 48, further comprising connecting means for electrically directly connecting one of said connectors and the other thereof.

50. A couple according to claim 48, wherein said one of connectors includes connecting means for effecting said receiving and delivering of the signals and for effecting supply of electric energy through the other of said connectors.

51. A couple according to claim 48, further comprising connecting means for effecting said receiving and delivering of the signals, for effecting supply of electric energy and for delivering signals from sensors connected with said connector having the IC.

52. A couple according to claim 48, wherein at least one of said connectors is mounted for movement to absorb deviation occurring at the time of connector engaging.

53. A couple according to claim 48, wherein said one of said connectors having the IC has a connector body enclosing a circumference of said IC, wherein said connector body prevents said IC from being exposed to outside.

54. A couple according to claim 53, wherein said connector body has an outer wall enclosing the IC, and the outer wall of said connector body of said one of connectors having said IC, is provided with a portion which is inside an edge of the outer wall, in a side or each of two sides of said IC not having contacts.

55. A couple according to claim 53, further comprising a projection on a surface of said connector body faced to a bottom surface of said IC to prevent surface contact between the bottom surface of said IC and the surface of said connector body.

56. A couple according to claim 48, further comprising an IC, connection contacts as said connecting means, and connector body for supporting said IC and said connection contacts.

57. A couple according to claim 56, wherein the connector body has an engaging portion for separable engagement with the counterpart connector not having the IC and made of insulating material, a base portion side outer wall portion cooperating with said engaging portion to enclose the connection contact and continuous from said engaging portion, and the IC and contact mounting portion in and over said engaging portion and said base portion outer wall, wherein said IC and said contact are mounted to said IC and contact mounting portion and are connected with each other.

58. A couple according to claim 57, wherein electrostatic discharge preventing means in the form of an extension of said engaging portion around said contact to the counterpart connector engaging portion o as to prevent a conical probe from directly contacting to the contact from said engaging portion.

59. A couple according to claim 57, wherein part of the outer wall of the main assembly of said connector is openable, and there is provided a fixing member for sandwiching said IC, in the openable portion, and wherein when said connector is not mounted to a mounting member for the connector, said fixing member is in an open state, and when said connector is mounted thereto, said fixing member is closed state to prevent movement of said IC.

60. A couple according to claim 48, wherein said IC functions as electrically erasable memory means.

61. A couple according to claim 48, wherein said connector having said IC is supported on a supporting and is mounted to a connector mounting member through said supporting member.

62. A couple according to claim 61, wherein said connector is supported on two supporting members.

63. A couple according to claim 61, wherein said connector is integrally molded with one of said supporting members, is supported on the other supporting member.

64. A couple according to claim 61, wherein said connector and said supporting member are integrally molded.

65. A unit detachably mountable relative to a main assembly of an electrophotographic image forming apparatus, the improvement residing in the provision of a unit connector having an IC for signal communication with an electronic device in the main assembly through a main assembly connector in said main assembly, wherein said unit connector includes:

a mounting portion;

a plurality of electrical contacts, a plurality of which are on one side of said mounting portion, and the rest of which are on the other side of said mounting portion, for separably connecting with a contact of said main assembly connector when they are connected electrically with said main assembly connector; and a wall enclosing said electrical contacts with a space between inner surface of said wall and said electrical contacts, wherein said IC is electrically connected with said electrical contacts by lead lines, and wherein said unit connector is disconnectably connectable with the main assembly connector in said main assembly.

66. A unit detachably mountable relative to a main assembly of an image forming apparatus, the improvement residing in the provision of a connector having an IC for signal communication with an electronic device in the main assembly through a connector in said main assembly, wherein said connector is disconnectably connectable with the connector in said main assembly, wherein said unit further comprises:

a mounting portion;

a plurality of electrical contacts, a plurality of which are on one side of said mounting portion and the rest of which are on an opposite side thereof, for separably connecting with a contact of the main assembly connector when they are connected electrically with the main assembly connector; and a wall enclosing said mounting portion with a space between the inner surface of said wall and said electrical contacts on said mounting portion, wherein said IC is electrically connected with said electrical contacts with lead lines.

67. A unit detachably mountable relative to a main assembly of an image forming apparatus, the improvement residing in the provision of a connector having an IC for signal communication with an electronic device in the main assembly through a connector in said main assembly, wherein said connector is disconnectably connectable with the connector in said main assembly, wherein a unit side connector is mounted to said unit mounted on a supporting member for supporting said connector, wherein said unit further comprises:

a mounting portion;

a plurality of electrical contacts, a plurality of which are on one side of said mounting portion and the rest of which are on an opposite side thereof, for separably connecting with a contact of the main assembly connector when they are connected electrically with the main assembly connector; and a wall enclosing said mounting portion with a space between the inner surface of said wall and said electrical contacts on said mounting portion, wherein said IC is electrically connected with said electrical contacts with lead lines.

68. A unit detachably mountable relative to a main assembly of an image forming apparatus, the improvement residing in the provision of a connector having an IC for signal communication with an electronic device in the main assembly through a connector in said main assembly, wherein said connector is disconnectably connectable with the connector in said main assembly, wherein said unit includes developing means for developing a latent image on an electrophotographic photosensitive member, wherein said unit further comprises:

a mounting portion;

a plurality of electrical contacts, a plurality of which are on one side of said mounting portion and the rest of which are on an opposite side thereof, for separably connecting with a contact of the main assembly connector when they are connected electrically with the main assembly connector; and a wall enclosing said mounting portion with a space between the inner surface of said wall and said electrical contacts on said mounting portion, wherein said IC is electrically connected with said electrical contacts with lead lines.

69. A unit detachably mountable relative to a main assembly of an image forming apparatus, the improvement residing in the provision of a connector having an IC for signal communication with an electronic device in the main assembly through a connector in said main assembly, wherein said connector is disconnectably connectable with the connector in said main assembly, wherein said unit is a toner cartridge for supplying toner to developing means, wherein said unit further comprises:

a mounting portion;

a plurality of electrical contacts, a plurality of which are on one side of said mounting portion and the rest of which are on an opposite side thereof, for separably connecting with a contact of the main assembly connector when they are connected electrically with the main assembly connector; and a wall enclosing said mounting portion with a space between the inner surface of said wall and said electrical contacts on said mounting portion, wherein said IC is electrically connected with said electrical contacts with lead lines.

70. An electrical connector for electrically connecting a main assembly of an electrophotographic image forming apparatus with a process cartridge detachably mountable to the main assembly, said electrical connector comprising:

a main-assembly connector; and a process-cartridge connector, electrically connected to said main-assembly connector when said process cartridge is mounted on the main assembly, wherein said process-cartridge connector comprises:

a connector main structure comprising:

an integrated circuit mount inside said connector main structure;

a plurality of a plurality of electrical contacts, a plurality of which are on one side of said integrated circuit mount and the rest of which are on an opposite side thereof, for separably connecting with an electrical contact of the main assembly connector when they are connected electrically with the main assembly connector;

a wall enclosing said integrated circuit mount with a space between the inner surface of said wall and said electrical contacts on said integrated circuit mount, wherein said wall comprises:

a base portion having a base side external wall; and an engagement portion having an engagement portion side external wall connected to said base side external wall, wherein said base side external wall and said engagement portion side external wall surround said integrated circuit mount;

wherein said integrated circuit mount is spaced from said base side external wall and said engagement portion side external wall to form therewith a continuous terminal mounting space which opens outward at the top and the bottom of said connector main structure;

an integrated circuit storing member mounted on said integrated circuit mount; and an electrical contact, in contact with said integrated circuit storing member and positioned inside said continuous terminal mounting space; and a connector mount portion for mounting said process-cartridge connector to said process cartridge, wherein said main-assembly connector comprises:

a connector main structure automatically engaged with said connector main structure of said process cartridge as said process cartridge is mounted on said main assembly, wherein said connector main structure of said main-assembly connector is attachable to a connector mount of the main assembly;

wiring, attached to and extending downwardly from said connector main structure; and an electrical contact, connected to the wiring, and engaged with said electrical contact of said process-cartridge connector when said process cartridge is mounted on said main assembly and said connector main structure of said main-assembly connector automatically engages said connector main structure of said process-cartridge connector.

71. The-electrical connector according to claim 70, wherein said connector main structure of said main-assembly connector comprises two screws extending downwardly therefrom, which are engagable with a connector mount of the main assembly in such a manner as to floatingly connect said connector main structure to the connector mount, thereby preventing imperfect alignment between the process cartridge and the main assembly from generating stress in said connector main structures of said main-assembly connector and said process-cartridge connector when said process cartridge is mounted on said main assembly and said connector main structure of said main-assembly connector automatically engages said connector main structure of said process-cartridge connector.

72. The electrical connector according to claim 70, wherein said connector main structure of said process-cartridge connector is composed of synthetic resin.

73. The electrical connector according to claim 70, wherein said connector main structure of said process-cartridge connector is hollow and has a substantially rectangular cross-section.

74. The electrical connector according to claim 70, wherein said base portion of said connector main structure of said process-cartridge connector is larger than said engagement portion of said connector main structure of said process-cartridge connector.

75. The electrical connector according to claim 70, wherein the longitudinal section of said integrated circuit mount is substantially T-shaped.

76. The electrical connector according to claim 70, wherein said electrical contact of said process-cartridge connector contacts said integrated circuit mount.

77. The electrical connector according to claim 76, wherein said electrical contact of said process-cartridge connector contacts said integrated circuit mount except at the bottom end thereof, wherein the bottom end of said process-cartridge-connector electrical contact is bent outward away from said integrated circuit mount.

78. The electrical connector according to claim 70, wherein said process-cartridge connector comprises a plurality of electrical contacts, wherein said integrated circuit storing member comprises lead wires, each of which directly press on one of said process-cartridge electrical contacts, wherein said integrated circuit storing member is electrically connected to said plurality of process-cartridge-connector electrical contacts by said lead wires.

79. The electrical connector according to claim 70, wherein said main-assembly-connector main structure comprises:

a mount portion comprising two screws extending downwardly therefrom for engagement with the main assembly; and an engagement port ion for engaging said engagement portion of said process-cartridge-connector main structure.

80. The electrical connector according to claim 79, wherein said engagement portion of said main-assembly-connector main structure is in the form of a rectangular parallelepiped.

81. The electrical connector according to claim 79, wherein said main-assembly connector electrically contacts an internal surface of said main-assembly connector engagement portion.

82. The electrical connector according to claim 79, wherein said engagement portion of said main-assembly connector main structure has a cavity therein in which said main-assembly connector electrical contact is disposed, wherein as the process cartridge is inserted into the image-forming-apparatus main assembly, an internal peripheral surface of said engagement portion of said process-cartridge connector main structure contacts the external peripheral surface of said engagement portion of said main-assembly connector main structure and the bottom portion of said process-cartridge connector electrical contact presses against said main-assembly connector electrical contact.

83. The electrical connector according to claim 70, wherein said integrated circuit storing member is positioned behind said process-cartridge-connector main structure relative to the direction in which said process-cartridge connector is connected to said main-assembly connector when said process cartridge is mounted to the main assembly.

84. The electrical connector according to claim 70, wherein said main-assembly connector main structure comprises an engagement portion for engaging with said process-cartridge-connector-main structure engagement portion, wherein the bottom end of said process-cartridge-connector engagement portion is tapered to guide said main-assembly-connector engagement portion when said process cartridge is mounted on the main assembly.

85. The electrical connector according to claims 4, 5, 7, or 8, wherein said storing member is mounted at a position upstream of said plurality of electrical contacts in a direction of connection of said plurality of electrical contacts with said main assembly connector.

86. The electrical connector according to claims 4, 5, 7, or 8, wherein free ends of said plurality of electrical contacts are provided inside said wall in a direction of the height of said wall, and in a direction in which a part of said main-assembly connector enters a space in said electrical connector.

87. The electrical connector according to claims 4, 5, 7, or 8, wherein said wall is composed of synthetic resin.

88. The electrical connector according to claims 4, 5, 7, or 8, wherein said electrical connector is hollow and has a substantially rectangular cross-section.

89. The electrical connector according to claims 4, 5, 7, or 8 wherein said electrical connector comprises a base portion and an engagement portion, wherein said storing member is attached to said base portion, wherein said plurality of electrical contacts extend through said base portion and said engagement portion, wherein said base portion is larger than said engagement portion.

90. The electrical connector according to claims 4, 5, 7, or 8, further comprising a mount for mounting said storing member, wherein the longitudinal section of said mount is substantially T-shaped.

91. The electrical connector according to claim 90, wherein said plurality of electrical contacts contact said mount except at the bottom end thereof, wherein the bottom end of said process-cartridge-connector electrical contact is bent outward away from said integrated circuit mount.

92. The unit according to claims 66, 67, 68, or 69, further comprising a plurality of electrical contacts for forming an electrical connection between said unit and the main assembly, wherein said IC is mounted on said unit connector at a position upstream of said plurality of electrical contacts in a direction of connection of said plurality of electrical contacts with said main assembly.

93. The unit according to claims 66, 67, 68, or 69 further comprising:

a plurality of electrical contacts for forming an electrical connection between said unit and the main assembly; and a wall enclosing said plurality of electrical contacts, wherein free ends of said plurality of electrical contacts are provided inside said wall in a direction of the height of said wall, and in a direction in which a part of said unit connector is connected to the main assembly connector.

94. The unit according to claims 66, 67, 68, or 69 wherein said unit connector is composed of synthetic resin.

95. The unit according to claims 66, 67, 68, or 69, wherein said unit connector has a substantially rectangular cross-section.

96. The unit according to claims 66, 67, 68, or 69, further comprising a plurality of electrical contacts for forming an electrical connection between said unit and the main assembly, wherein said unit connector comprises a base portion and an engagement portion, wherein said IC is attached to said base portion, wherein said plurality of electrical contacts extend through said base portion and said engagement portion, wherein said base portion is larger than said engagement portion.

97. The unit according to claims 66, 67, 68, or 69, further comprising a mount for mounting said IC, wherein the longitudinal section of said mount is substantially T-shaped.

98. The unit according to claims 97, further comprising a plurality of electrical contacts for forming an electrical connection between said unit and the main assembly, wherein said plurality of electrical contacts contact said mount except at the bottom end thereof, wherein the bottom end of said plurality of electrical contact is bent outward away from said mount.

99. An electrical connector electrically connectable with a main assembly connector, provided in a main assembly of an electrophotographic image forming apparatus, comprising:

a storing member for storing information;

a plurality of electrical contacts for separably connecting with a contact of said main assembly connector when they are connected electrically with said main assembly connector; and a wall provided so as to enclose said electrical contacts, wherein free ends of said electrical contacts are provided inside said wall in a direction of height of said wall, and wherein said storing member is electrically connected with each of said electrical contacts with lead lines, wherein said wall is provided with a taper adjacent an end for connection with said main assembly connector, wherein when said electrical connector is to be connected with the main assembly connector, it is guided by said taper, wherein said storing member is mounted at a position upstream of said plurality of electrical contacts in a direction of connection of said plurality of electrical contacts with said main assembly connector, wherein said free ends of said plurality of electrical contacts are provided inside said wall in a direction of the height of said wall, and in a direction in which a part of said main-assembly connector enters a space in said electrical connector, wherein said wall is composed of synthetic resin, wherein said electrical connector is hollow and has a substantially rectangular cross-section, and wherein said electrical connector comprises a base portion and an engagement portion, wherein said storing member is attached to said base portion, wherein said plurality-of electrical contacts extend through said base portion and said engagement portion, and wherein said base portion is larger than said engagement portion.

100. An electrical connector electrically connectable with a main assembly connector, provided in a main assembly of an electrophotographic image forming apparatus, comprising:

a storing member for storing information;

a plurality of electrical contacts for separably connecting with a contact of said main assembly connector when they are connected electrically with said main assembly connector;

wherein said storing member is electrically connected with said electrical contacts with lead lines; and a wall provided so as to enclose said electrical contacts, and wherein free ends of said electrical contacts, are provided inside said wall in a direction of height of said wall, wherein when said electrical connector is to be connected electrically with said main assembly connector, an engaging portion of said main assembly connector is engaged with a space formed between an inner surface of said wall and said electrical contacts, wherein said engaging portion is provided with a dimple, into which said electronic contacts of said electrical connector enter to be electrically connected with the electrical contacts, wherein said storing member is mounted at a position upstream of said plurality of electrical contacts in a direction of connection of said plurality of electrical contacts with said main assembly connector, wherein said free ends of said plurality of electrical contacts are provided inside said wall in a direction of the height of said wall, and in a direction in which a part of said main-assembly connector enters a space in said electrical connector, wherein said wall is composed of synthetic resin, wherein said electrical connector is hollow and has a substantially rectangular cross-section, and wherein said electrical connector comprises a base portion and an engagement portion, wherein said storing member is attached to said base portion, wherein said plurality of electrical contacts extend through said base portion and said engagement portion, and wherein said base portion is larger than said engagement portion.

101. A process-cartridge connector of a process cartridge, electrically connectable to a main-assembly connector of a main assembly of an electrophotographic image forming apparatus, for electrically connecting the main assembly of the electrophotographic image forming apparatus with the process cartridge when said process cartridge is mounted on the main assembly, said electrical connector comprising:

a connector main structure comprising:

an integrated circuit mount inside said connector main structure;

a plurality of a plurality of electrical contacts, a plurality of which are on one side of said integrated circuit mount and the rest of which are on an opposite side thereof, for separably connecting with an electrical contact of the main assembly connector when they are connected electrically with the main assembly connector;

a wall enclosing said integrated circuit mount with a space between the inner surface of said wall and said electrical contacts on said integrated circuit mount, wherein said wall comprises:

a base portion having a base side external wall; and an engagement portion having an engagement portion side external wall connected to said base side external wall, wherein said base side external wall and said engagement portion side external wall surround said integrated circuit mount;

wherein said integrated circuit mount is spaced from said base side external wall and said engagement portion side external wall to form therewith a continuous terminal mounting space which opens outward at the top and the bottom of said connector main structure;

an integrated circuit storing member mounted on said integrated circuit mount;

an electrical contact, in contact with said integrated circuit storing member and positioned inside said continuous terminal mounting space; and a connector mount portion for mounting said process-cartridge connector to said process cartridge, wherein said connector main structure of said process cartridge automatically engages the connector main structure of the main-assembly connector as said process cartridge is mounted on said main assembly, and wherein electrical contact of said process-cartridge connector engages an electrical contact of the main-assembly connector when said process cartridge is mounted on the main assembly and the connector main structure of the main-assembly connector automatically engages said connector main structure of said process-cartridge connector.

102. The process-cartridge connector according to claim 101, wherein said connector main structure of said process-cartridge connector is composed of synthetic resin.

103. The process-cartridge connector according to claim 101, wherein said connector main structure of said process-cartridge connector is hollow and has a substantially rectangular cross-section.

104. The process-cartridge connector according to claim 101, wherein said base portion of said connector main structure of said process-cartridge connector is larger than said engagement portion of the connector main structure of said process-cartridge connector.

105. The process-cartridge connector according to claim 101, wherein the longitudinal section of said integrated circuit mount is substantially T-shaped.

106. The process-cartridge connector according to claim 101, wherein said electrical contact of said process-cartridge connector contacts said integrated circuit mount.

107. The process-cartridge connector according to claim 106, wherein said electrical contact of said process-cartridge connector contacts said integrated circuit mount except at the bottom end thereof, wherein the bottom end of said process-cartridge-connector electrical contact is bent outward away from said integrated circuit mount.

108. The process-cartridge connector according to claim 101, wherein said integrated circuit storing member comprises lead wires, each of which directly press on one of said process-cartridge electrical contacts, wherein said integrated circuit storing member is electrically connected to said plurality of process-cartridge-connector electrical contacts by said lead wires.

109. The process-cartridge connector according to claim 101, wherein said integrated circuit storing member is positioned behind said process-cartridge-connector main structure relative to the direction in which said process-cartridge connector is connected to the main-assembly connector when said process cartridge is mounted to the main assembly.

* * * * *

UNITED STATES PATENT AND TRADEMARK OFFICE

CERTIFICATE OF CORRECTION

PATENT NO. : 6,097,908 
DATED : August 1, 2000
INVENTOR(S) : Seiji Uchiyama et al.

It is certified that error appears in the above-identified patent and that said Letters Patent is hereby corrected as shown below:

Drawings,
SHEET 3,
FIG. 3, “FEEDRE” should read -- FEEDER --;
FIG. 3, “SCANER” should read -- SCANNER --; and
FIG. 3, “BUICT-IN CAL & CLOK” should read -- BUILT-IN CAL & CLOCK --.

Column 1,
Line 47, “process,” should read -- process --; and
Line 48, “simply” should read -- simple --.

Column 2,
Line 32, “cartridge” should read -- cartridge, --.

Column 3,
Line 23, “FIG: 2” should read -- FIG. 2 --;
Line 37, “therefore.” should read -- thereof. --;
Line 40, “the” should read -- the structure --;
Line 41, “FIGS. 8(*a*), 8(*b*) 8(*c*)” should read -- FIGS. 8(*a*), 8(*b*) and 8(*c*) --; and
Line 64, “FIGS. 15(*b*) and 15(*a*)” should read -- FIGS. 15(*a*) and 15(*b*) --.

Column 4,
Line 20, “apparatus” should read -- apparatus is --.

Column 6,
Line 28, “exchanging” should read -- exchanging input --;
Line 60, “portion” should read -- portions --; and
Line 65, “is” should read -- are --.

Column 8,
Line 55, “53*a*of” should read -- 53*a* of --.

Column 9,
Line 18, “provide” should read -- provided --;
Line 19, “groove” should read -- grooves --; and
Line 37, “member” should read -- members --.

Column 10,
Line 7, “FIG. 7(*a*)” should read -- FIG. 7(*a*), --;
Line 20, “portion” should read -- portions --;
Line 40, “members” should read -- member --; and
Line 48, “projection” should read -- projections --.

UNITED STATES PATENT AND TRADEMARK OFFICE

CERTIFICATE OF CORRECTION

PATENT NO. : 6,097,908
DATED : August 1, 2000
INVENTOR(S) : Seiji Uchiyama et al.

It is certified that error appears in the above-identified patent and that said Letters Patent is hereby corrected as shown below:

Column 11,
Line 8, "protection" should read -- projections --;
Line 17, "protections" should read -- projections --;
Line 26, "coating in advance the connector support members 66 and" should read -- coating with adhesive, in advance, --;
Line 27, "67 with adhesive," should be deleted; and
Line 29, "separated" should read -- separate --.

Column 12,
Line 10, "term" should read -- terms --; and
Line 64, "such" should read -- such as --.

Column 14,
Line 4, "protection" should read -- projection --; and
Line 20, "mains" should read -- main --.

Column 16,
Line 6, "in" should read -- into --.

Column 17,
Line 56, "space:" should read -- space; --; and
Line 59, "being is" should read -- being --.

Column 19,
Line 29, "lines;" should read -- lines, --.

Column 20,
Line 54, "grove," should read -- groove, --.

Column 21,
Line 11, "herein" should read -- wherein --;
Line 35, "assure a" should read -- assure --; and
Line 36, "degree" should read -- degrees --.

Columns 21-22,
Lines 1-67, should be deleted (duplication) (Certificate of Correction entered February 24, 2004).

UNITED STATES PATENT AND TRADEMARK OFFICE

CERTIFICATE OF CORRECTION

PATENT NO. : 6,097,908
DATED : August 1, 2000
INVENTOR(S) : Seiji Uchiyama et al.

It is certified that error appears in the above-identified patent and that said Letters Patent is hereby corrected as shown below:

Column 22,
Line 18, “assure a” should read -- assure --; and
Line 43, “remaining” should read -- remaining on --.

Column 23,
Line 28, “assure a” should read -- assure --; and
Line 55, “comprising;” should read -- comprising: --.

Columns 23-24,
Lines 1-67, should be deleted (duplication) (Certificate of Correction entered February 24, 2004).

Column 24,
Line 44, “assure a” should read -- assure --.

Columns 25-26,
Lines 1-67, should be deleted (duplication) (Certificate of Correction entered February 24, 2004).

Column 25,
Line 40, “assure a” should read -- assure --;
Line 59, “electro photographic” should read -- electrophotographic --; and
Line 66, “-contacts” should read -- contacts --.

Column 26,
Line 13, “comprising,” should read -- comprising: --;
Line 56, “a. a” should read -- a) a --;
Line 57, “a) a” should read -- a --; and
Line 61, “a” should read -- ¶ a --.

Columns 27-28,
Lines 1-67, should be deleted (duplication) (Certificate of Correction entered February 24, 2004).

Column 27,
Line 36, “delivers” close left margin.

UNITED STATES PATENT AND TRADEMARK OFFICE

CERTIFICATE OF CORRECTION

PATENT NO. : 6,097,908
DATED : August 1, 2000
INVENTOR(S) : Seiji Uchiyama et al.

It is certified that error appears in the above-identified patent and that said Letters Patent is hereby corrected as shown below:

Column 28,
Line 17, “o as” should read -- so as --;
Line 20, “wherein” should read -- wherein a --; and
Line 30, “supporting” should read -- supporting member --.

Column 31,
Line 5, “The-electrical” should read -- The electrical --; and
Line 57, “port ion” should read -- portion --.

Column 33,
Line 27, “claims” should read -- claim --.

Column 34,
Line 4, “plurality-of” should read -- plurality of --.

Signed and Sealed this

Eighteenth Day of October, 2005

JON W. DUDAS
*Director of the United States Patent and Trademark Office*